US011053102B2

(12) United States Patent
Gok et al.

(10) Patent No.: US 11,053,102 B2
(45) Date of Patent: Jul. 6, 2021

(54) GANTRY SYSTEM FOR REPLACING FULL TRACKSIDE GIRDERS UNDER THE STATION PLATFORM AND INSTALLING PRECAST PLATFORM PANELS

(71) Applicant: E.E. Cruz & Company, Inc., New York, NY (US)

(72) Inventors: Mustafa Gok, Highland Park, NJ (US); Suleybe Sen, Brooklyn, NY (US); Alejandra Villegas, Oceanside, NY (US)

(73) Assignee: E.E. Cruz & Company, Inc., New York, NY (US)

( * ) Notice: Subject to any disclaimer, the term of this patent is extended or adjusted under 35 U.S.C. 154(b) by 34 days.

(21) Appl. No.: 16/566,403

(22) Filed: Sep. 10, 2019

(65) Prior Publication Data

US 2020/0079625 A1 Mar. 12, 2020

Related U.S. Application Data

(60) Provisional application No. 62/729,138, filed on Sep. 10, 2018.

(51) Int. Cl.

| | |
|---|---|
| ***B66C 17/06*** | (2006.01) |
| ***B66C 23/50*** | (2006.01) |
| ***B66C 19/00*** | (2006.01) |

(52) U.S. Cl.

CPC ..... *B66C 19/005* (2013.01); *B66C 17/06* (2013.01)

(58) Field of Classification Search

CPC ..... B66C 17/06; B66C 9/02; B66C 23/022; B66C 23/163; B66C 23/36; B66C 23/50; B66C 2700/0328; B66C 2700/0335; B66C 2700/0385; E04B 5/02

See application file for complete search history.

(56) References Cited

U.S. PATENT DOCUMENTS

| | | | | |
|---|---|---|---|---|
| 3,263,628 | A * | 8/1966 | Grove | B60F 1/043 105/72.2 |
| 3,269,331 | A * | 8/1966 | Thompson | B60F 1/043 105/72.2 |
| 5,518,128 | A * | 5/1996 | Kroll | B66C 23/50 212/196 |
| 2003/0172837 | A1* | 9/2003 | Whiston | B61D 15/00 105/215.2 |
| 2019/0085516 | A1* | 3/2019 | Liu | B66C 9/00 |

FOREIGN PATENT DOCUMENTS

| | | | | |
|---|---|---|---|---|
| FR | 3057279 | A1 * | 4/2018 | B66C 23/50 |

* cited by examiner

*Primary Examiner* — Michael R Mansen
*Assistant Examiner* — Juan J Campos, Jr.
(74) *Attorney, Agent, or Firm* — Troutman Pepper Hamilton Sanders LLP

(57) ABSTRACT

A gantry system has at least one crane assembly, at least one support post, and at least one hoist. The crane assembly has a stationary base, a rotating base, and a crane arm. The rotating base is attached to both the stationary base and the crane arm in such a ways as to allow the rotating base and the crane arm to rotate while the stationary base remains stationary. The crane arm is supported on its far end by a support post. The crane assembly is configured such that the support post rests on an in-place girder. A hoist is attached and can move along the crane arm to position a railway component, such as a replacement girder and/or a precast panel.

12 Claims, 58 Drawing Sheets

GANTRY SYSTEM FOR REPLACING FULL TRACKSIDE GIRDERS UNDER THE STATION PLATFORM AND INSTALLING PRECAST PLATFORM PANELS

CROSS REFERENCE TO RELATED APPLICATIONS

This application claims the benefit of priority of U.S. Provisional Patent Application Ser. No. 62/729,138, filed on Sep. 10, 2018, the entire contents of which is hereby incorporated by reference herein.

TECHNICAL FIELD

The present disclosure generally relates to a girder lifting device, and more particularly to a girder lifting device with a support post for supporting the lifting device on an existing girder while placing another girder.

BACKGROUND

Typically, I-beam girders are placed to span columns and provide support to the platforms at elevated railroad and subway stations. Periodically, they need to be removed for repair or replacement. To remove them, a crane is usually used from street-level to first lift off the pre-cast slabs that make up the platform's floor and then lift the girder. The crane then lowers a new girder and reinstalls the platform's pre-cast slabs. Various cranes have been developed that allow for the lifting of girders and concrete slabs. Most cranes are designed so that they must be staged on the street-side of the platform because they are too big to be staged on the railroad track side of the platform. However, such devices are not helpful when the street-side cannot accommodate a crane and a crane must be used from the railroad side. The present disclosure is directed to a gantry system that overcomes these and other problems of the prior art.

SUMMARY

In some embodiments, the present disclosure is directed to a gantry device for lifting a railroad girder. The device includes at least one crane assembly. The crane assembly has a stationary base that is attached to a ground. On top of the stationary base is a rotating base. The rotating base can spin around its axis while the stationary base remains stationary. On top of the rotating base is a crane arm. The crane arm is a long I-beam that is perpendicularly attached to the crane arm. When fully assembled, support posts sit on the top of a ground and underneath the crane arm. The support post will help support the weight of the load. Attached to the crane arm is a hoist. The hoist attaches to a load and moves the load along the length of the crane arm.

In another embodiment, the present disclosure is directed to a gantry device for lifting pre-cast slabs. The device includes at least two crane assemblies. The crane assembly has a stationary base that is attached to a ground. On top of the stationary base is a rotating base. The rotating base can spin around its axis while the stationary base remains stationary. On top of the rotating base is a crane arm. The crane arm is a long I-beam that is perpendicularly attached to the crane arm. When fully assembled, support posts sit on the top of a ground and underneath the crane arm. Between the crane arms is a trolley beam that can move along the length of the crane arms. On the trolley beam is a hoist. The hoist attaches to a load. The load can be moved laterally along the trolley beam via the hoist or along the crane arms via the trolley beam.

Additional features and advantages of the invention will be made apparent from the following detailed description of illustrative embodiments that proceeds with reference to the accompanying drawings.

BRIEF DESCRIPTION OF THE DRAWINGS

The foregoing and other aspects of the present disclosure are best understood from the following detailed description when read in connection with the accompanying drawings. For the purpose of illustrating the disclosure, there is shown in the drawings embodiments that are presently preferred, it being understood, however, that the disclosure is not limited to the specific embodiments disclosed.

DETAILED DESCRIPTION OF ILLUSTRATED EMBODIMENTS

The present disclosure describes embodiments of a gantry system. The gantry system includes at least one crane assembly, at least one support post, and at least one hoist. The crane assembly includes a stationary base, a rotating base, and a crane arm. The rotating base is attached to both the stationary base and the crane arm in such a ways as to allow the rotating base and the crane arm to rotate while the stationary base remains stationary. The crane arm is supported on its far end by a support post. The crane assembly is configured such that the support post rests on an in-place girder. A hoist is attached and can move along the crane arm.

In at least some embodiments, the crane arm is configured in multiple parts. For example, a base arm may be attached to the rotating base and an arm extension may be attached to the rotating base. The connection may hinged such that the arm extension may be folded in to shorten the length of the crane arm, or folded out to lengthen the length of the crane arm. In some embodiments, a truss is connected to the rotating base and the crane arm.

In some embodiments, two crane assembles with associated support posts and hoists make up the gantry system. In some embodiments, the gantry system includes two support posts, two crane assemblies, and a hoist connected between them via a trolley beam.

Figure 1:
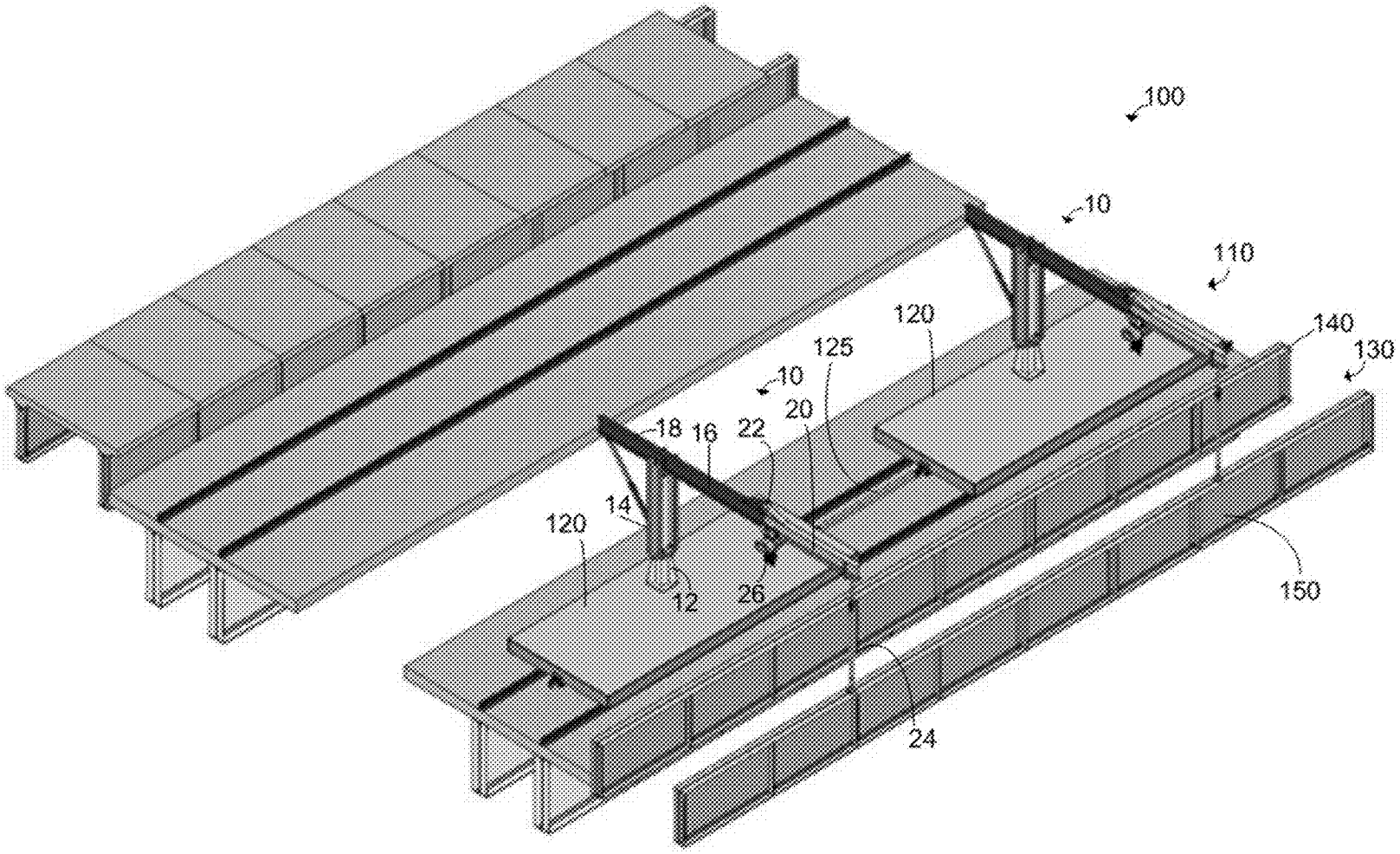
FIG. 1 is a perspective view an exemplary gantry system with a near and far girder in position, consistent with disclosed embodiments.
Figure 2:
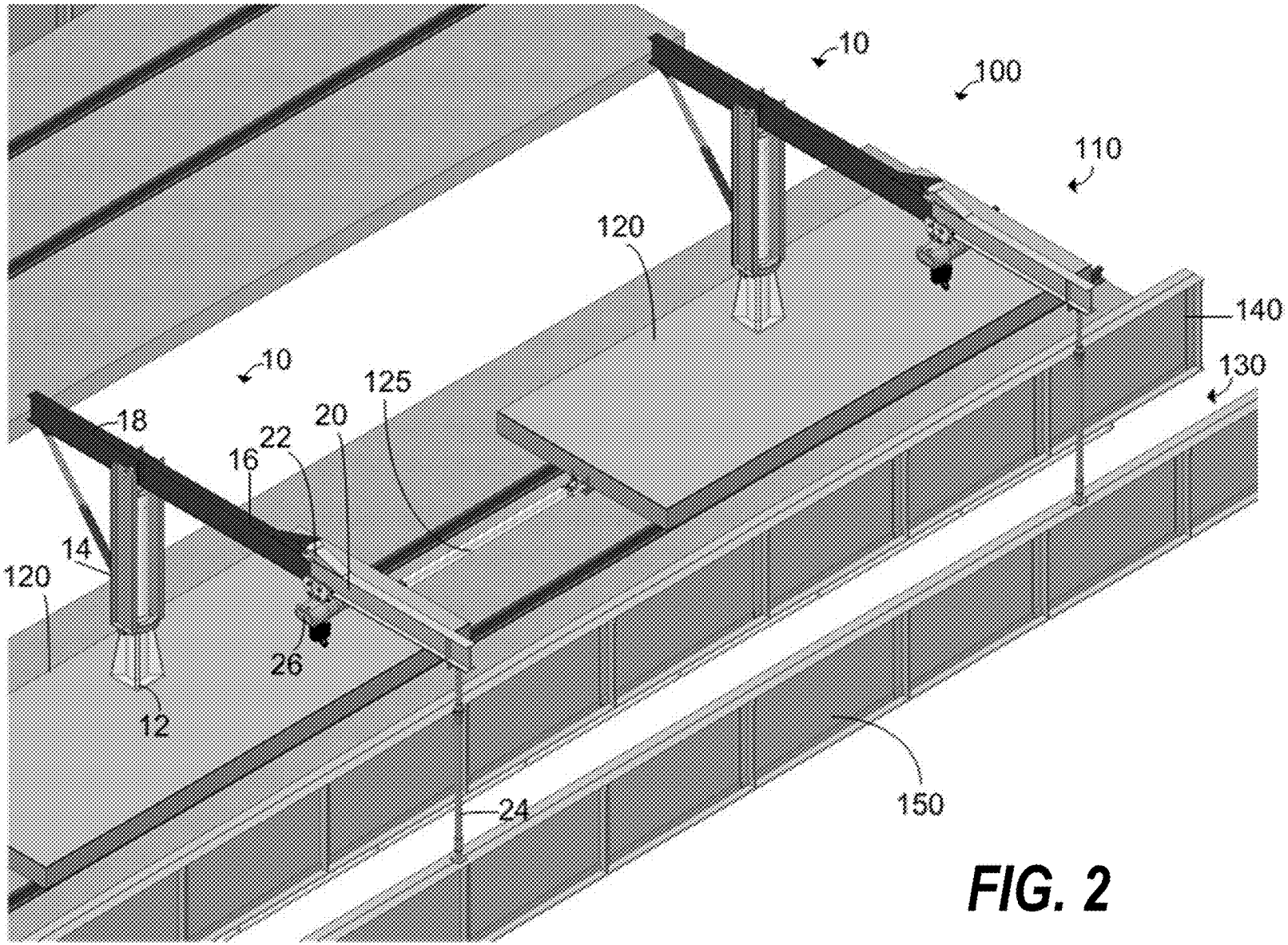
FIG. 2 is a close-up perspective view of the gantry system of FIG. 1.

FIGS. 1-2 are perspective views of an exemplary embodiment of a gantry system 100. The gantry system 100 is configured to be used in conjunction with a railway area 110 having one or more rails for train cars, subway cars, etc. In an exemplary embodiment, the gantry system 100 includes one or more moveable platforms 120 configured to move along the one or more rails of the railway area 110. The railway area 110 may be adjacent to a platform area 130 which includes a near girder 140 and a far girder 150 for supporting a platform (e.g., for supporting passengers for boarding and exiting a train car).

Figure 58:
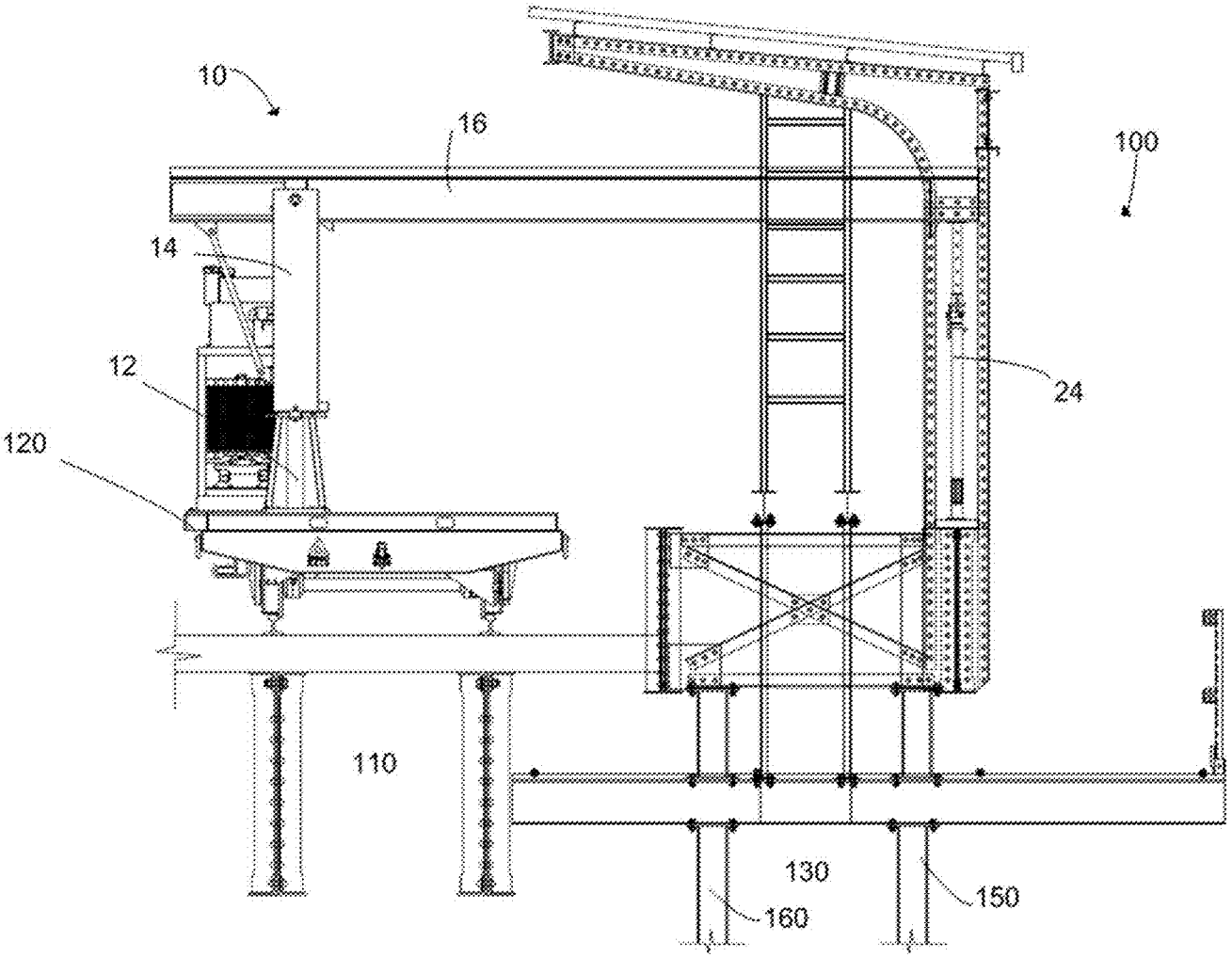
FIG. 58 is a side view of an exemplary crane assembly, according to an additional embodiment without a hinge mechanism, consistent with disclosed embodiments.

In an exemplary embodiment, the gantry system 100 may include a pair of crane assemblies 10. The crane assembly 10 includes a stationary base 12, a rotating base 14, and a crane arm 16. The stationary base 12 is preferably configured to be attached to one of the movable platforms 120. The rotating base 14 is configured to rotate with respect to the stationary base 12. The rotating base 14 may be configured to be fixed vertically and to share a common axis with the stationary base 12. The crane arm 16 is attached perpendicularly to the rotating base 14. In some embodiments, the crane arm 16 includes a base arm 18 hingedly connected to an extension arm 20. In some embodiments, the crane arm is an integral piece from a proximal end to a distal end. For example, FIG. 58 illustrates an exemplary embodiment of a crane assembly 10A having a one-piece crane arm 16A. Other embodiments may include, for example, a telescoping crane arm, crane arm that hinges at multiple points, a multi-piece removable crane arm, etc.

In the illustrated hinged embodiment, the base arm 18 may be attached perpendicularly to the rotating base 14. The arm extension 20 may be attached to the base arm 18 via a hinge mechanism 22 such that the arm extension 20 can be folded into the base arm 18 or extended out. It should be understood that the hinge mechanism 22 is optional. FIG. 58 illustrates an alternative embodiment of the crane assembly 10 without a hinge mechanism 22.

Figure 3:
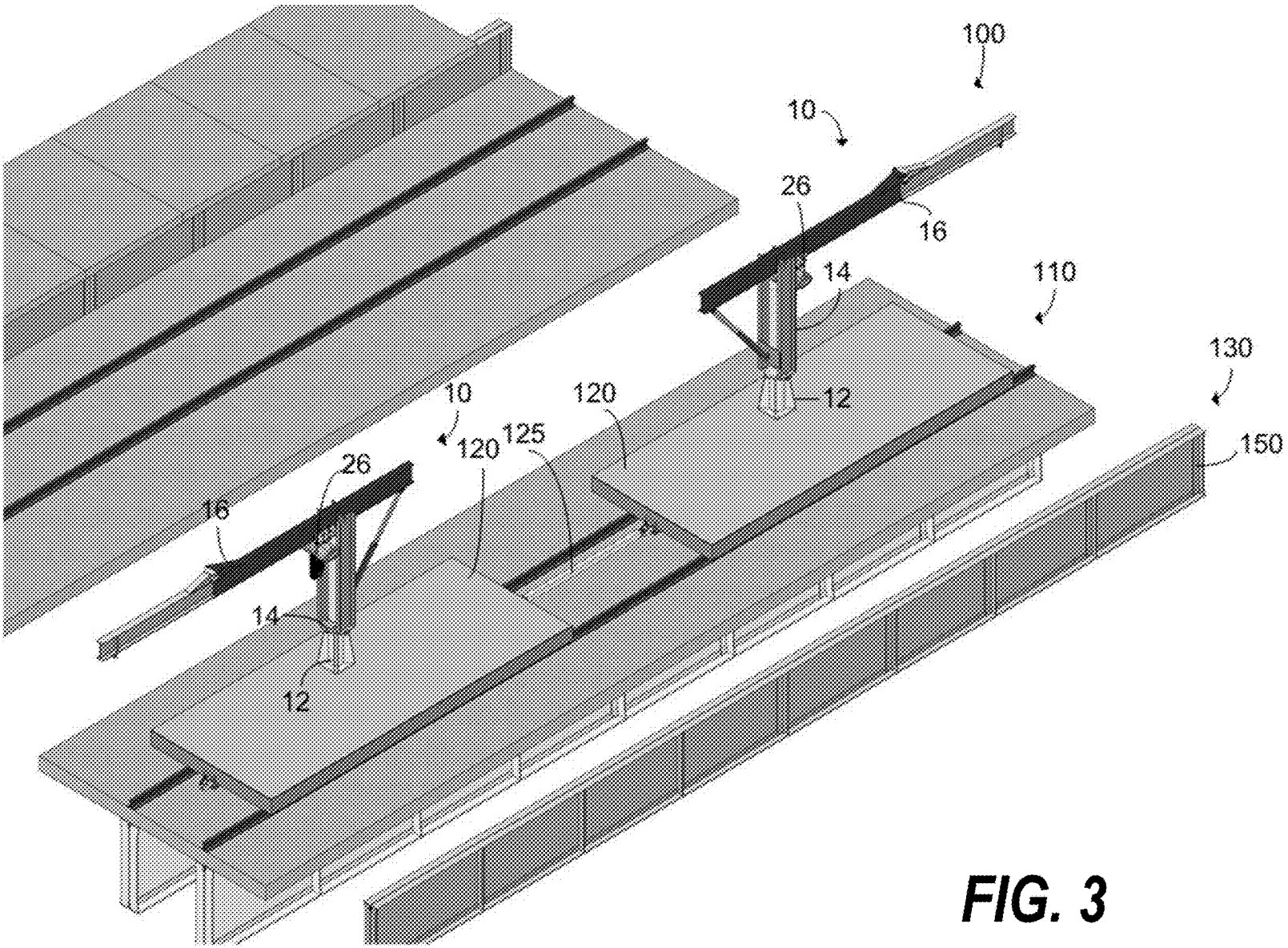
FIG. 3 is a perspective view of a stowed position of the gantry system of FIG. 1, consistent with disclosed embodiments.
Figure 4:
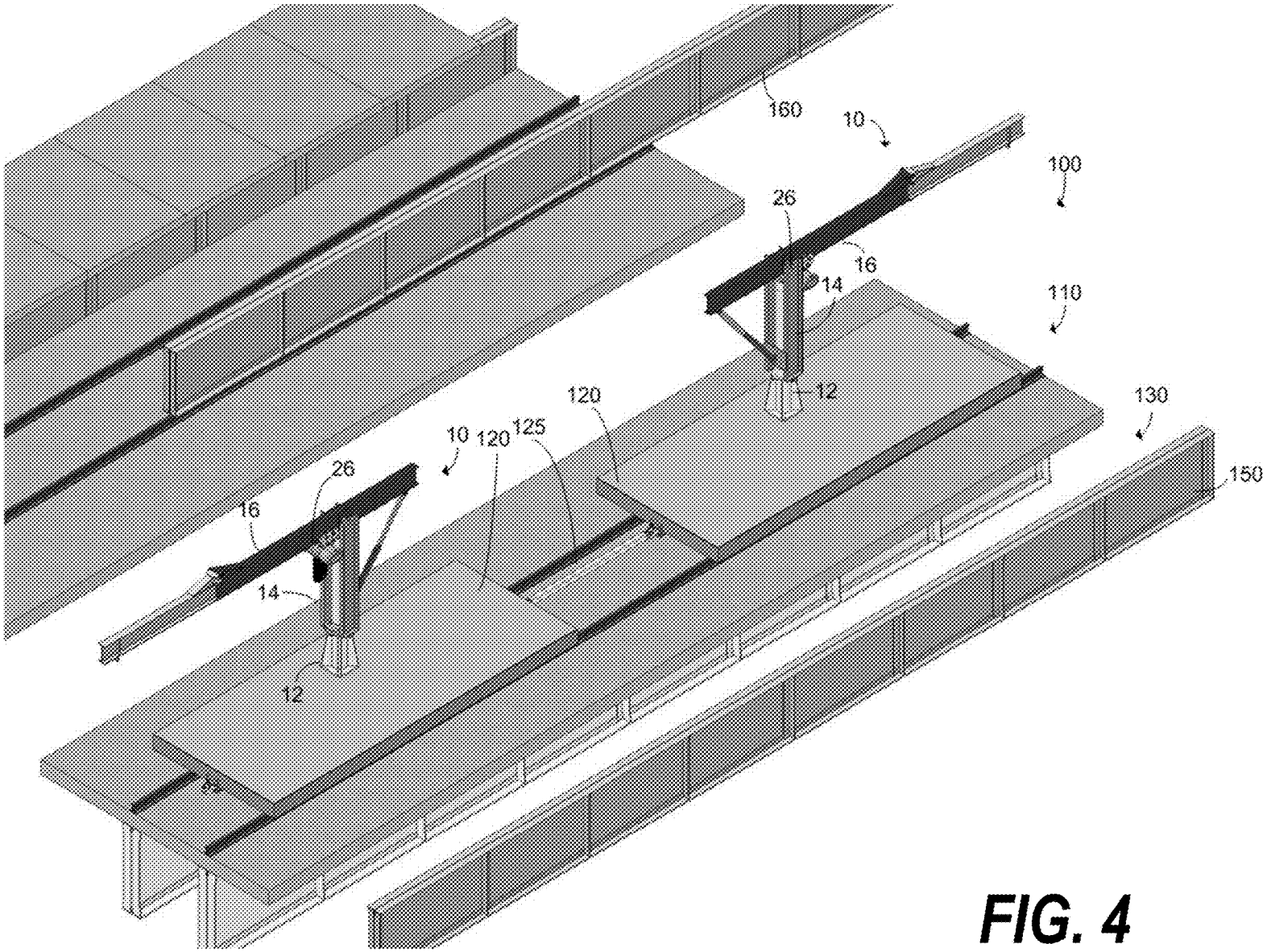
FIGS. 4-6 are perspective views of the gantry system of FIG. 3, illustrating a replacement girder being lowered a support area of the gantry system.
Figure 5:
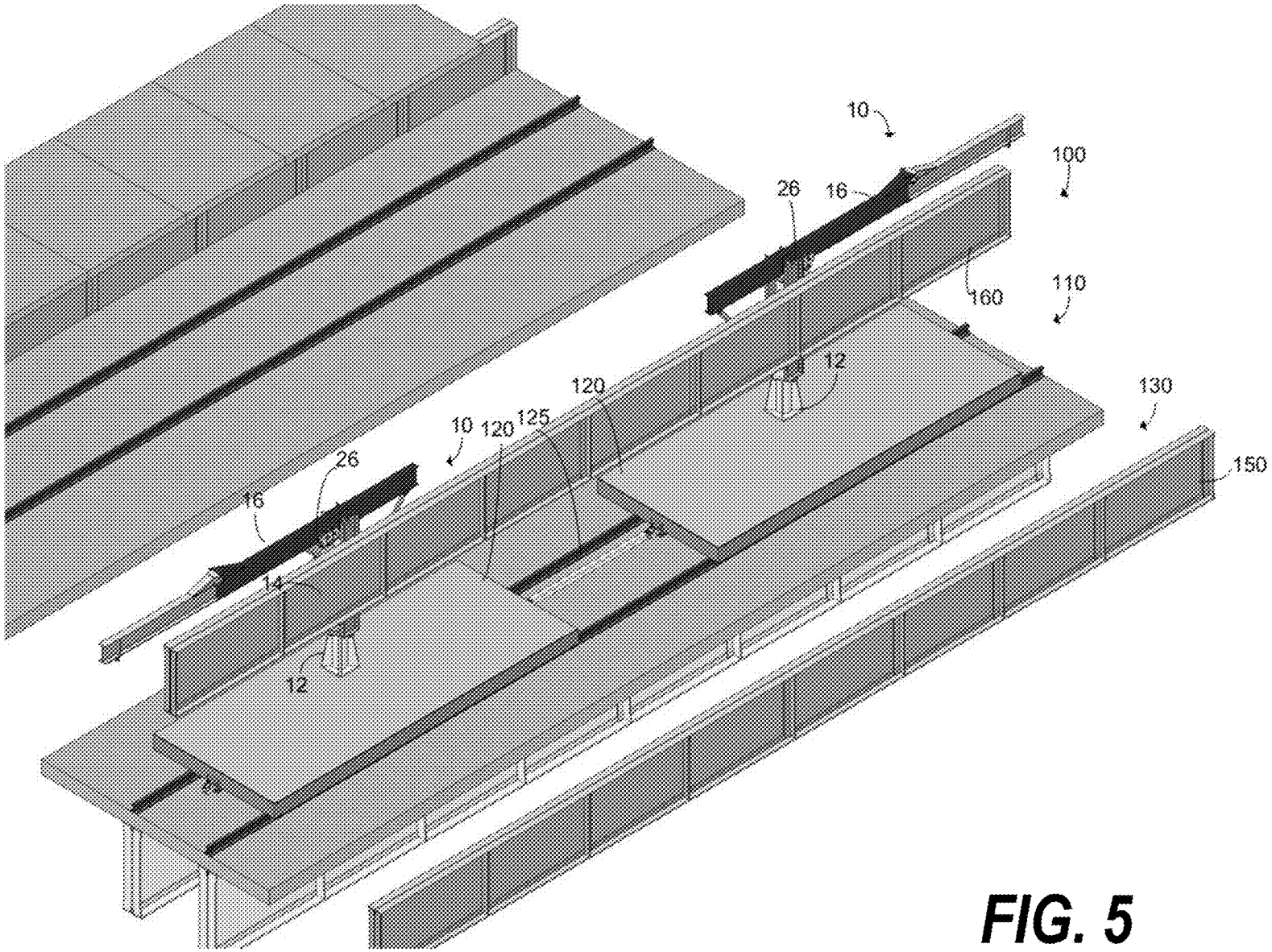

FIGS. 3-5 illustrate the gantry system 100 with the crane assemblies 10 being in a stowed position. In the stowed position, the crane arms 16 extend parallel to the direction of travel of the movable platforms 120 (and the rails of the railway area 110). In this way, the crane assemblies 10 may easily move along the rails without extending out into the platform area 130 and potential obstructions. This allows the gantry system 100 to be positioned in hard-to-reach and confined areas of a train or subway station, for example.

Figure 6:
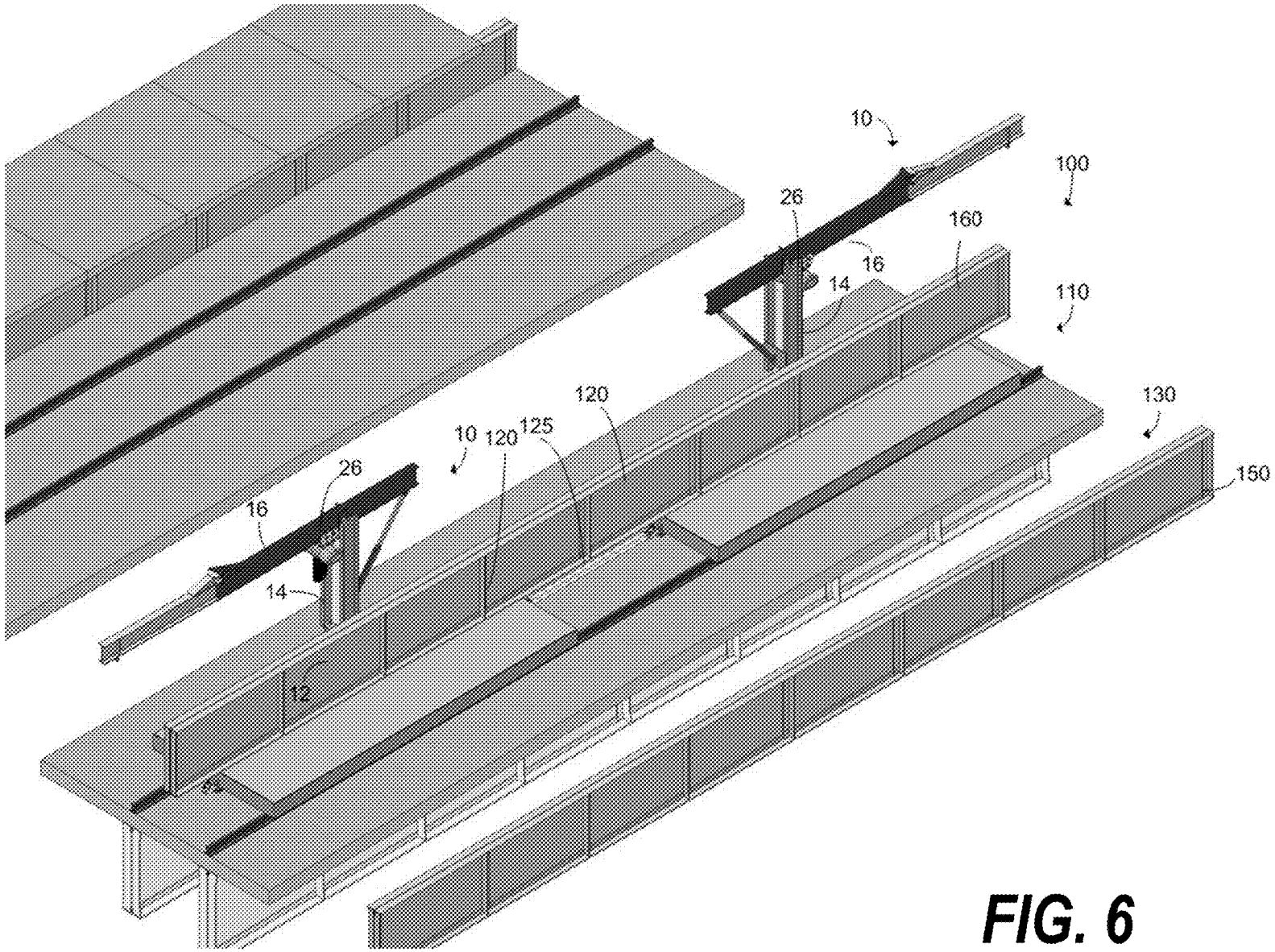
Figure 7:
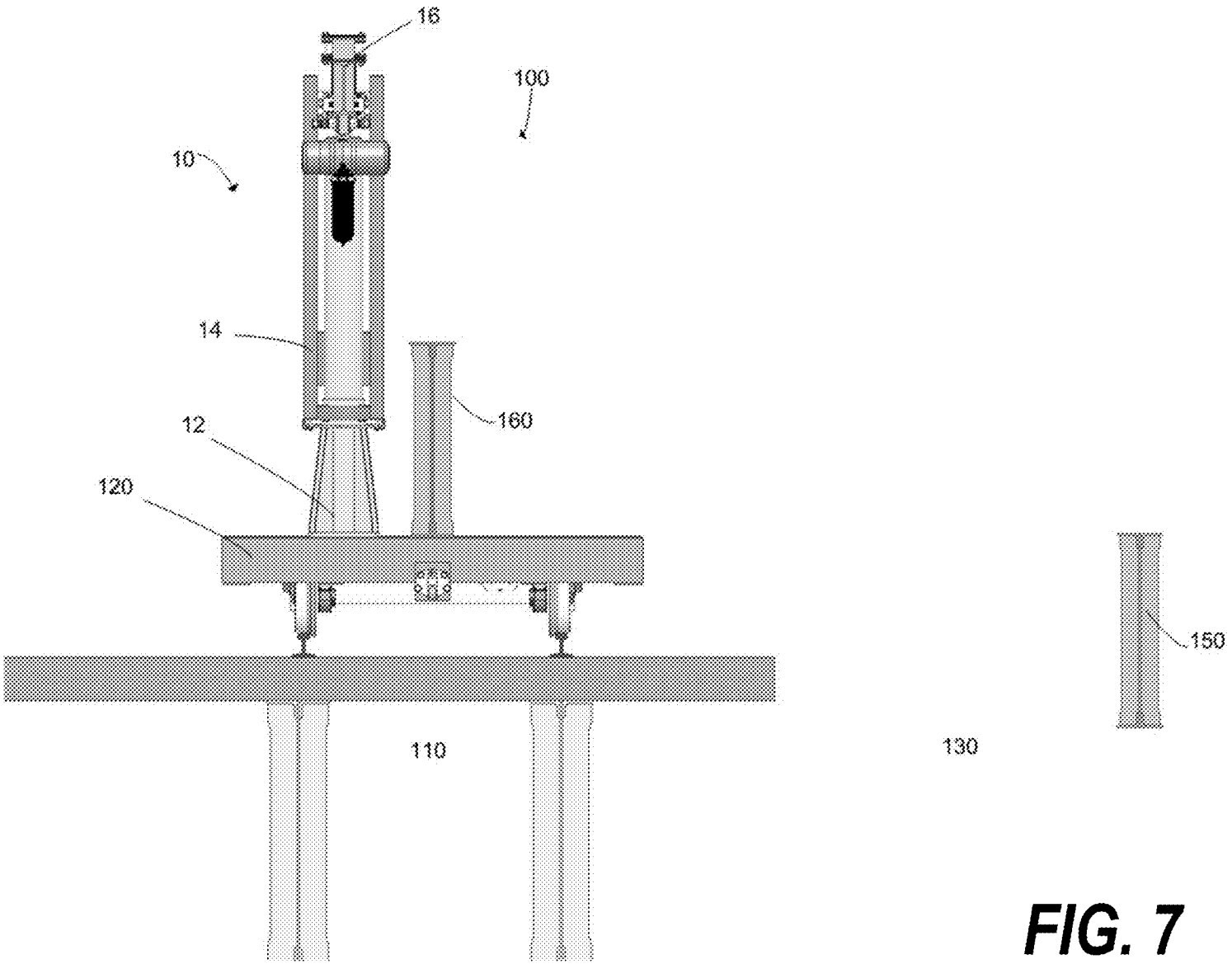
FIG. 7 is a side view of the gantry system of FIG. 6, with a far girder in position and the replacement girder on the support area of the gantry system, consistent with disclosed embodiments.
Figure 8:
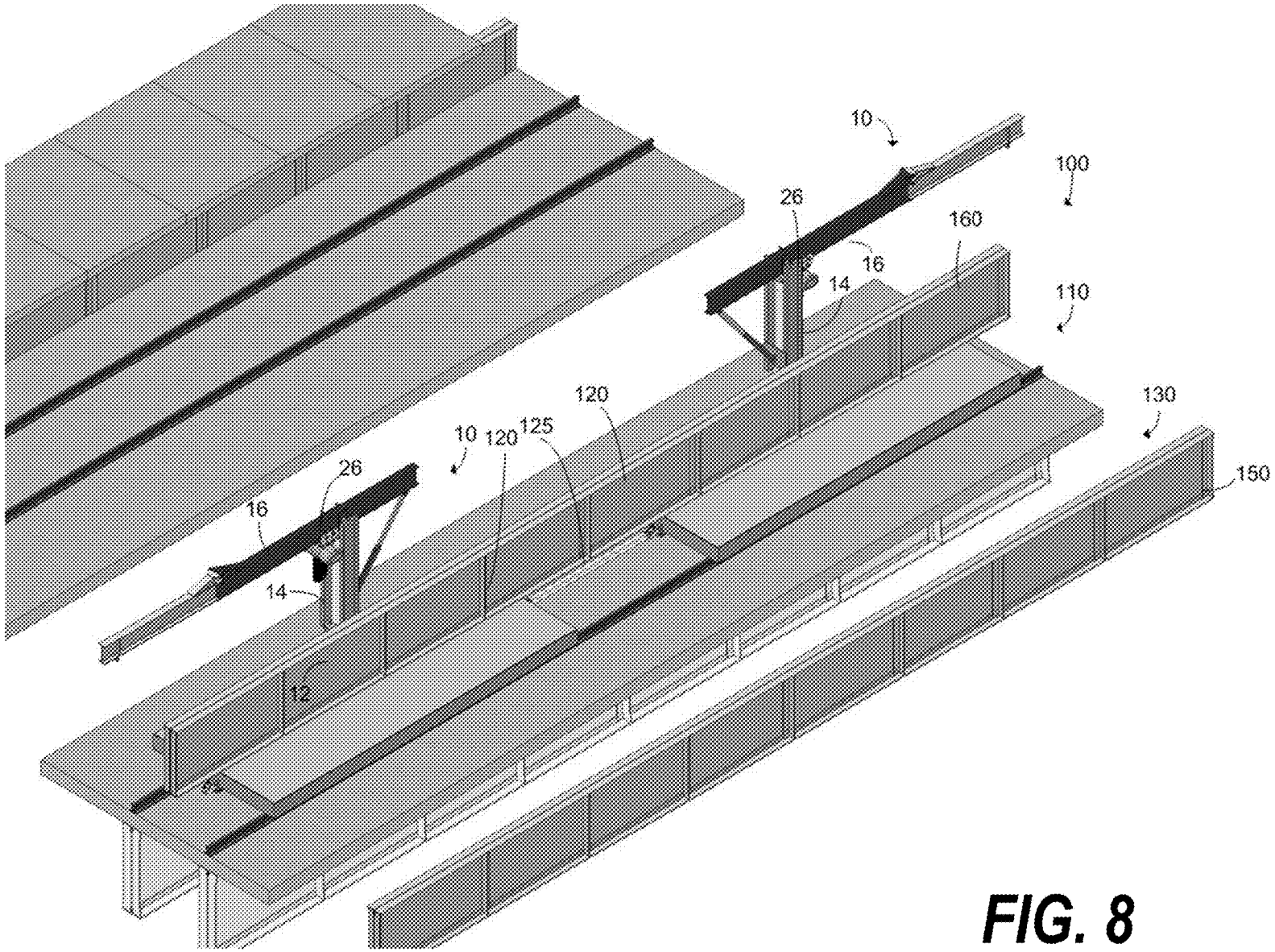
FIGS. 8-10 are perspective views of the gantry system of FIG. 3, illustrating lift arms being moved into an action position.
Figure 9:
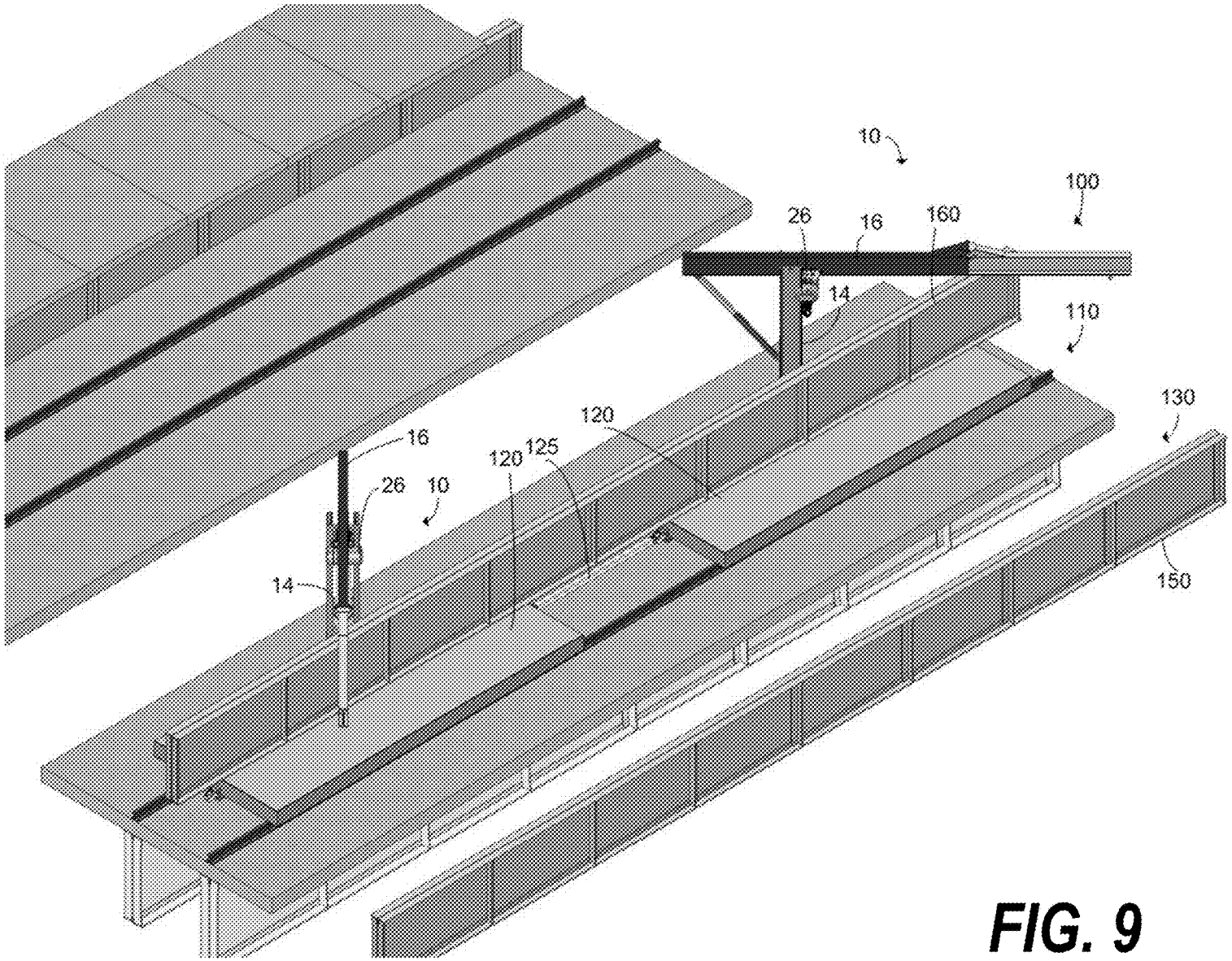
Figure 10:
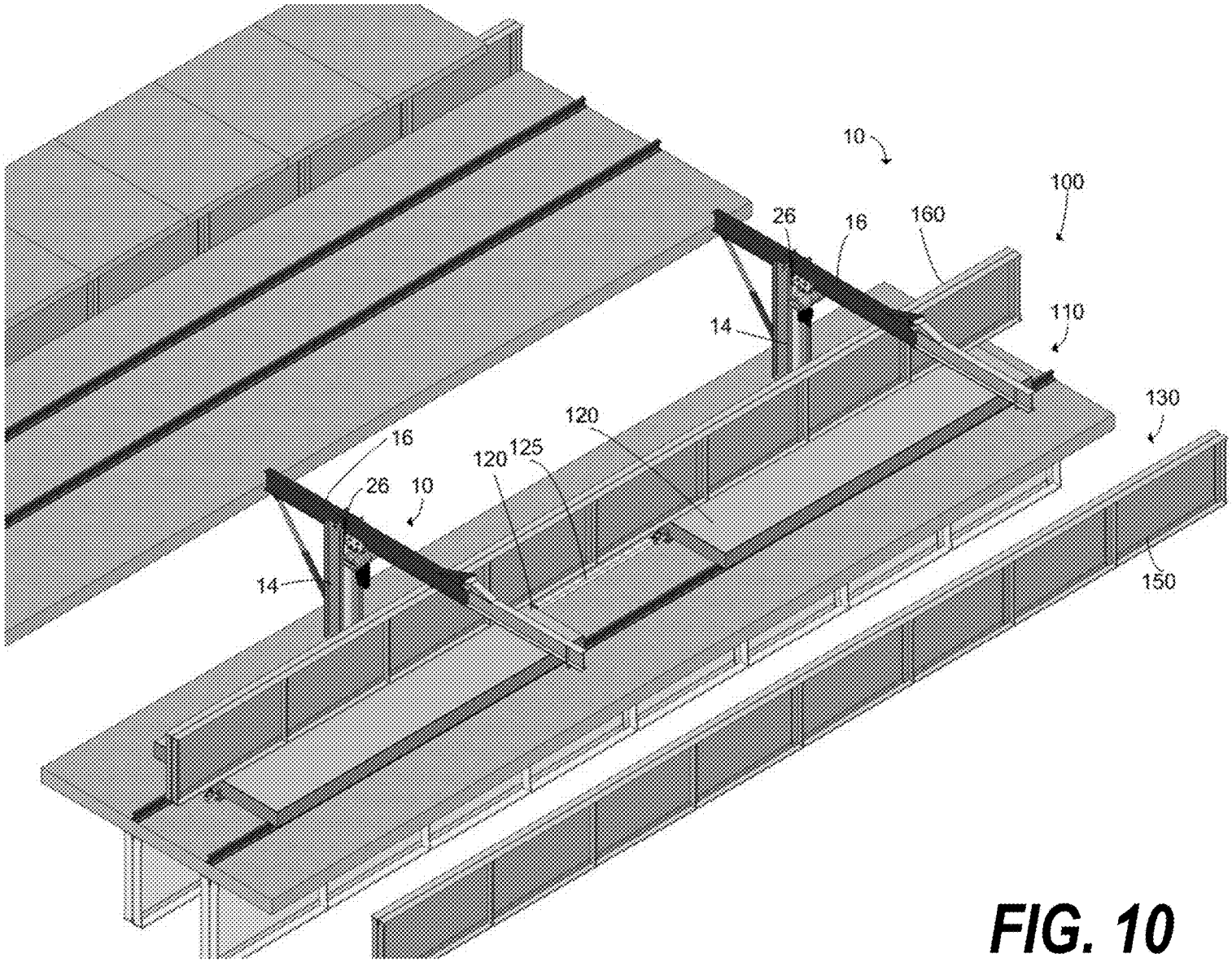

FIGS. 6-8 illustrate the gantry system 100 with a replacement girder 160 for being positioned and replacing the near girder 140 of FIG. 1. The replacement girder 160 may be placed on the moveable platforms 120 which are then moved into position via the rails of the railway area 110. FIGS. 9 and 10 illustrate the crane arms 16 being moved into place from a stowed position to an action position in which the crane arms 16 are perpendicular to the rails of the railway and perpendicular to the replacement girder 160.

Figure 11:
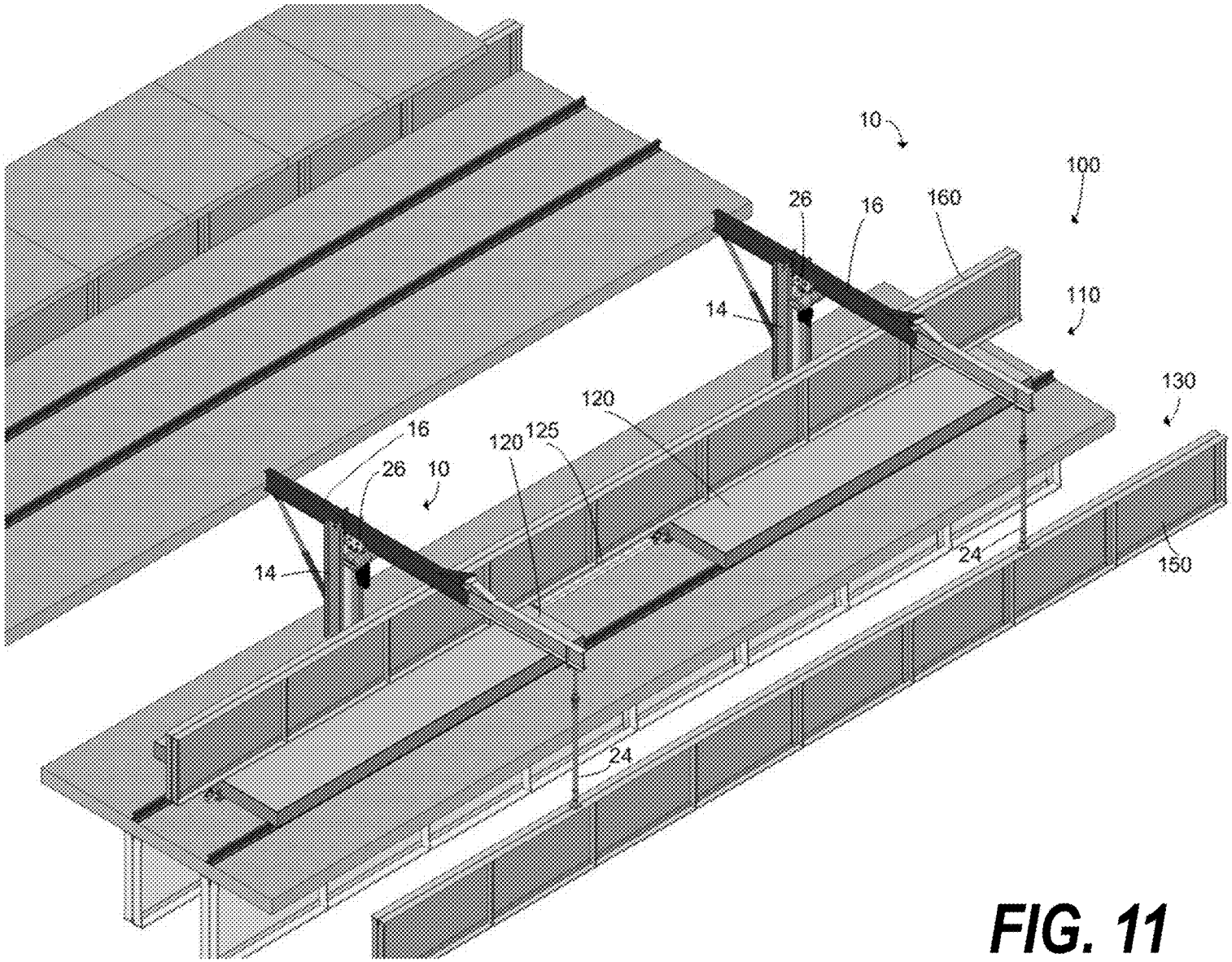
FIG. 11 is a perspective view of the gantry system of FIG. 3, illustrating support posts being positioned for support on the far girder, consistent with disclosed embodiments.
Figure 12:
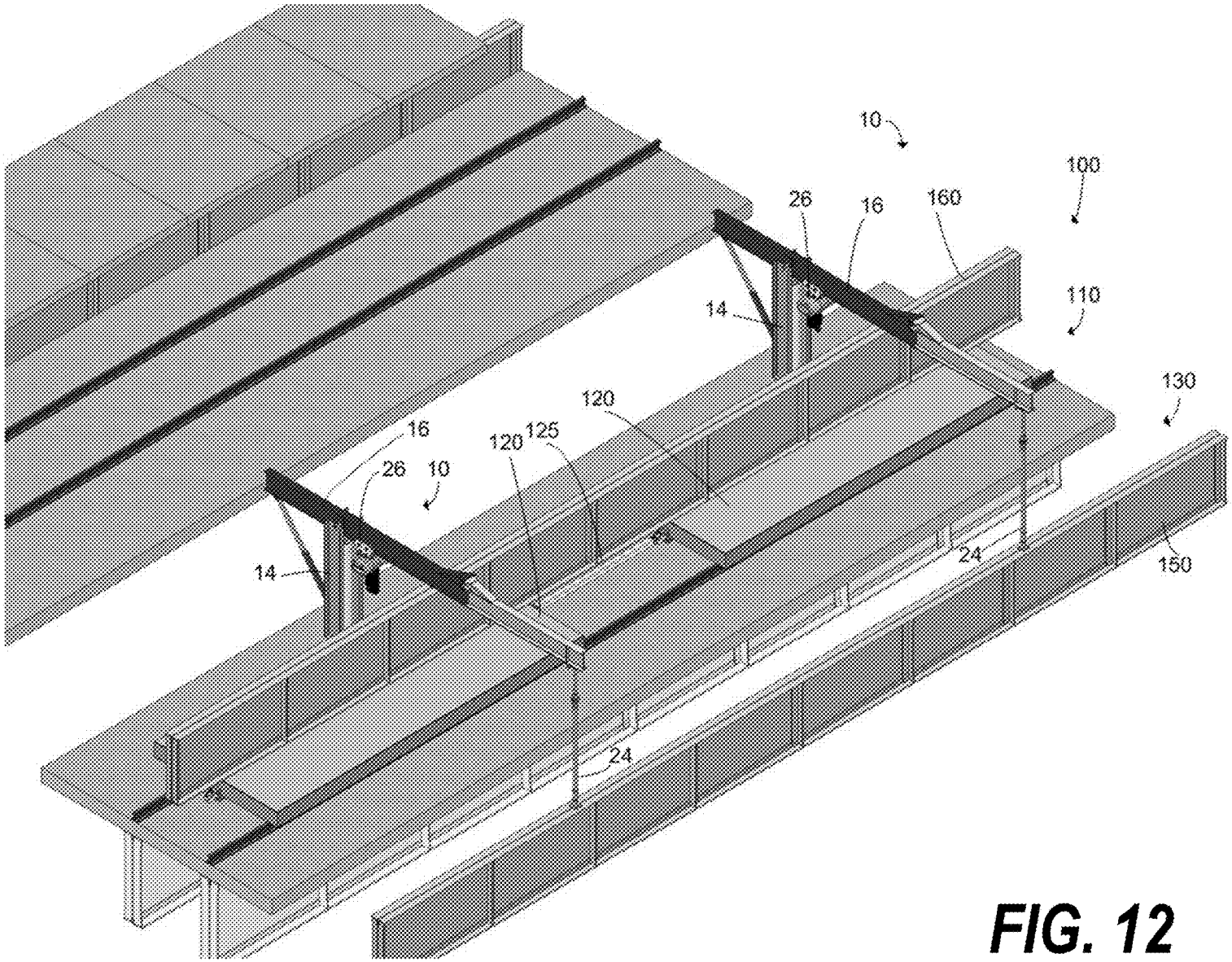
FIGS. 12-15 are perspective views of the gantry system of FIG. 11, illustrating a lifting and moving of the replacement girder, consistent with disclosed embodiments.
Figure 13:
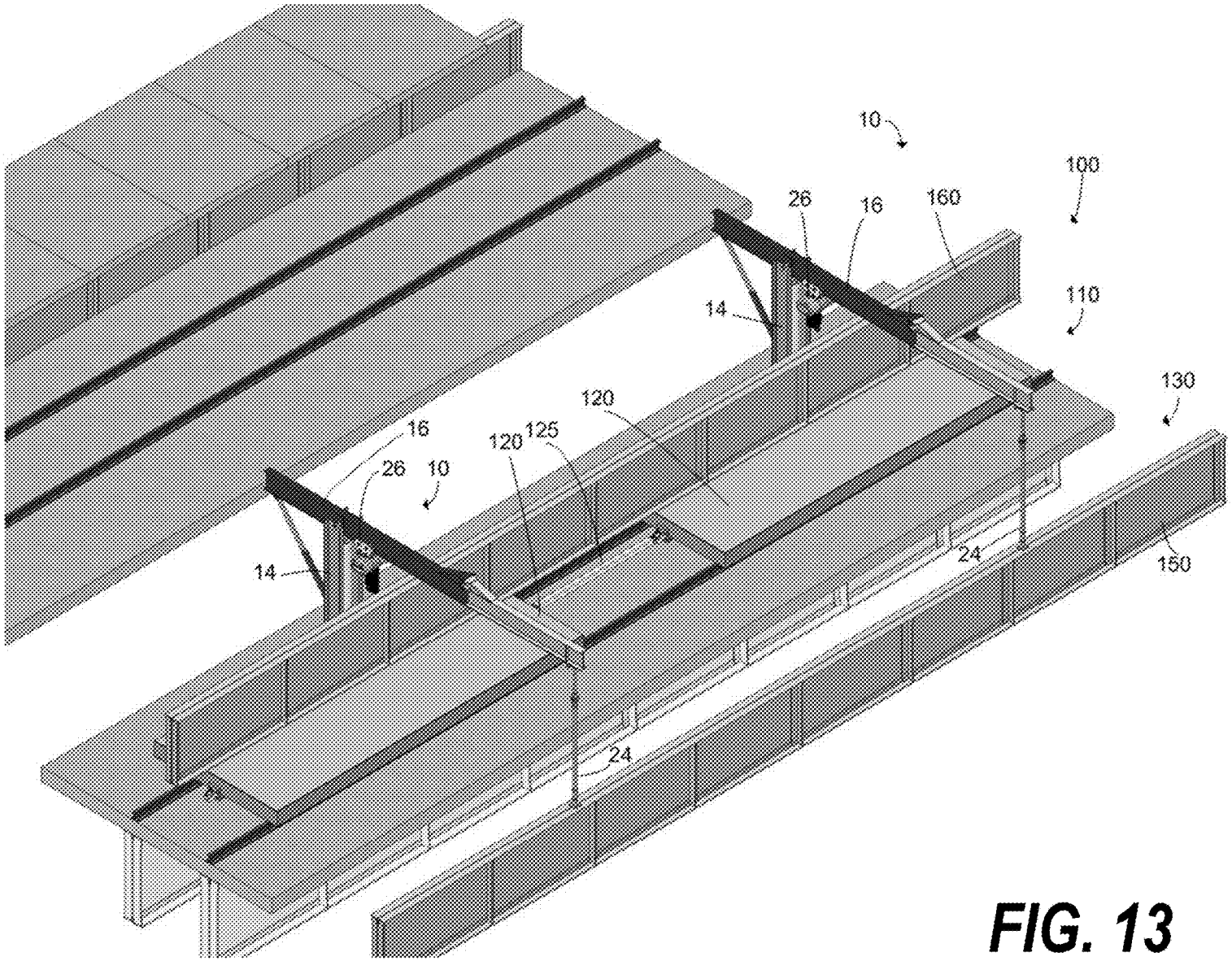
Figure 14:
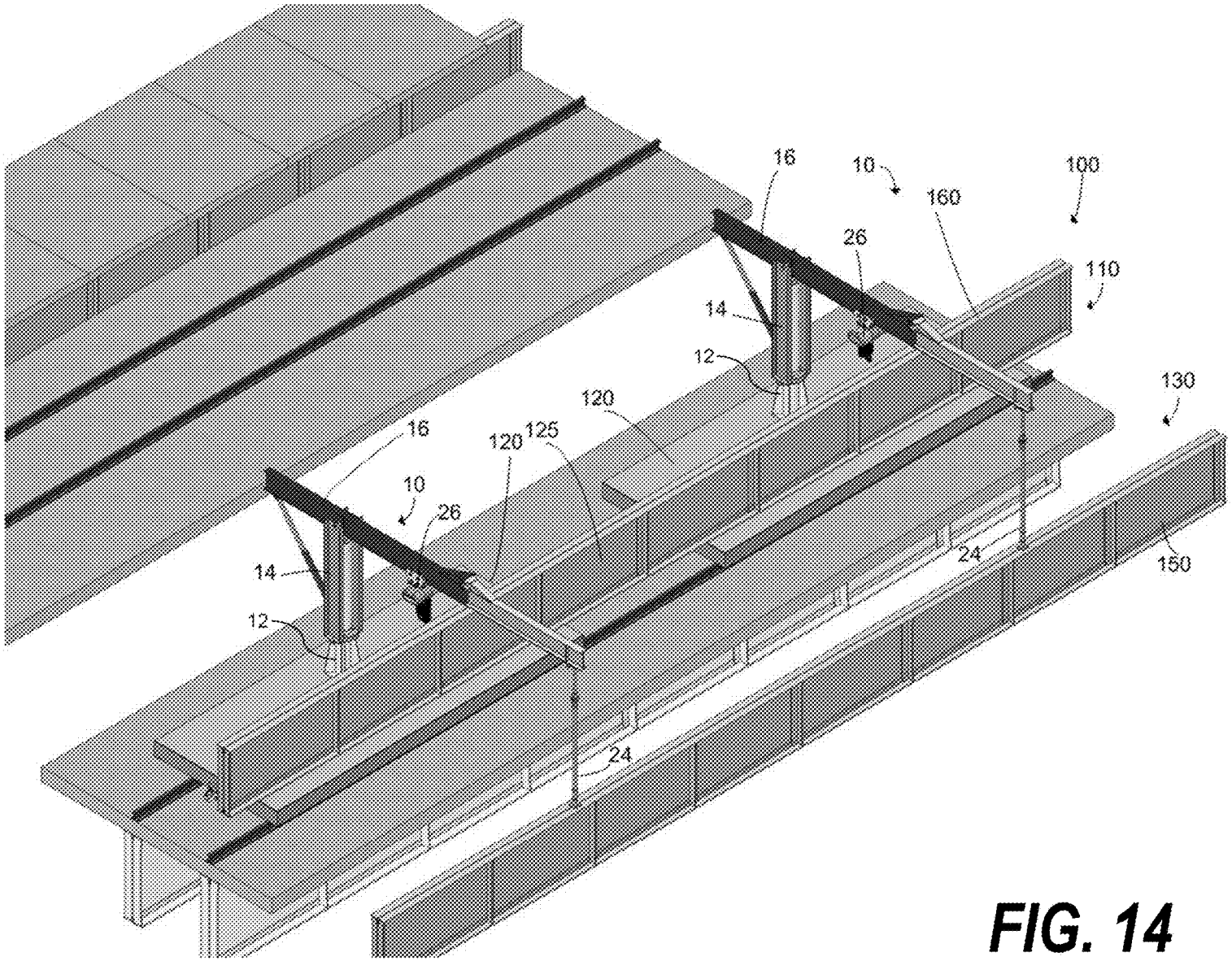
Figure 15:
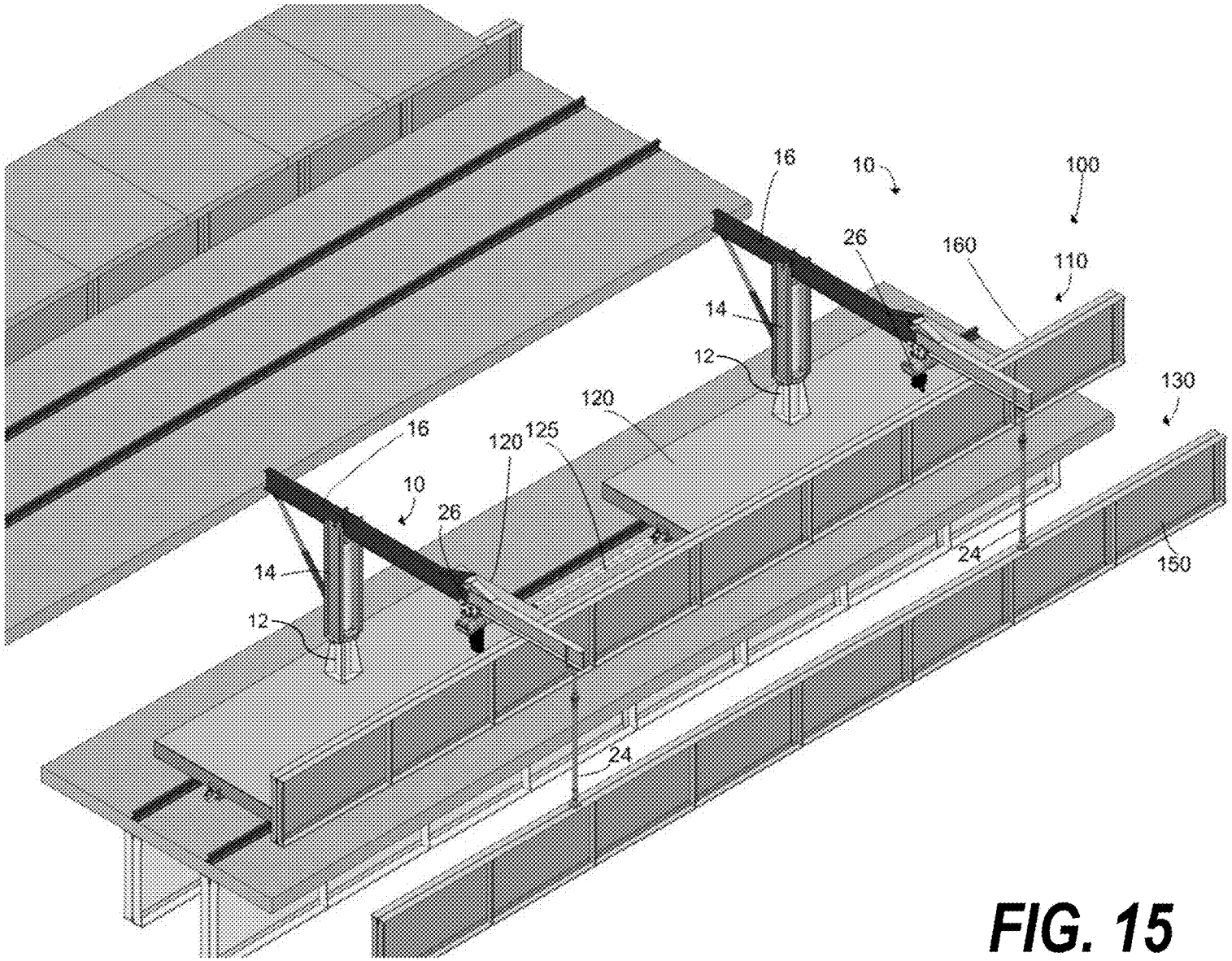
Figure 16:
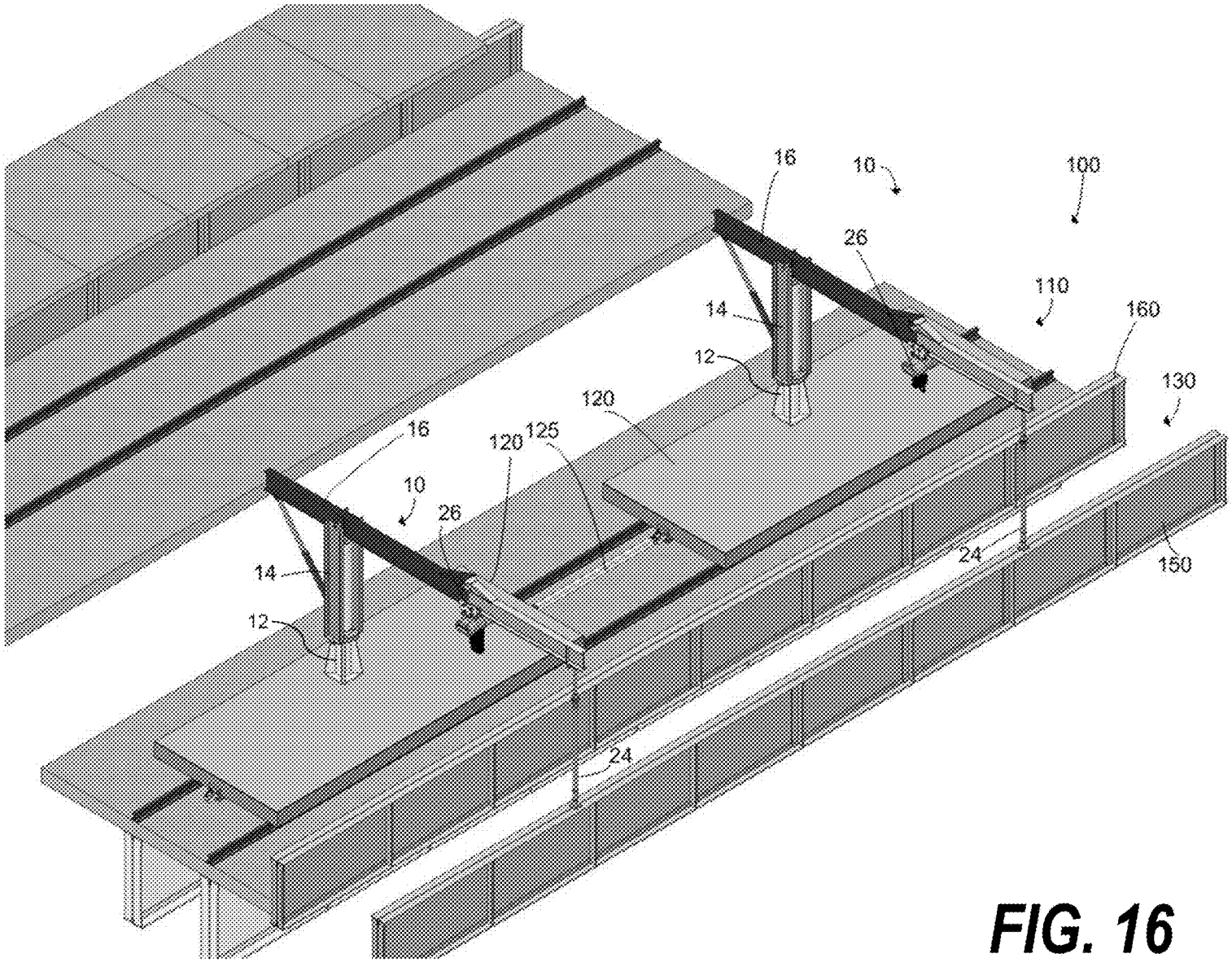
FIG. 16 is a perspective view of the gantry system of FIG. 11, illustrating the replacement girder being lowered into position and installed as a near girder, consistent with disclosed embodiments.
Figure 17:
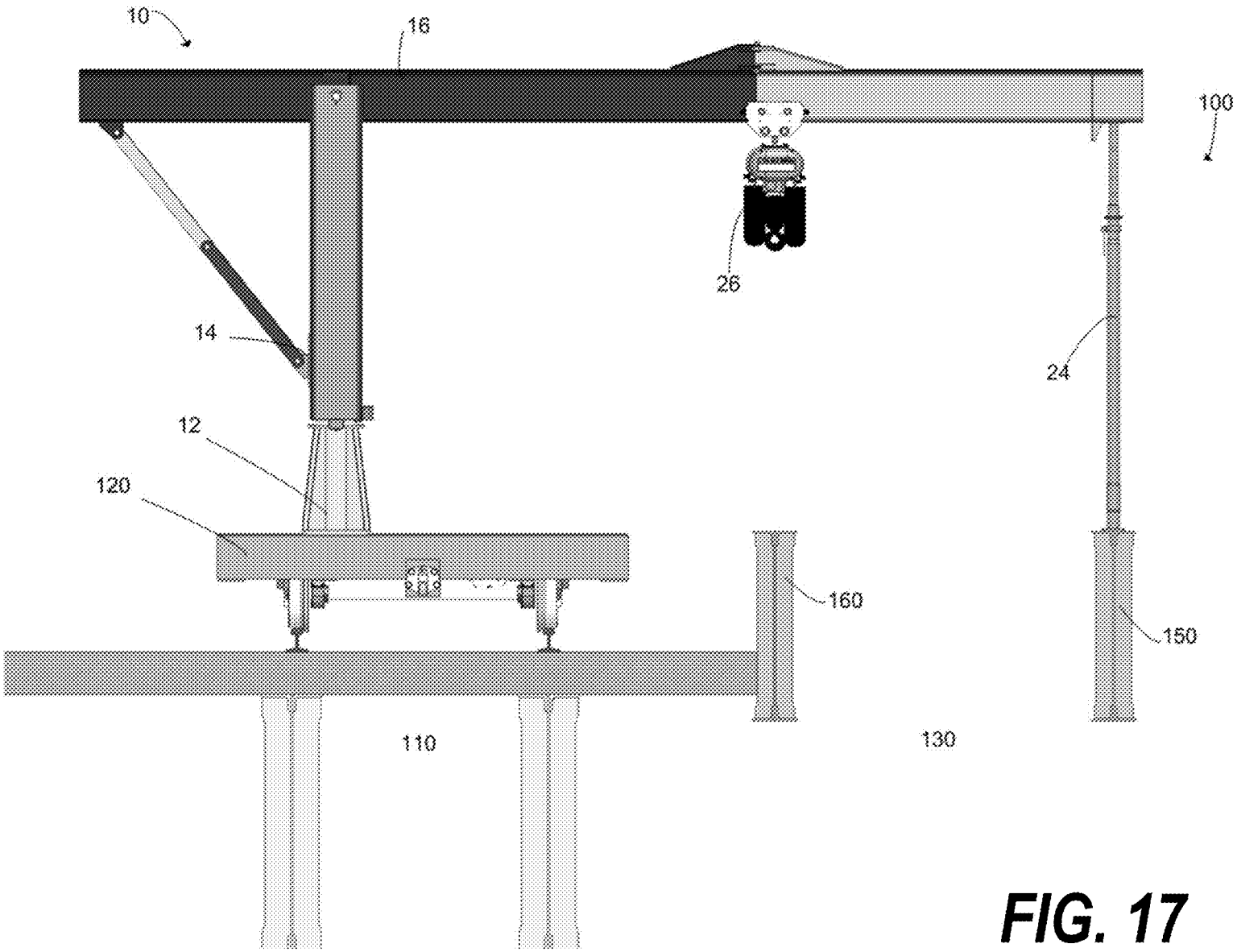
FIG. 17 is a side view of the gantry system of FIG. 16, with the replacement girder in position, consistent with disclosed embodiments.
Figure 18:
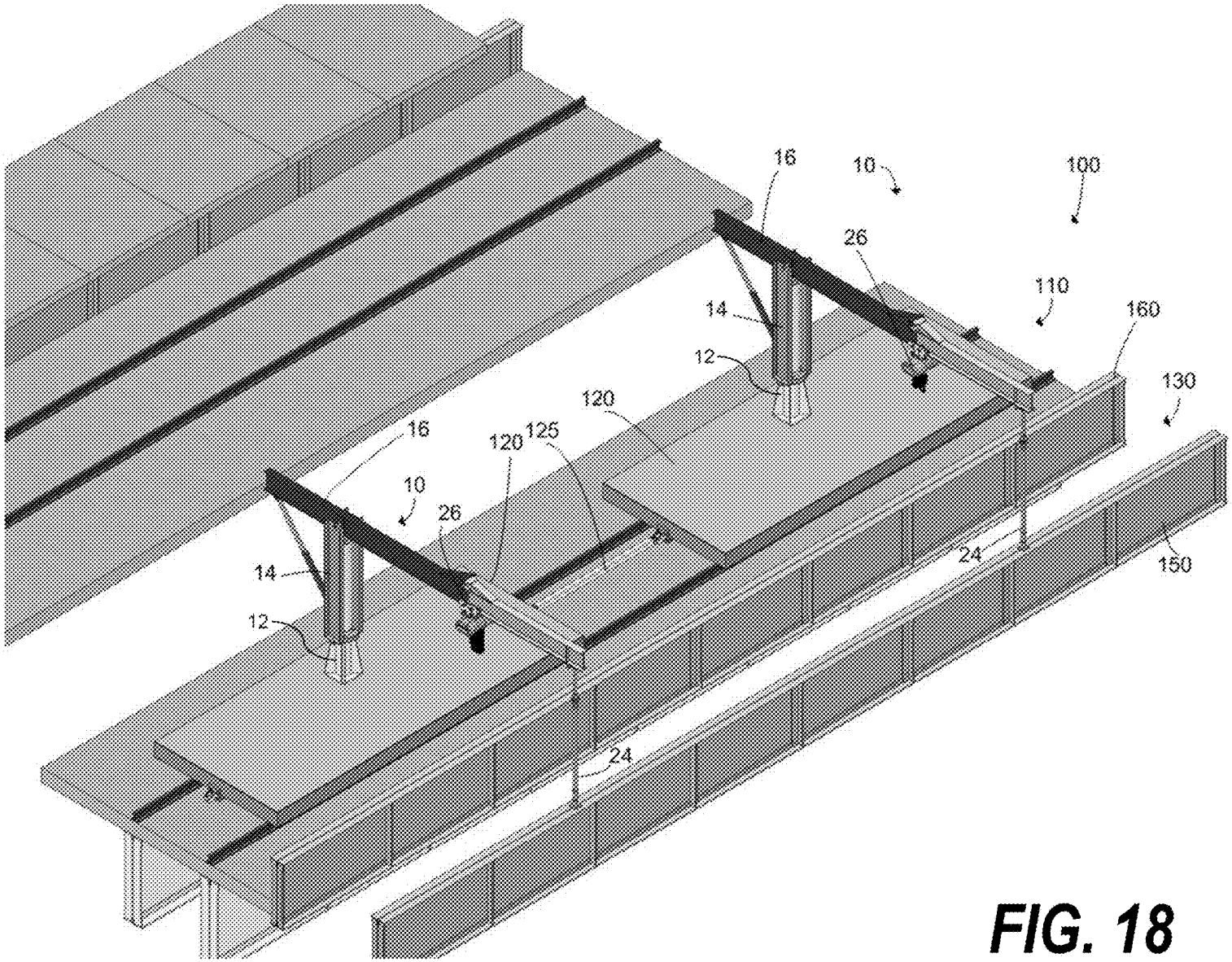
FIGS. 18-21 are perspective views of the gantry system of FIG. 3, illustrating hoists and support posts being returned to non-active positions and/or removed.
Figure 19:
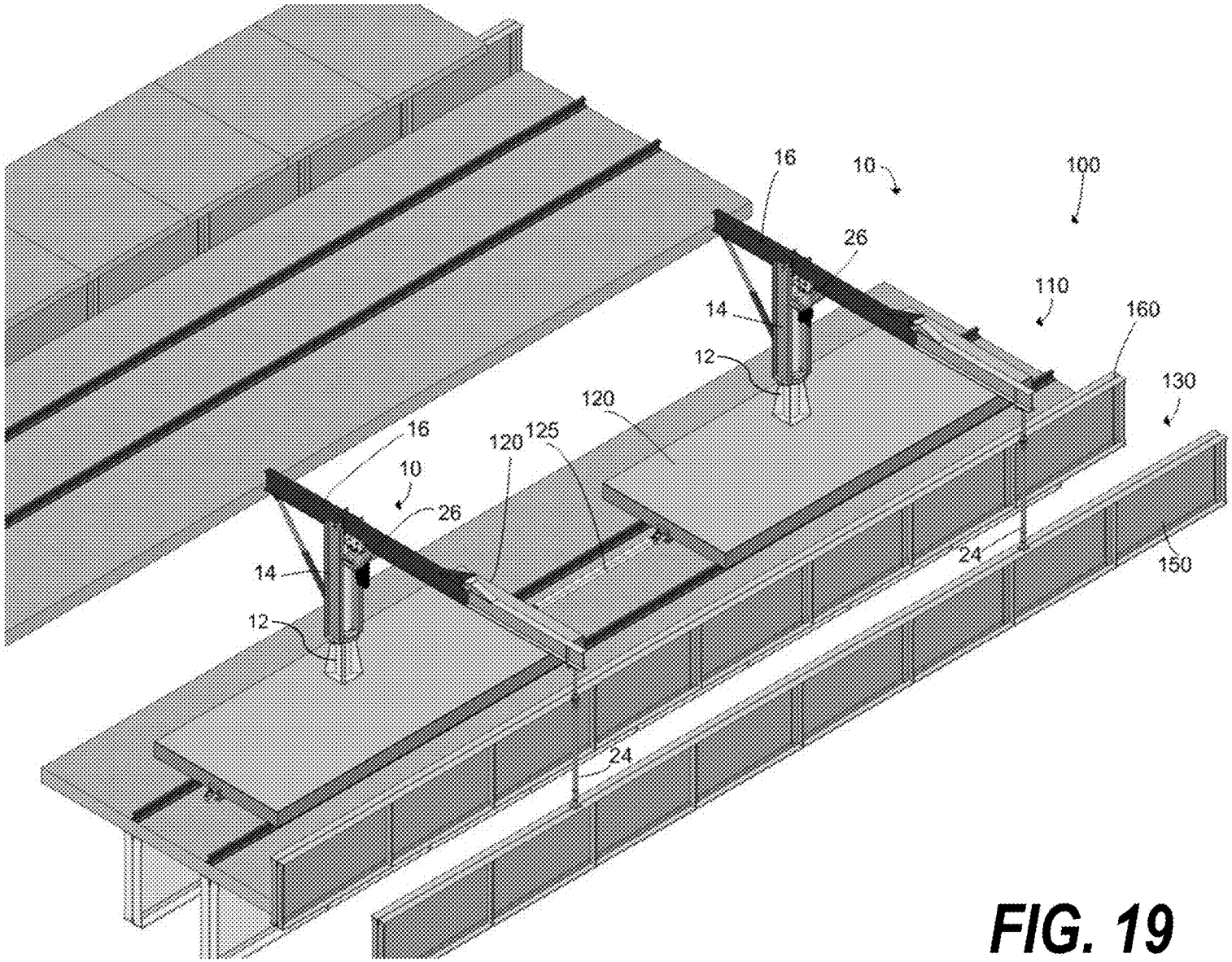
Figure 20:
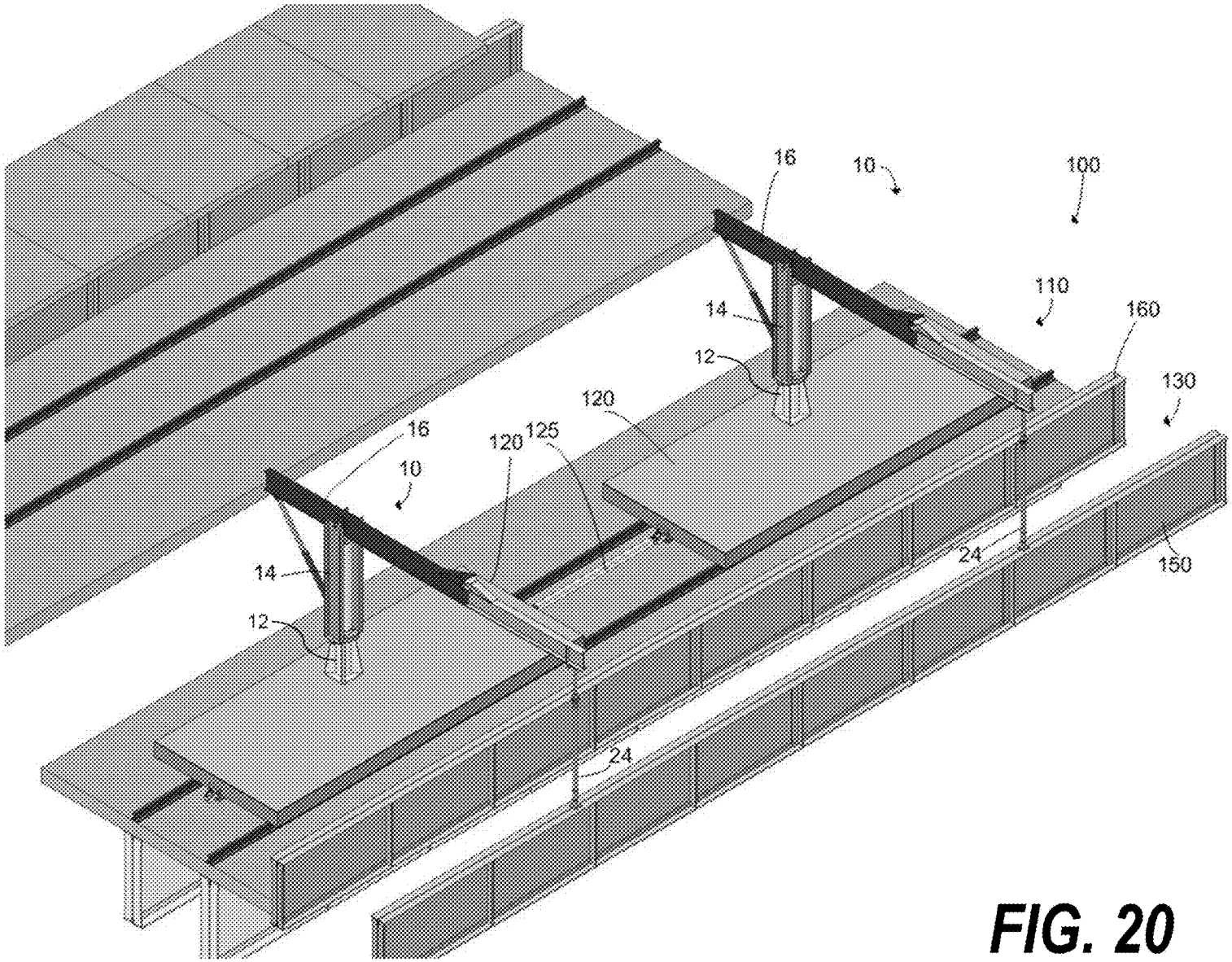
Figure 21:
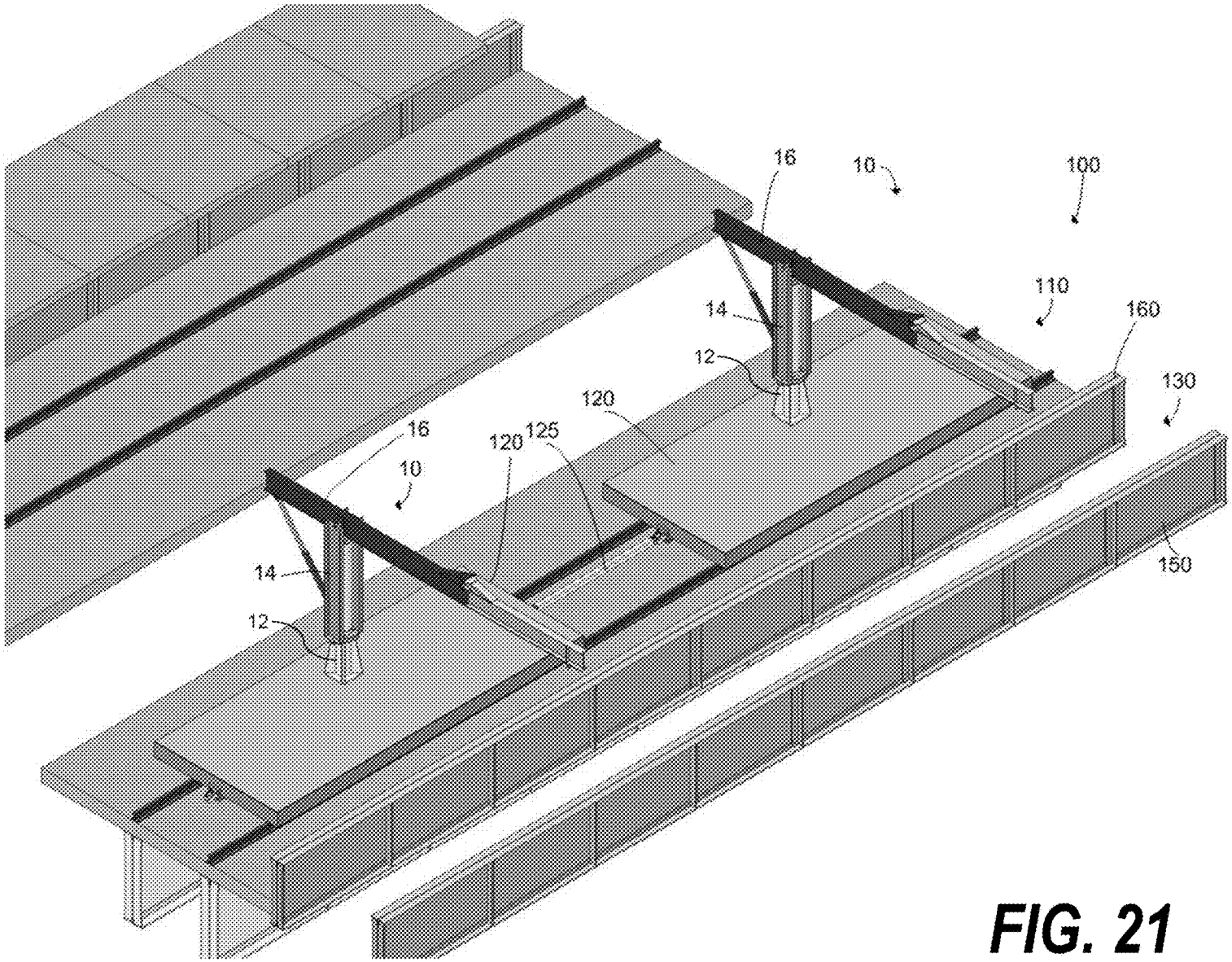
Figure 22:
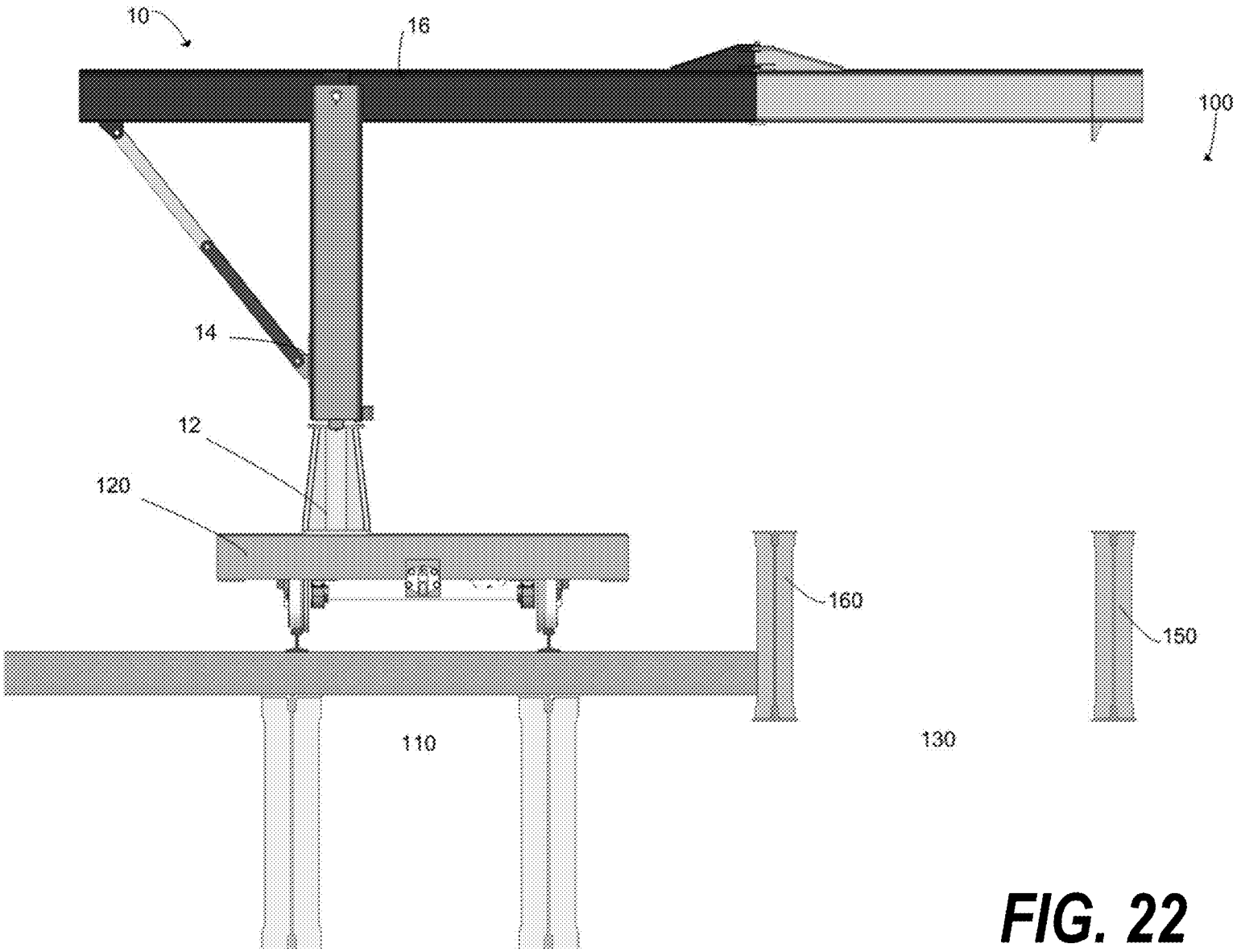
FIG. 22 is a side view of the gantry system of FIG. 3 with the hoists and support posts removed, consistent with disclosed embodiments.
Figure 23:
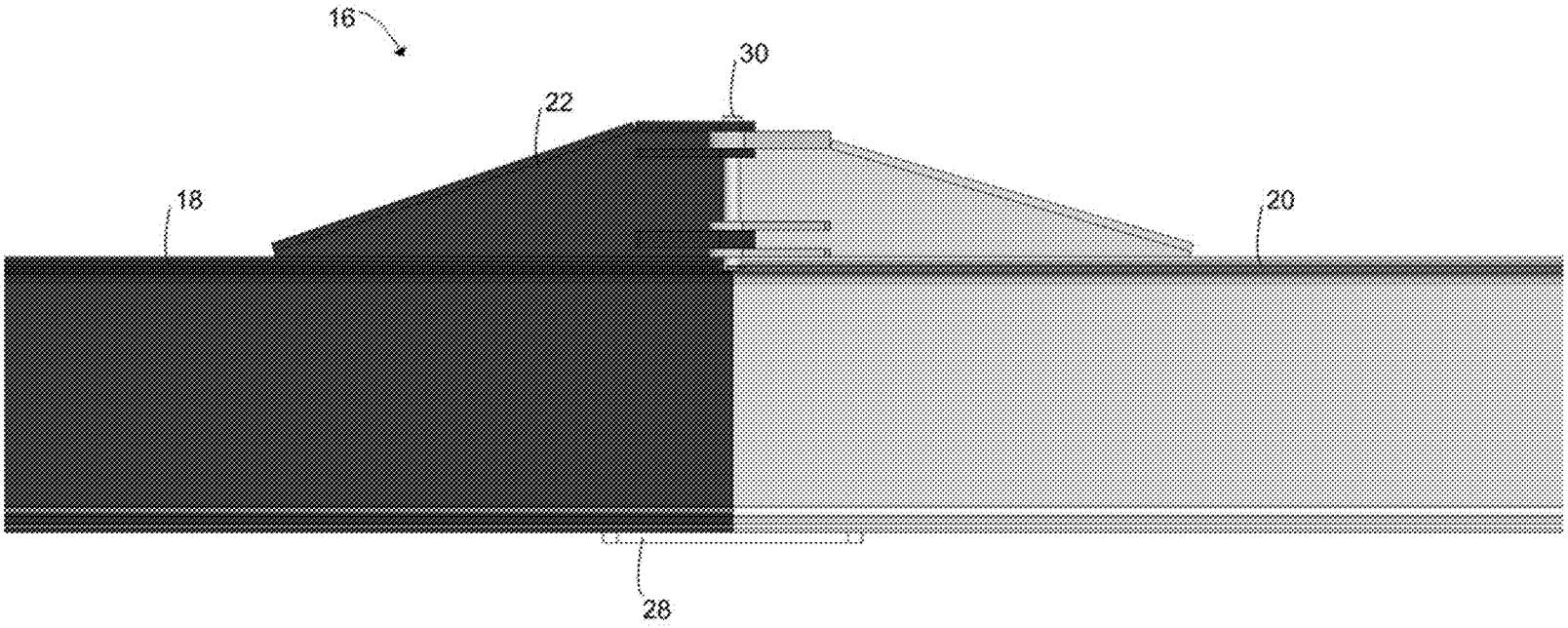
FIGS. 23-26 are close-up views of an optional hinge mechanism for a support arm of the gantry system, consistent with disclosed embodiments.
Figure 24:
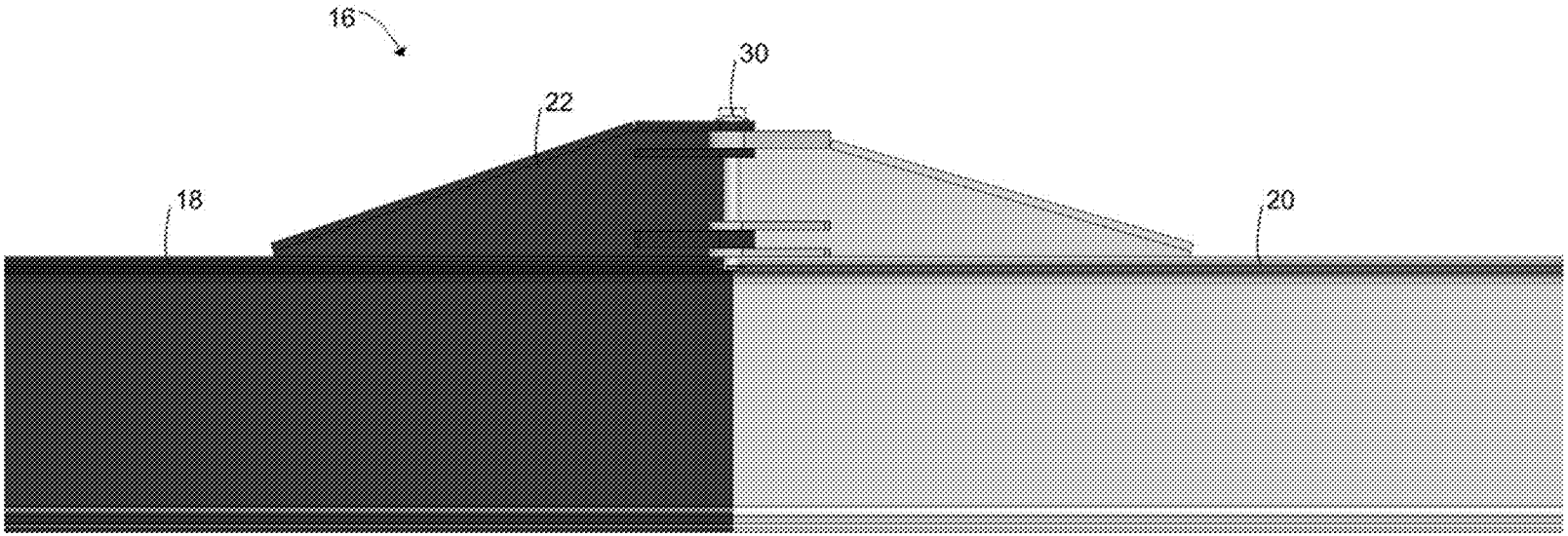
Figure 25:
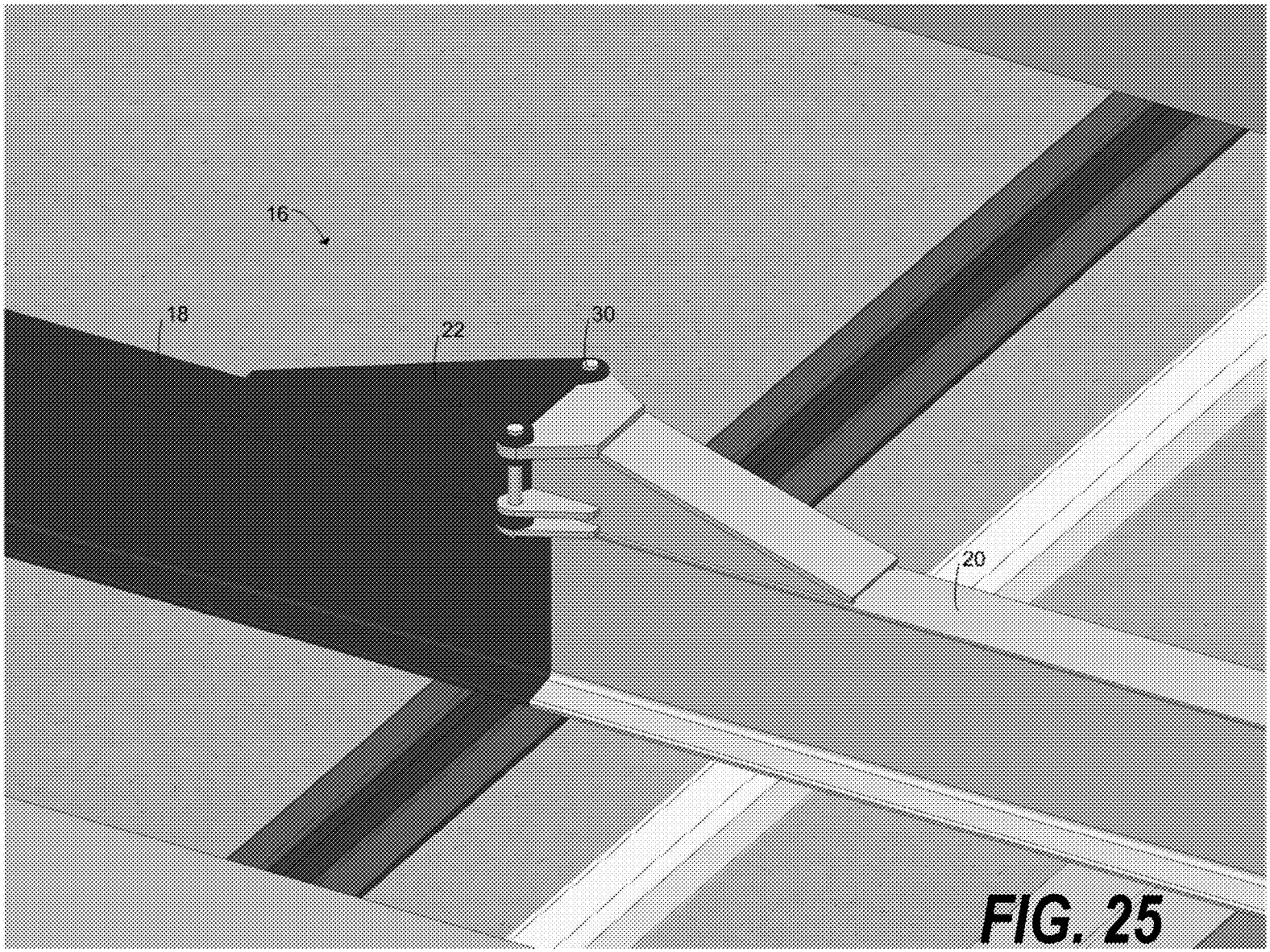
Figure 26:
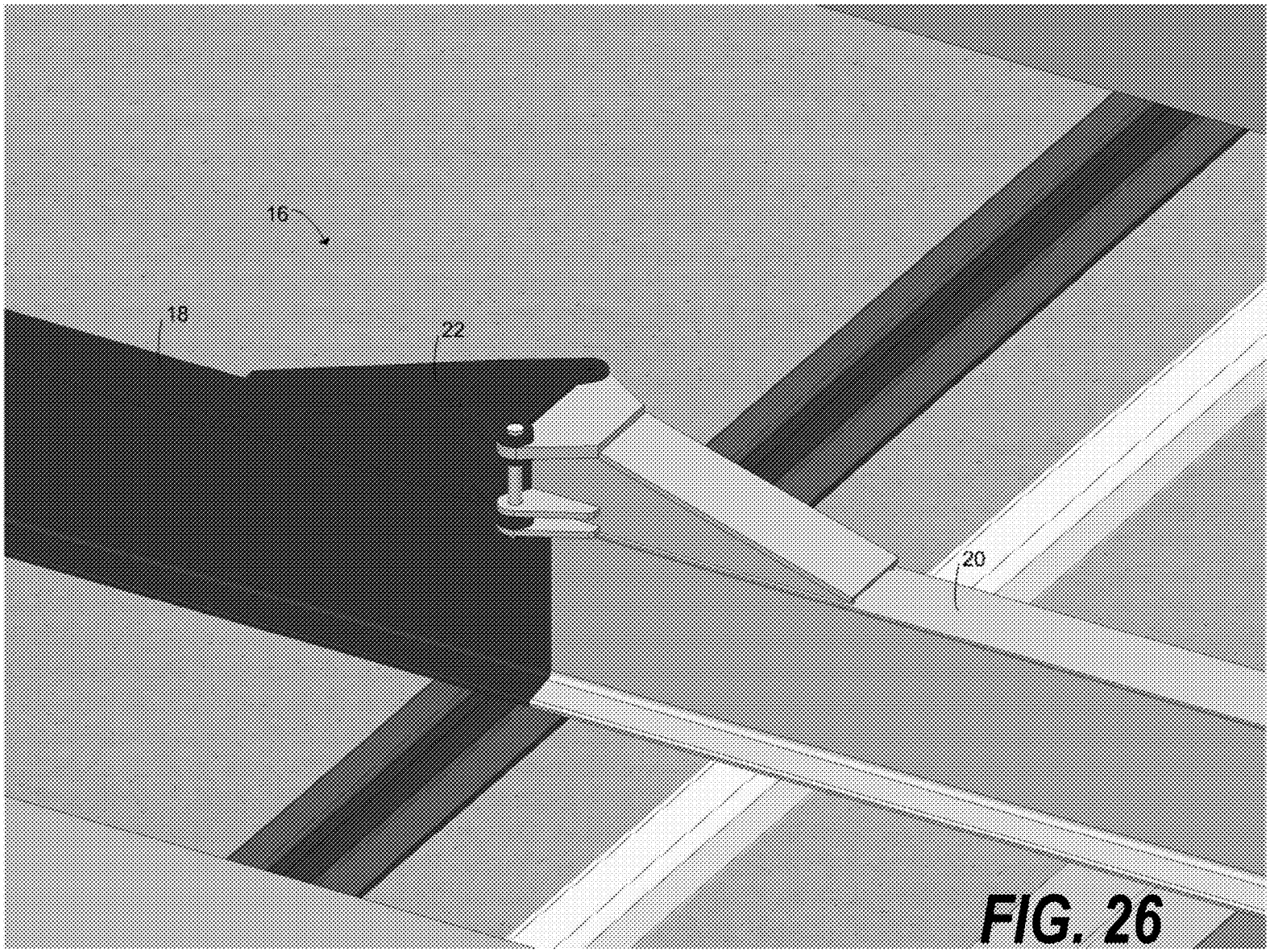

FIG. 11 illustrates an exemplary embodiment in which the crane arms 16 are supported at a distal end by a respective support post 24. The support posts 24 are configured to be positioned on a top surface of the far girder 150 for providing support to the crane arm 16 during operation. The positioning of the crane arms 16 perpendicular to the replacement girder 160 and the far girder 150 enables two or more crane assemblies 10 to be positioned longitudinally with respect to these girders while supported at different positions along the far girder 150. Each crane assembly 10 may be attached on a separate moveable platform 120. Each moveable platform 120 may be connected to each other by a tow bar 125 to tether the platforms to each other and inhibit relative movement. FIG. 12 illustrates a hoist 26 that may be attached to and can move along the length of the crane arm 16. The hoist 26 is preferably sized and configured to lift a replacement girder 160.

FIGS. 13-22 illustrate various additional positions of the gantry system 100 during placement of the replacement girder 160. The support posts 24 provide support and the hoists 26 lift the replacement girder off of the movable platforms 120 and traverse along the crane arms 16 until the girder 160 is directly above its position in the platform area 130. The hoists 26 then lower the replacement girder 160 into position as a near girder (with respect to the far girder 150).

In an exemplary installation process, first, the moveable platform cars 120 would be placed on the rails and locked into place. Then, one crane assembly 10 would be attached to each moveable platform 120 via the stationary bases 12. Then, the crane assemblies 10 would be rotated to a stowed position (if not already in this position), in which the crane arms 16 are parallel to the rails. With the crane arms 16 out of the way, the replacement girder 160 can be staged on the moveable platforms 120. Then, the crane assemblies 10 are rotated back to their action position, in which the crane arms 16 are perpendicular to the railroad tracks and hover over the replacement girder. At this point, the support posts 24 are installed on the far girder 150. The foot of the support post 24 rests on the far girder 150. The far end of the crane arm 16 is connected and supported at the top of the support post 24 so that the support post 24 can carry some of the weight of the load. Then, the hoist 26 is attached to the replacement girder 160. The hoist 26 is used to lift the replacement girder 160 and move the replacement girder 160 to its installation location.

Figure 27:
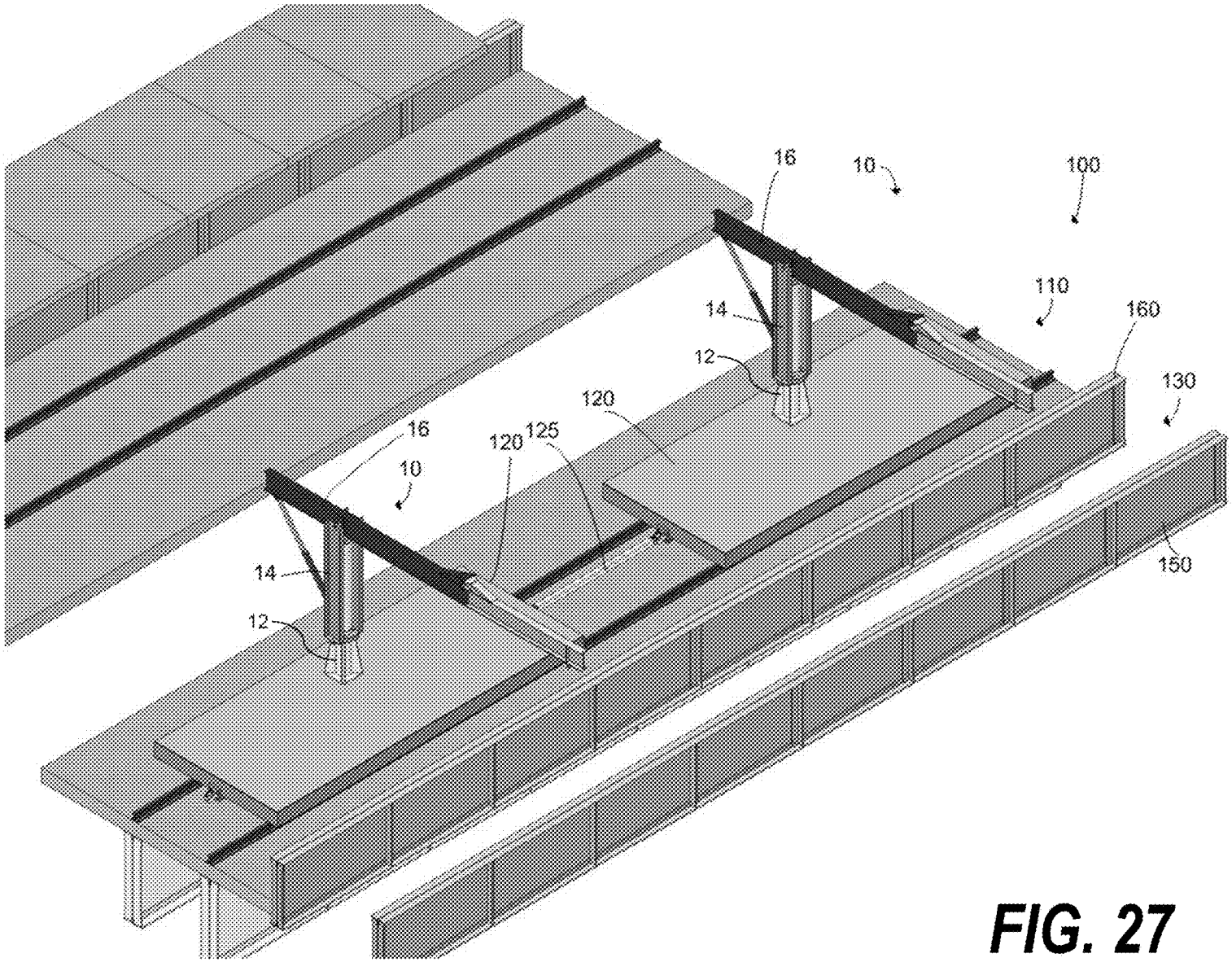
FIGS. 27-29 are perspective views of the gantry system of FIG. 3, illustrating an optional folding process for the support arms via the hinge mechanism of FIGS. 23-26, consistent with disclosed embodiments.
Figure 28:
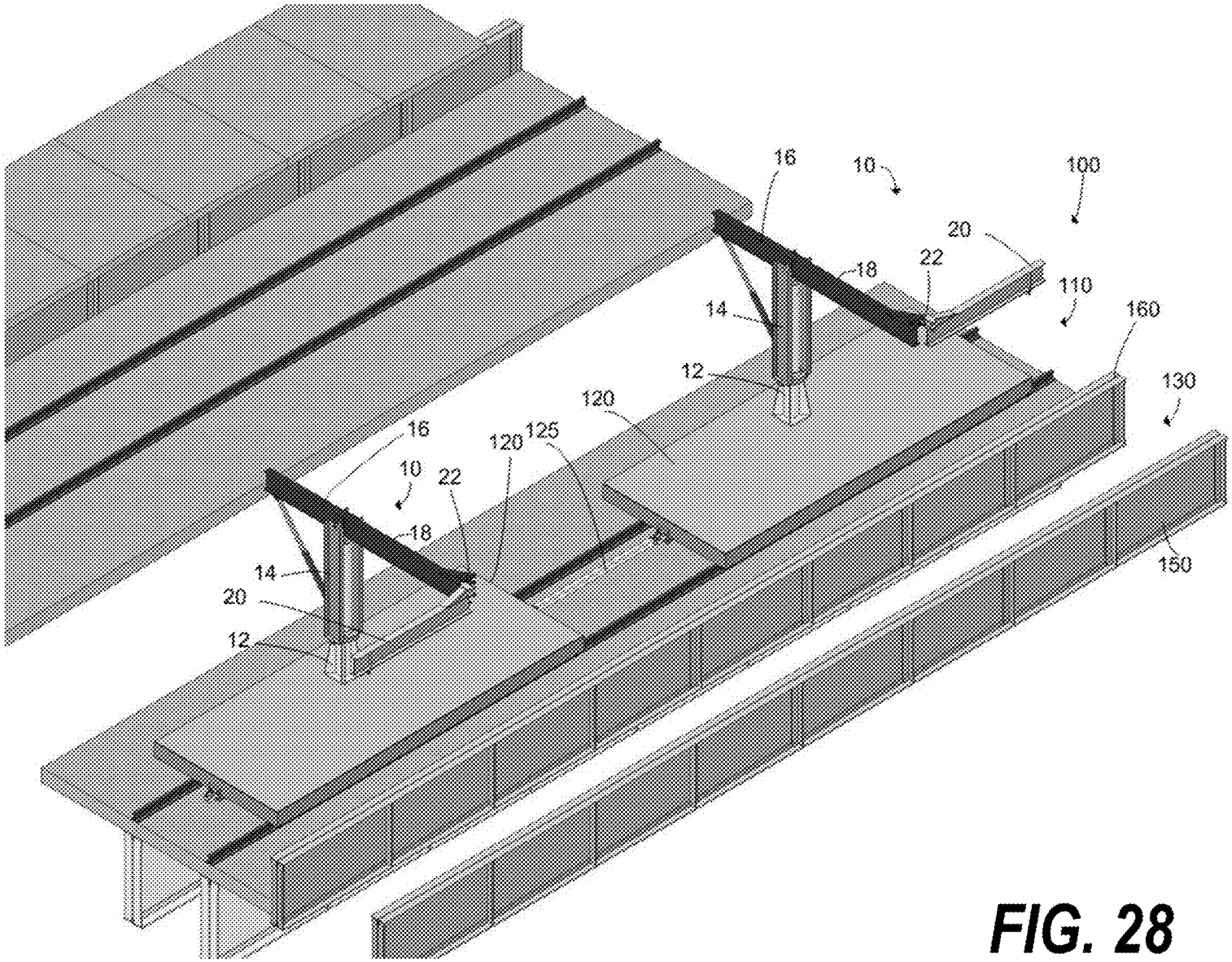
Figure 29:
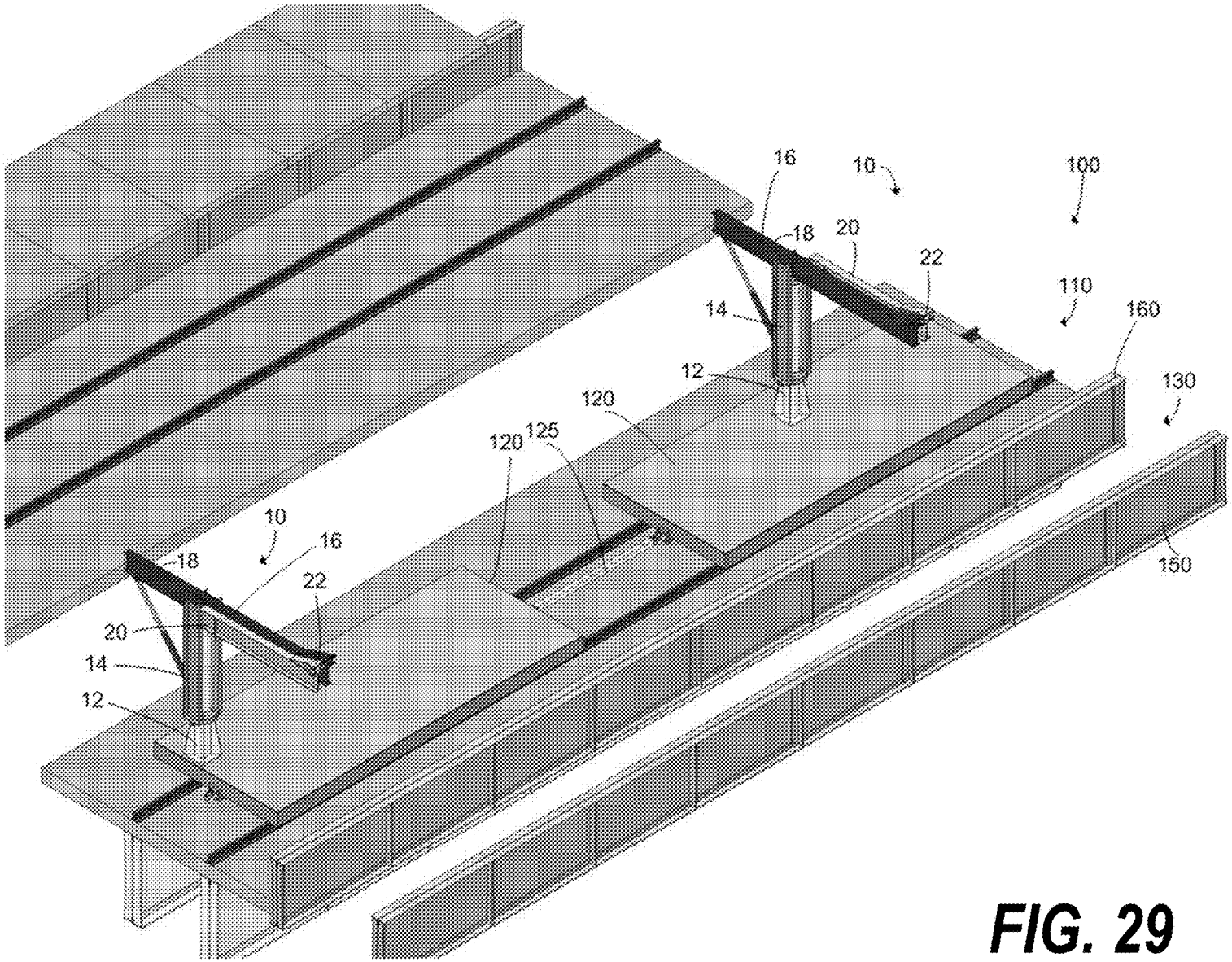

FIGS. 23-26 further illustrate an exemplary embodiment in which the crane arms 16 include the hinge mechanism 22. The hinge mechanism may include a splice plate 28 for connecting bottom portions of the base arm 18 and arm extension 20 and a lock pin 30 for locking the base arm 18 and arm extension 20 in an extended position. The lock pin 30 may be removed to allow the base arm 18 to fold with respect to the arm extension 20. FIGS. 27-29 further illustrate folding of the crane arms 16 to a compact position. The compact position further enables the crane assemblies 10 to be loaded and moved to hard-to-reach areas without impinging on various restrictions that may be present during travel.

Figure 30:
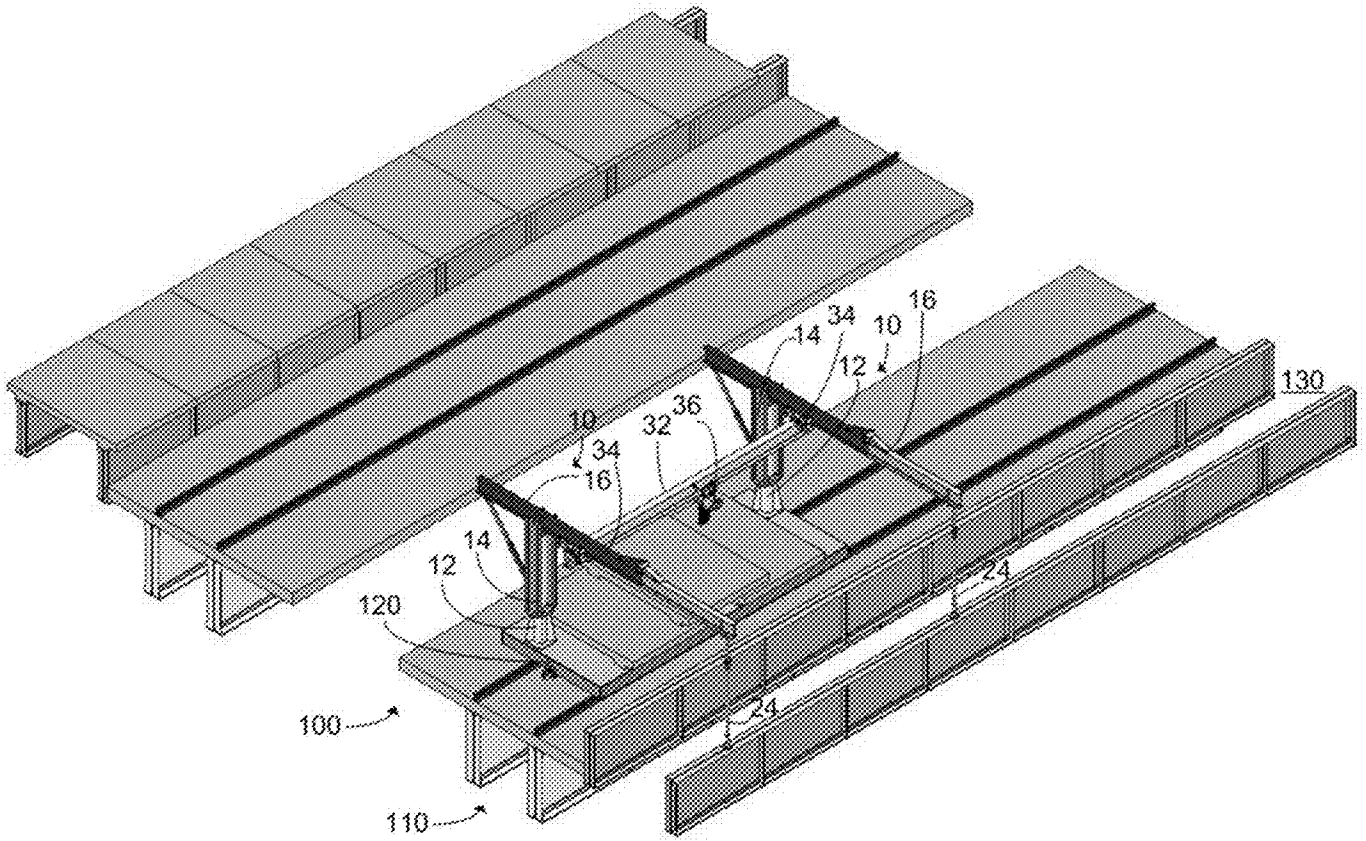
FIG. 30 is a perspective view of a further embodiment of the gantry system of FIG. 1, further including features for placing precast panels on the girders, consistent with disclosed embodiments.
Figure 31:
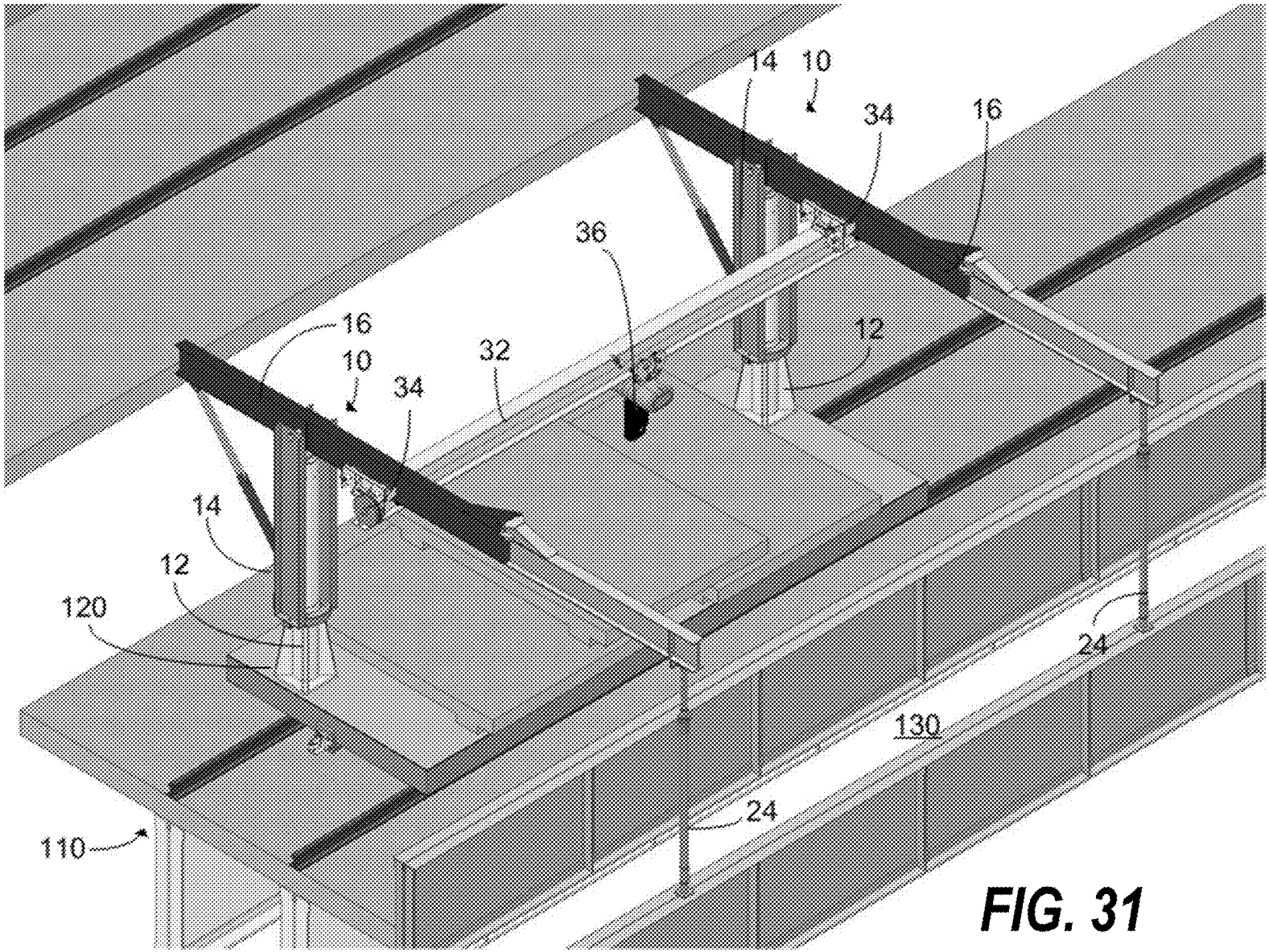
FIG. 31 is a close-up perspective view of the gantry system of FIG. 30.
Figure 32:
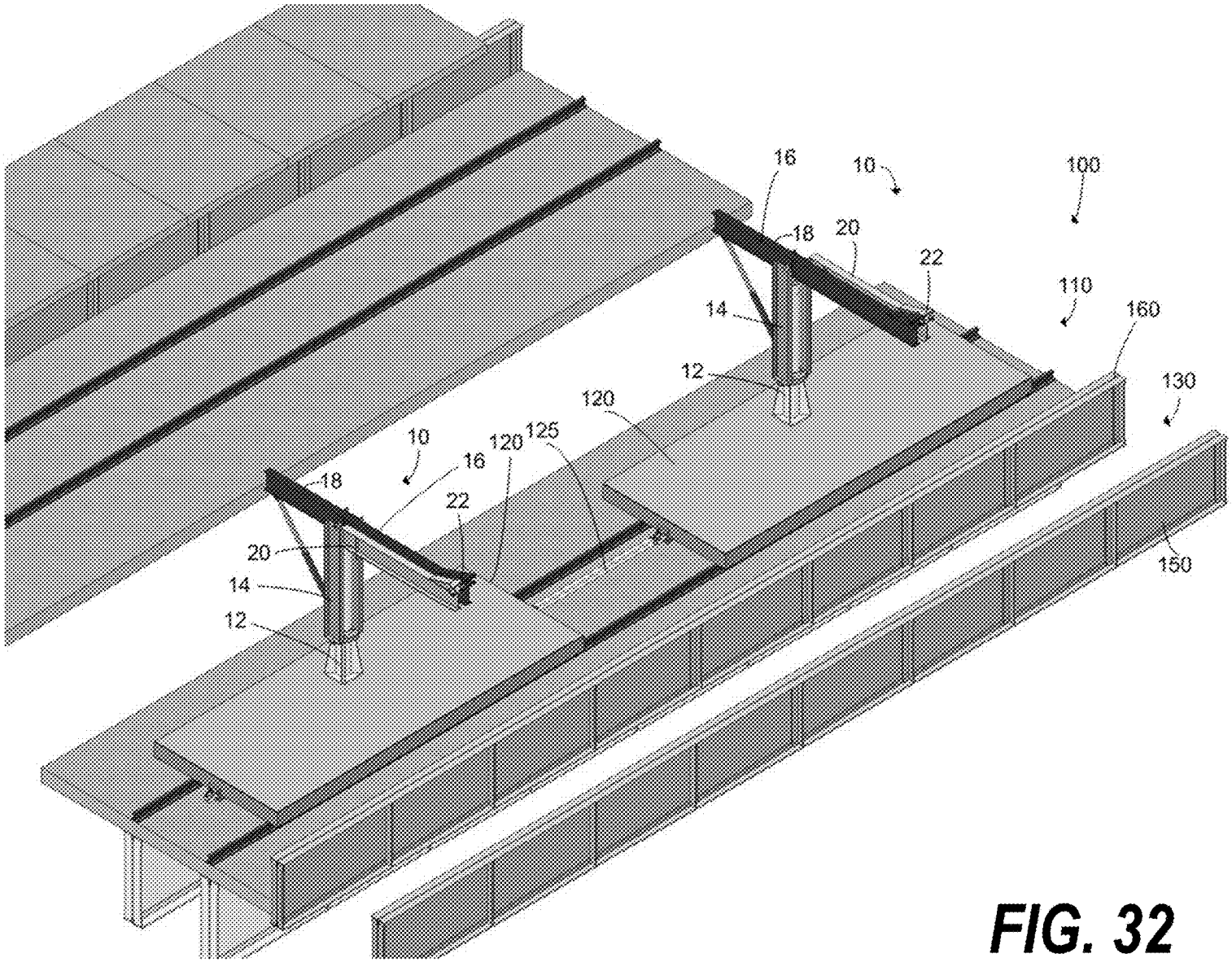
FIGS. 32-35 are perspective views of the gantry system of FIG. 1, illustrating a process to move the crane assemblies onto one platform.
Figure 33:
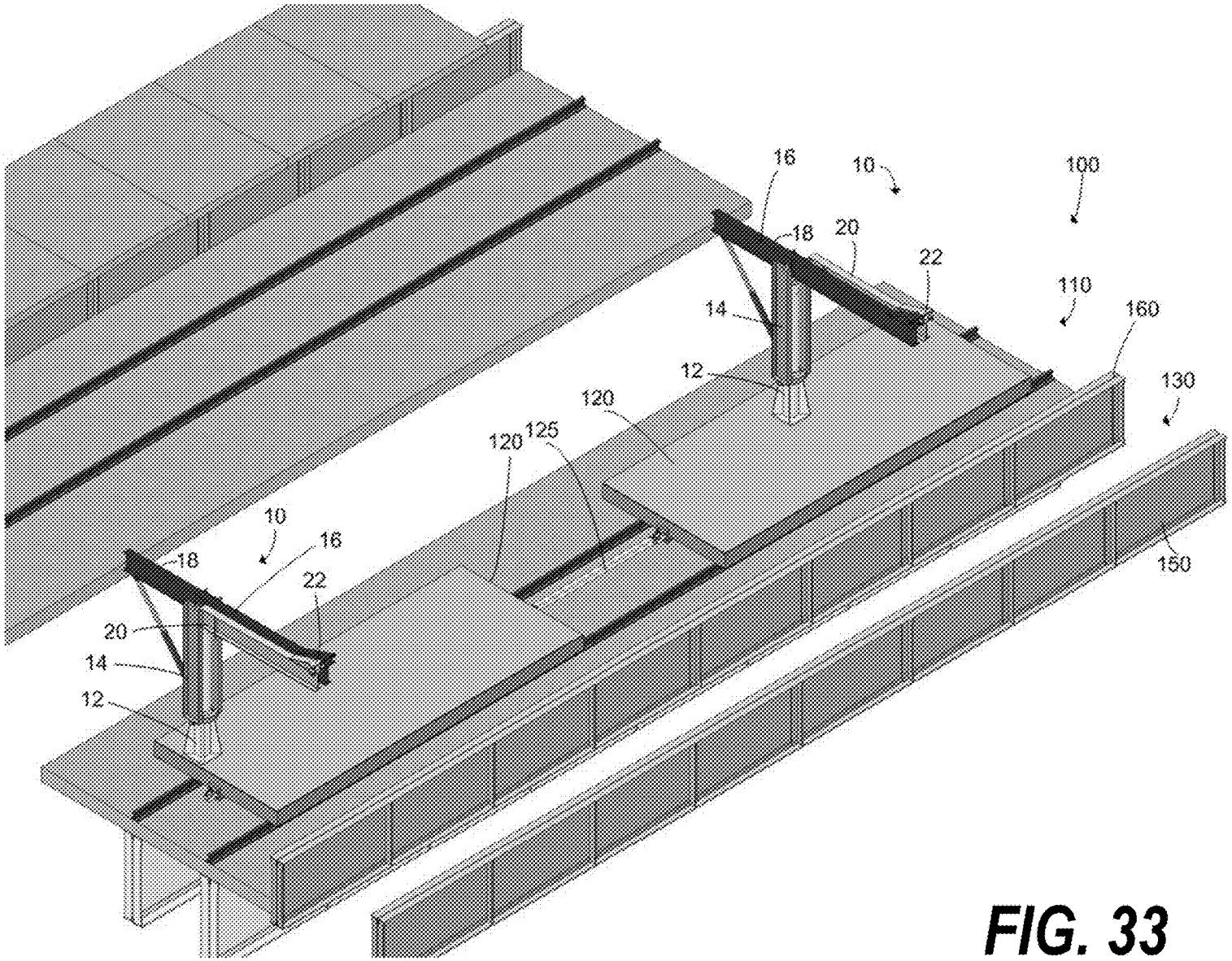
Figure 34:
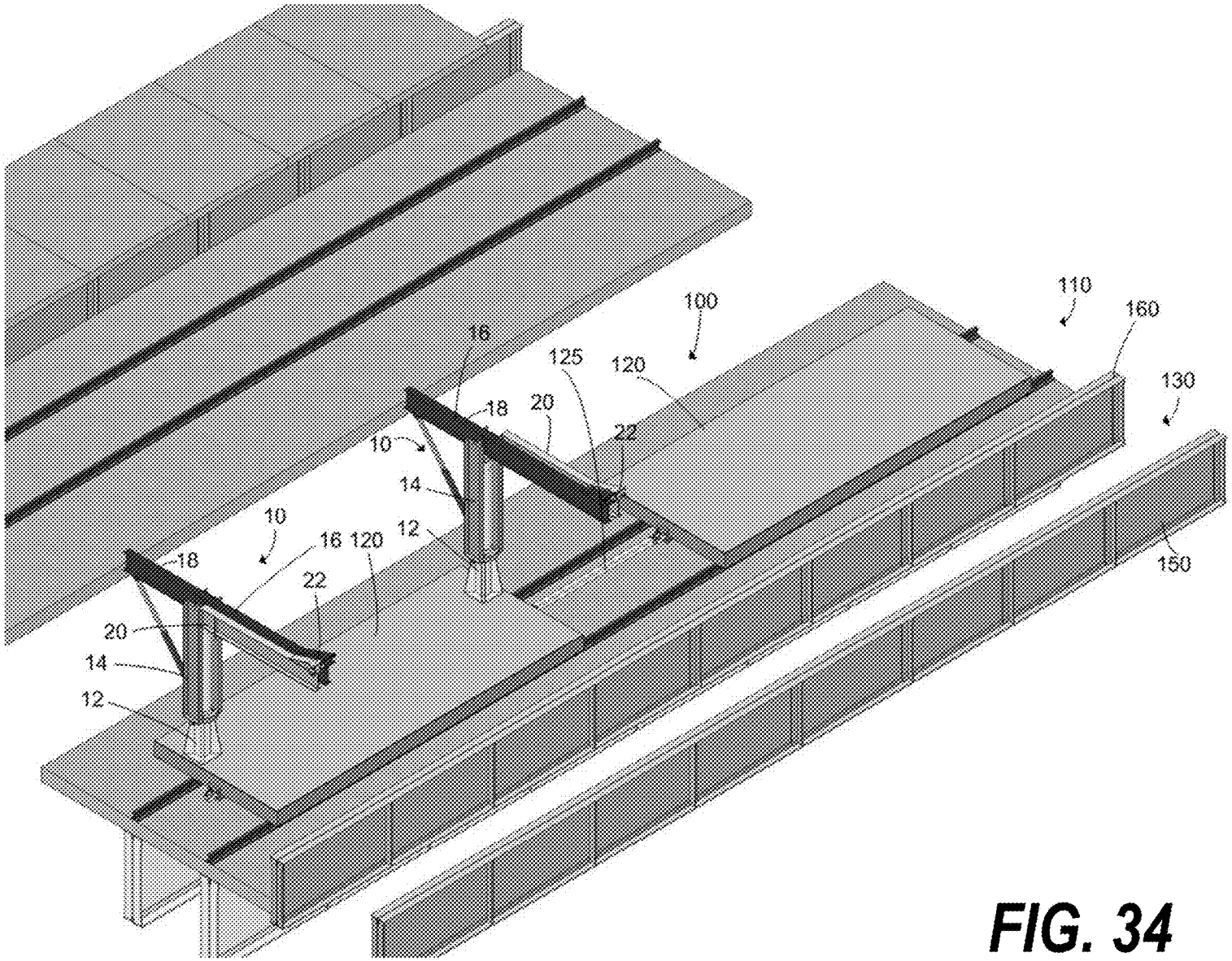
Figure 35:
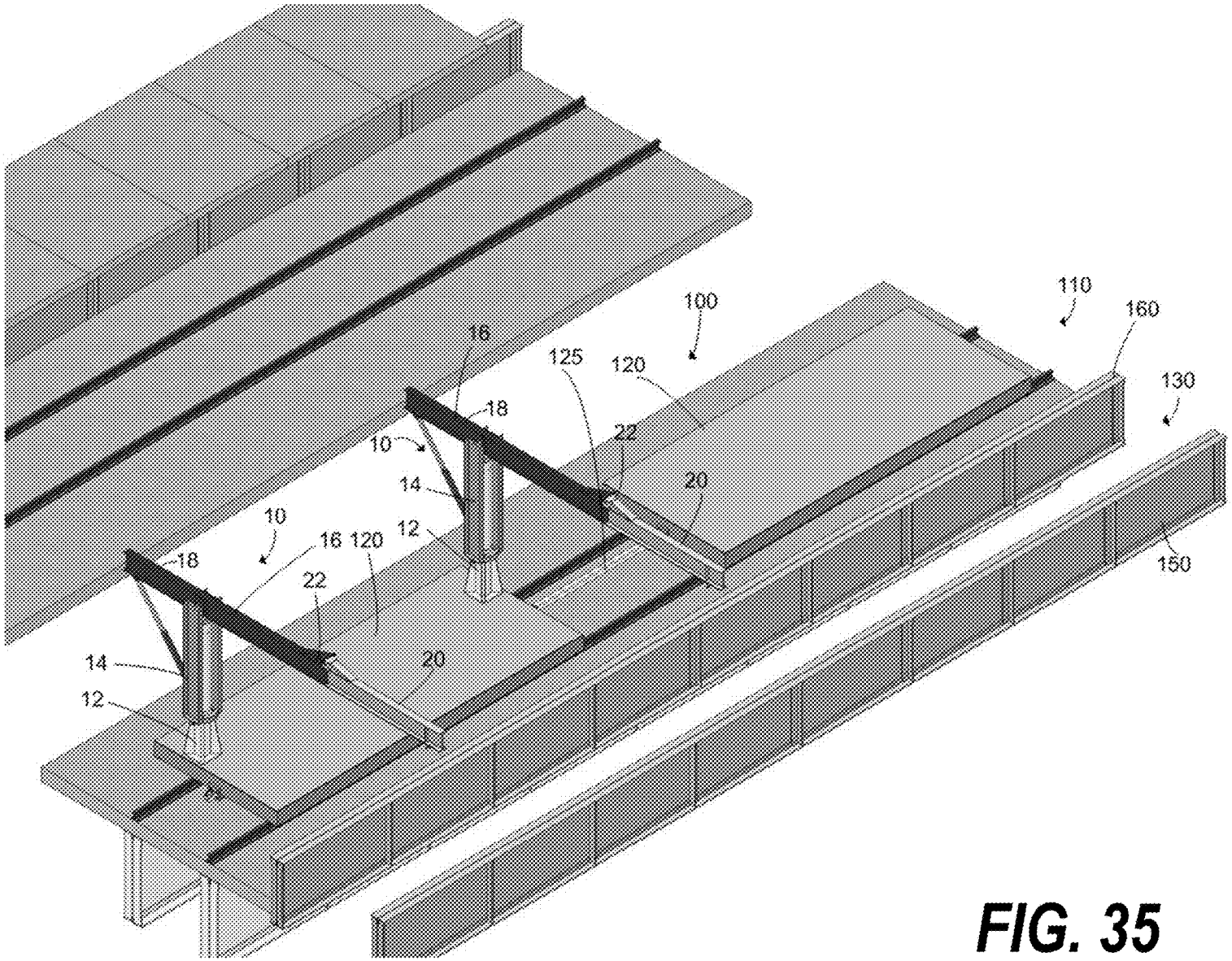
Figure 36:
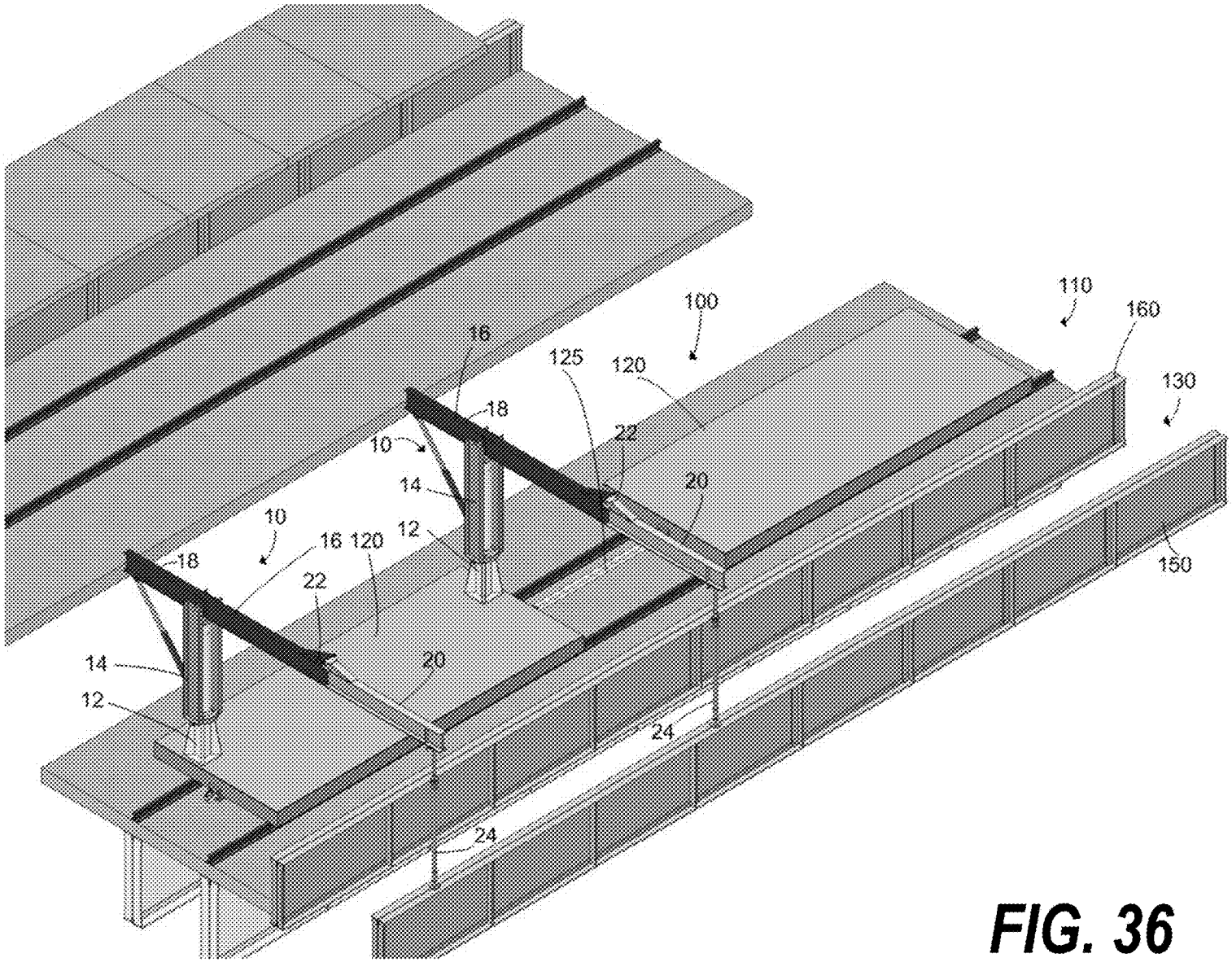
FIG. 36 is a perspective view of the gantry system of FIG. 35, illustrating the support posts being positioned for support on the far girder, consistent with disclosed embodiments.
Figure 37:
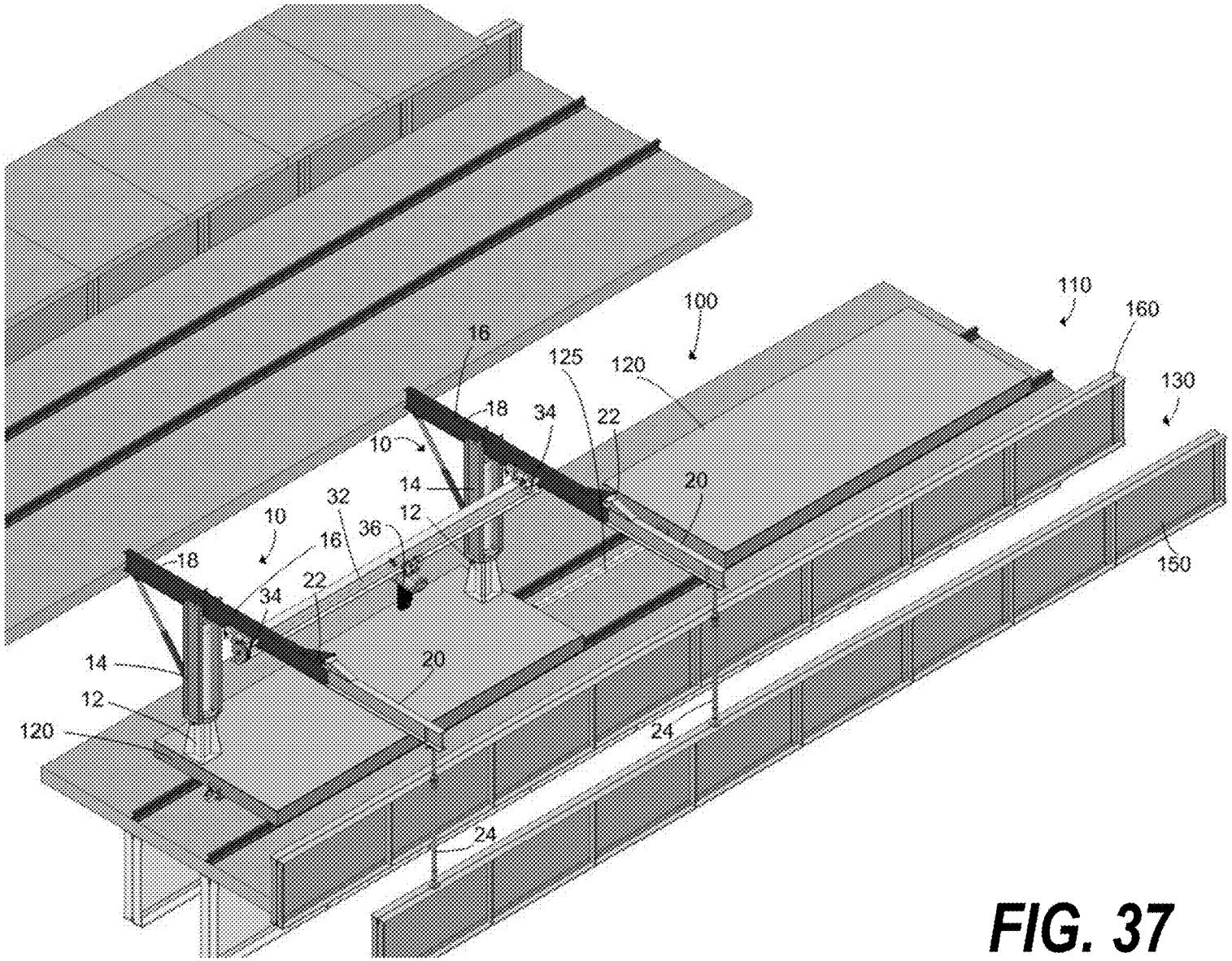
FIG. 37 is a perspective view of the gantry system of FIG. 36, illustrating the trolley beam being installed, consistent with disclosed embodiments.
Figure 38:
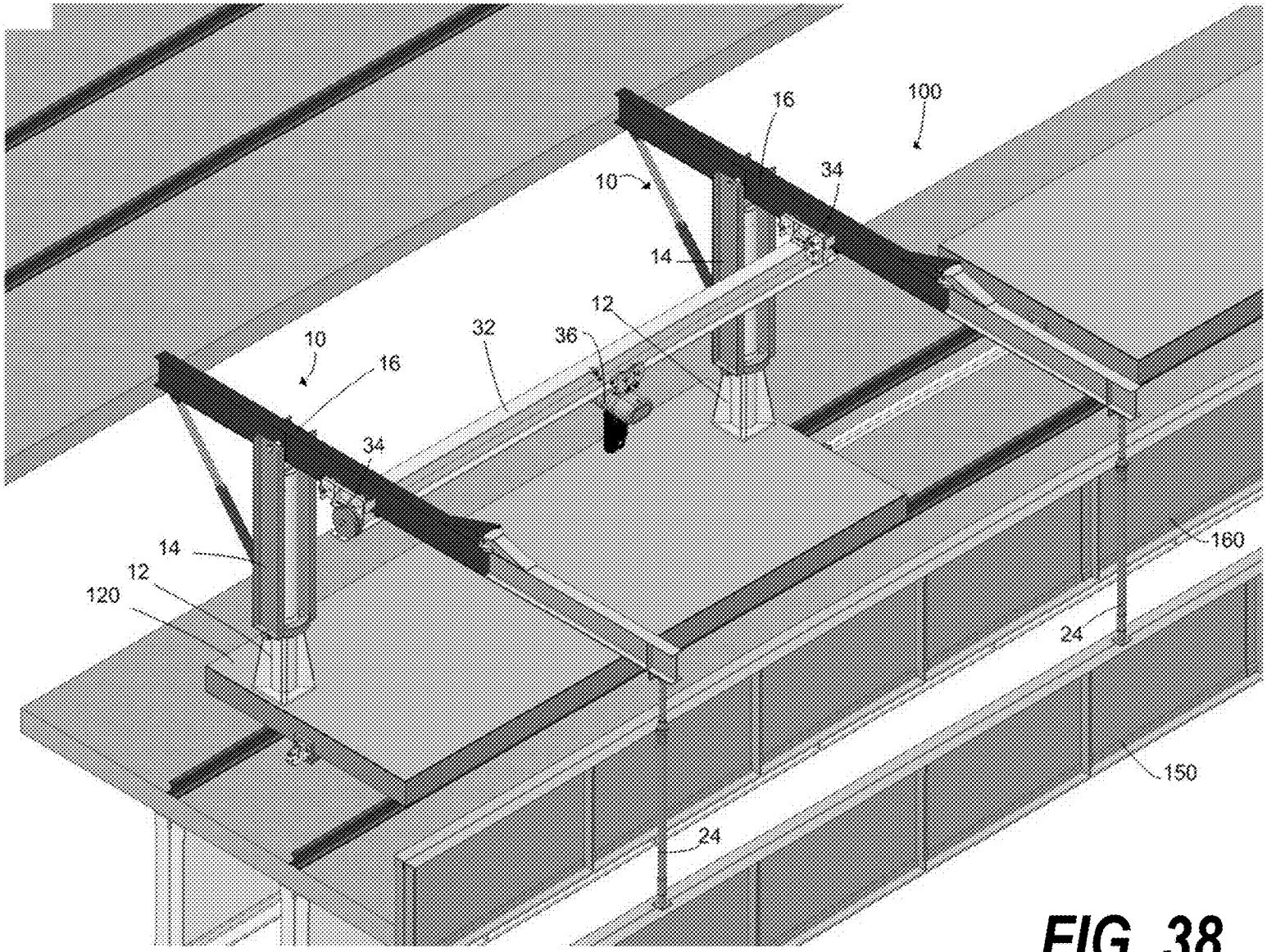
FIG. 38 is a close-up perspective view of the gantry system of FIG. 37, consistent with disclosed embodiments.
Figure 39:
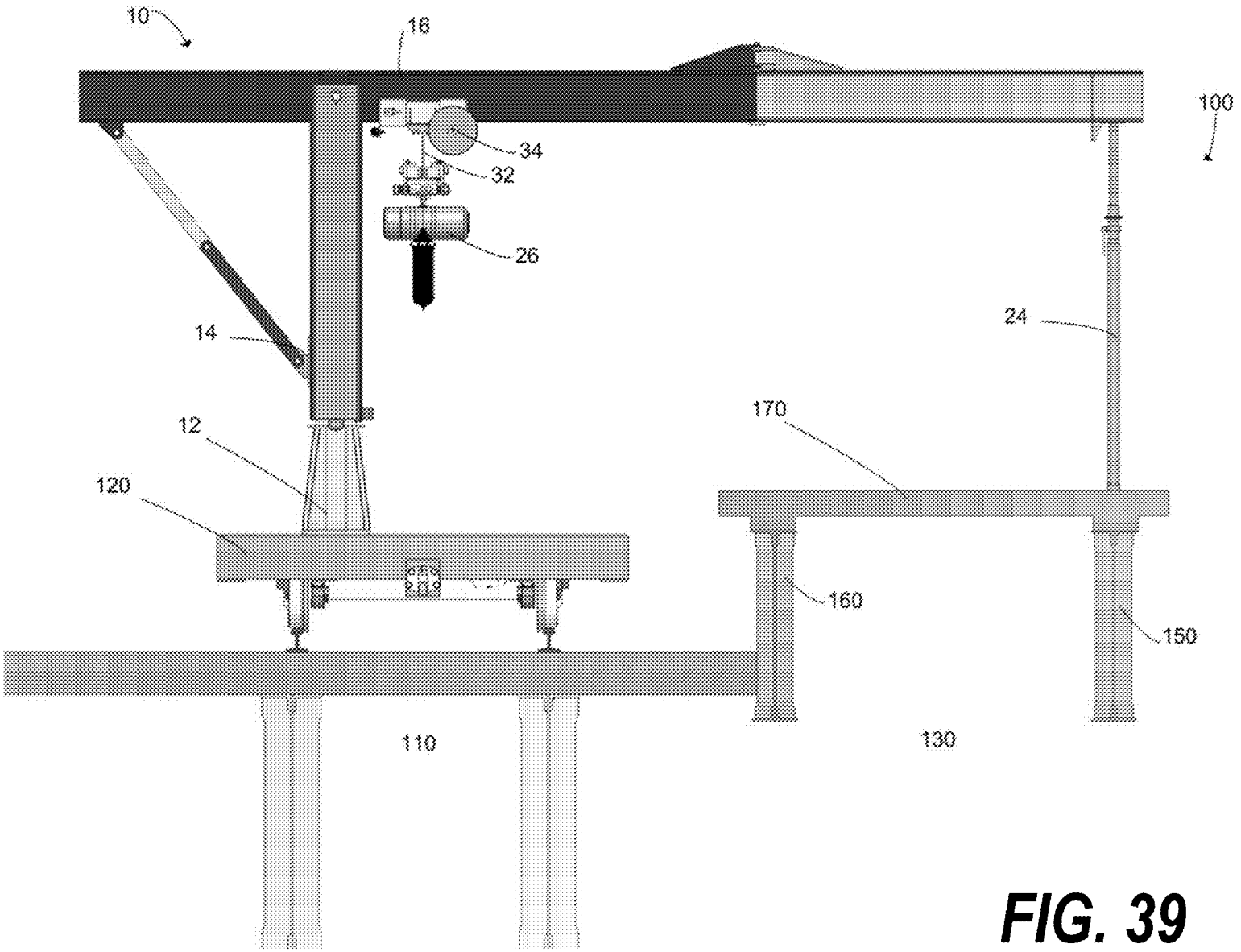
FIG. 39 is a side view of the gantry system of FIG. 37, consistent with disclosed embodiments.
Figure 40:
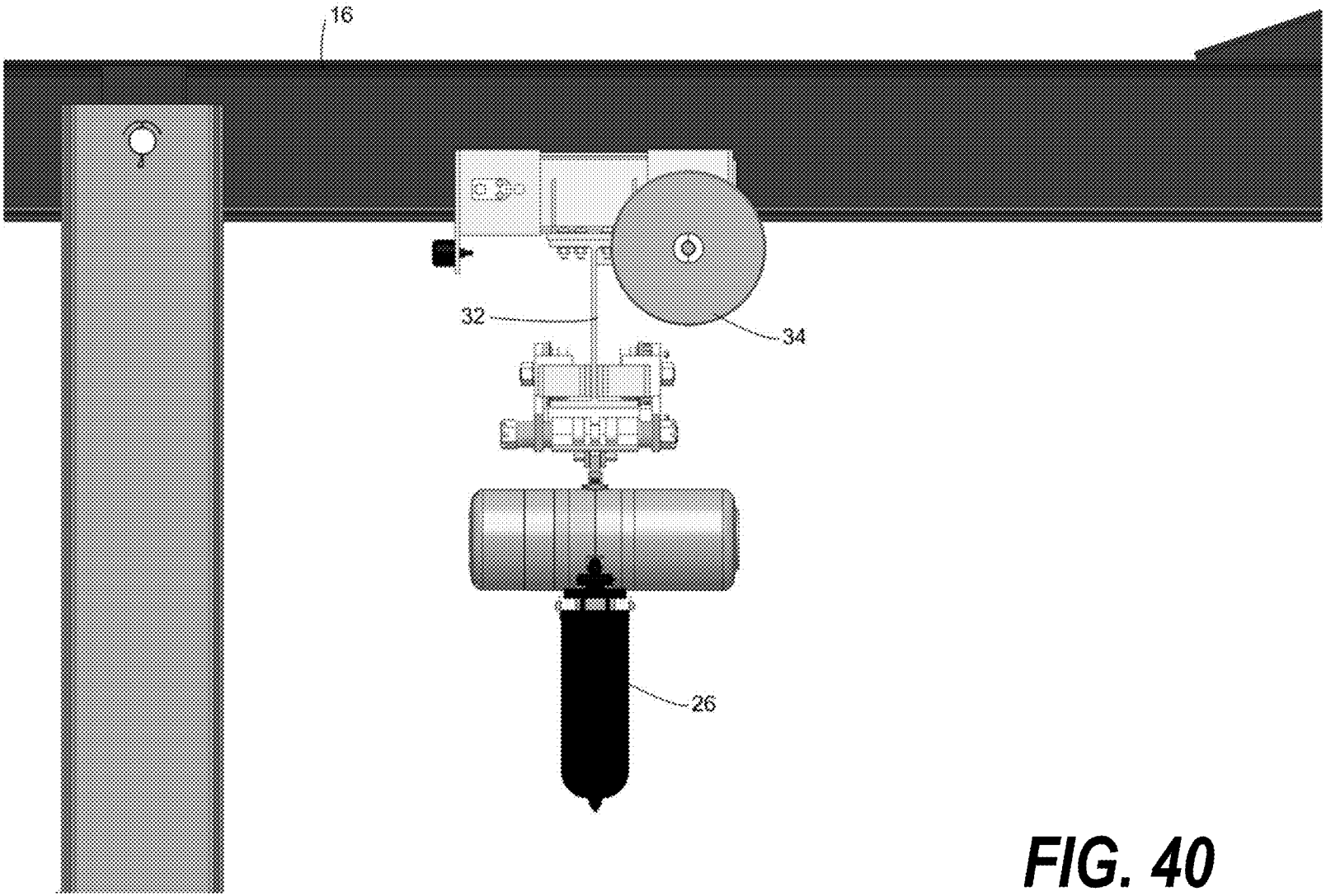
FIGS. 40-42 are various views of the gantry system, illustrating additional details of a hoist mechanism on the trolley beam of the gantry system of FIG. 37, consistent with disclosed embodiments.
Figure 41:
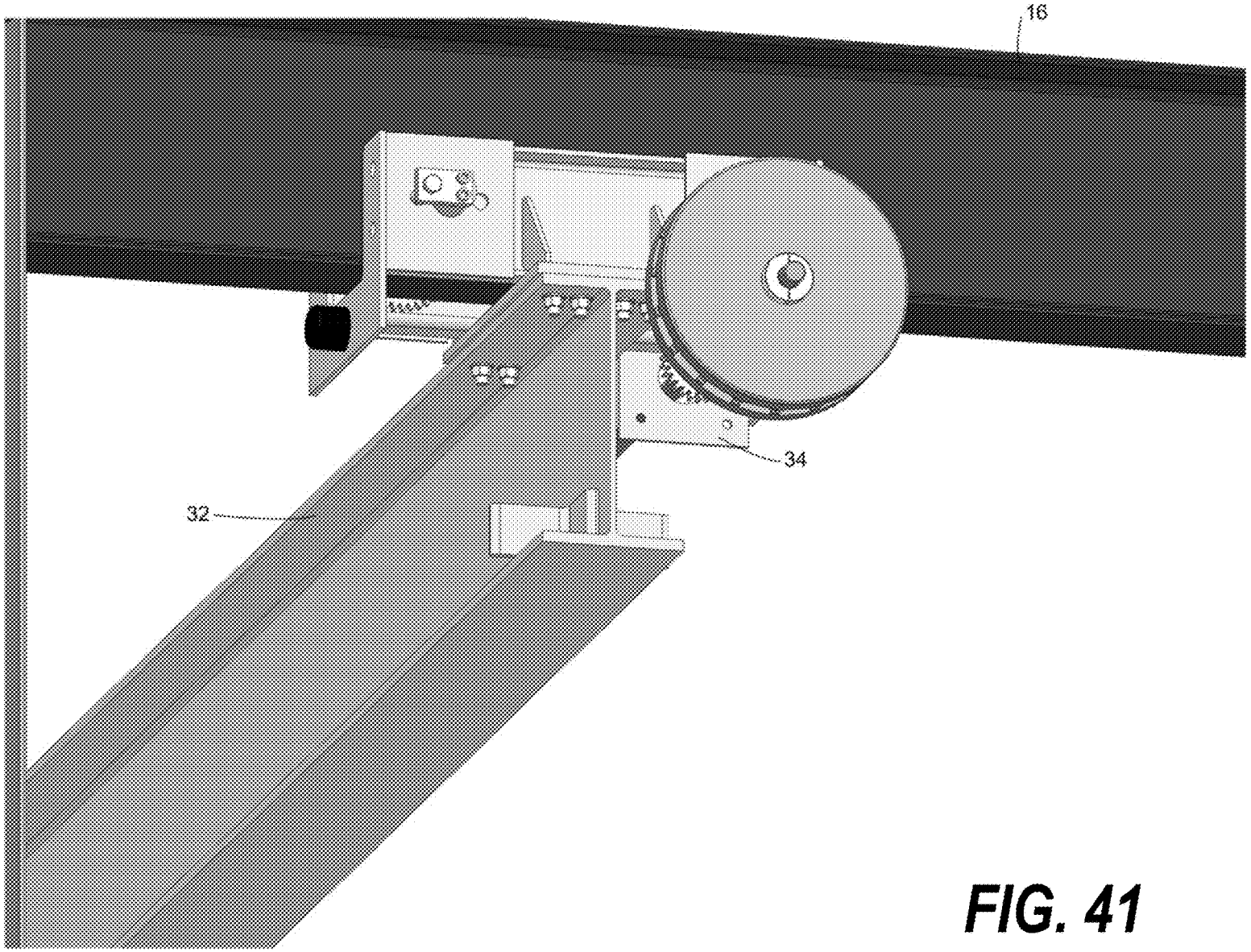
Figure 42:
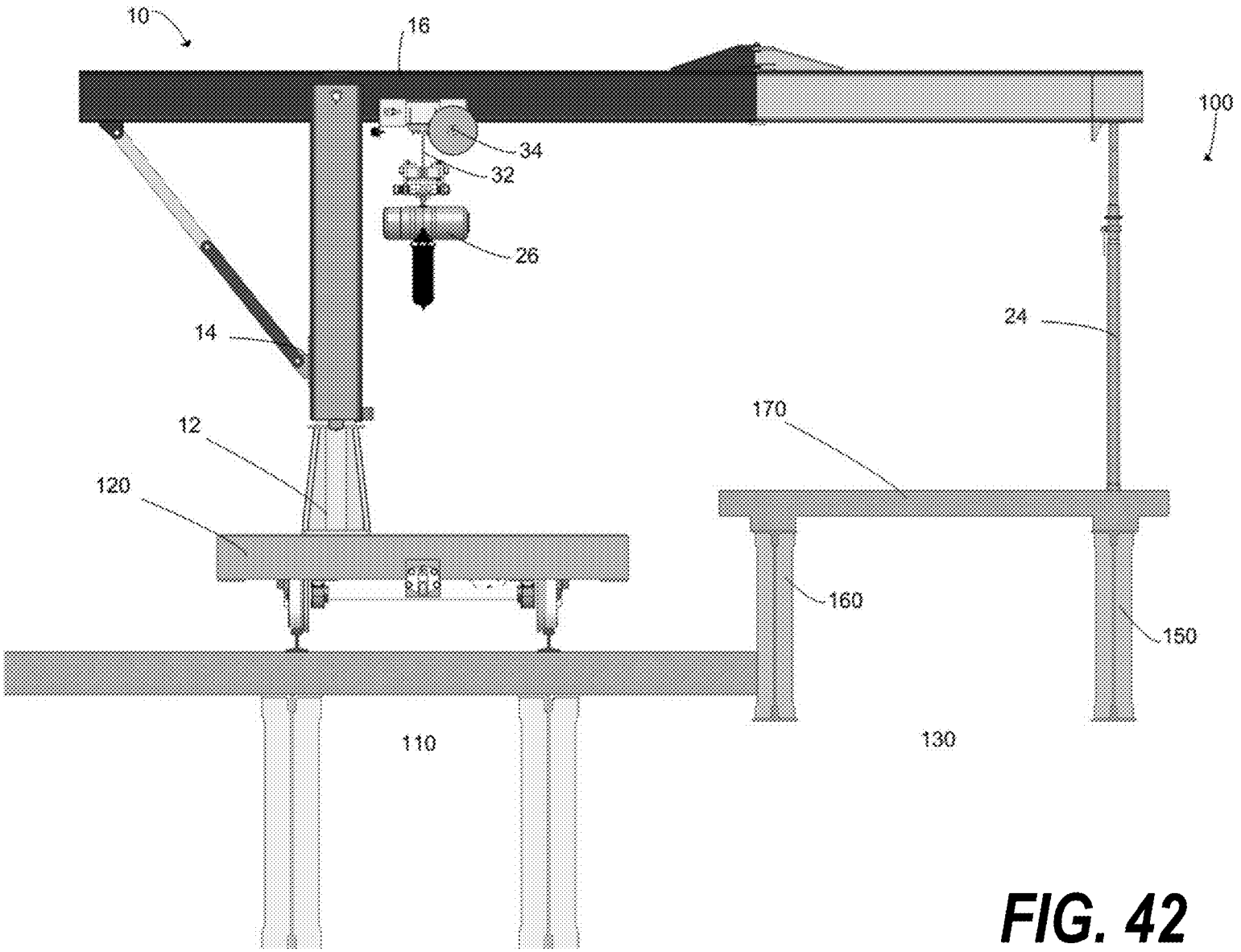
Figure 43:
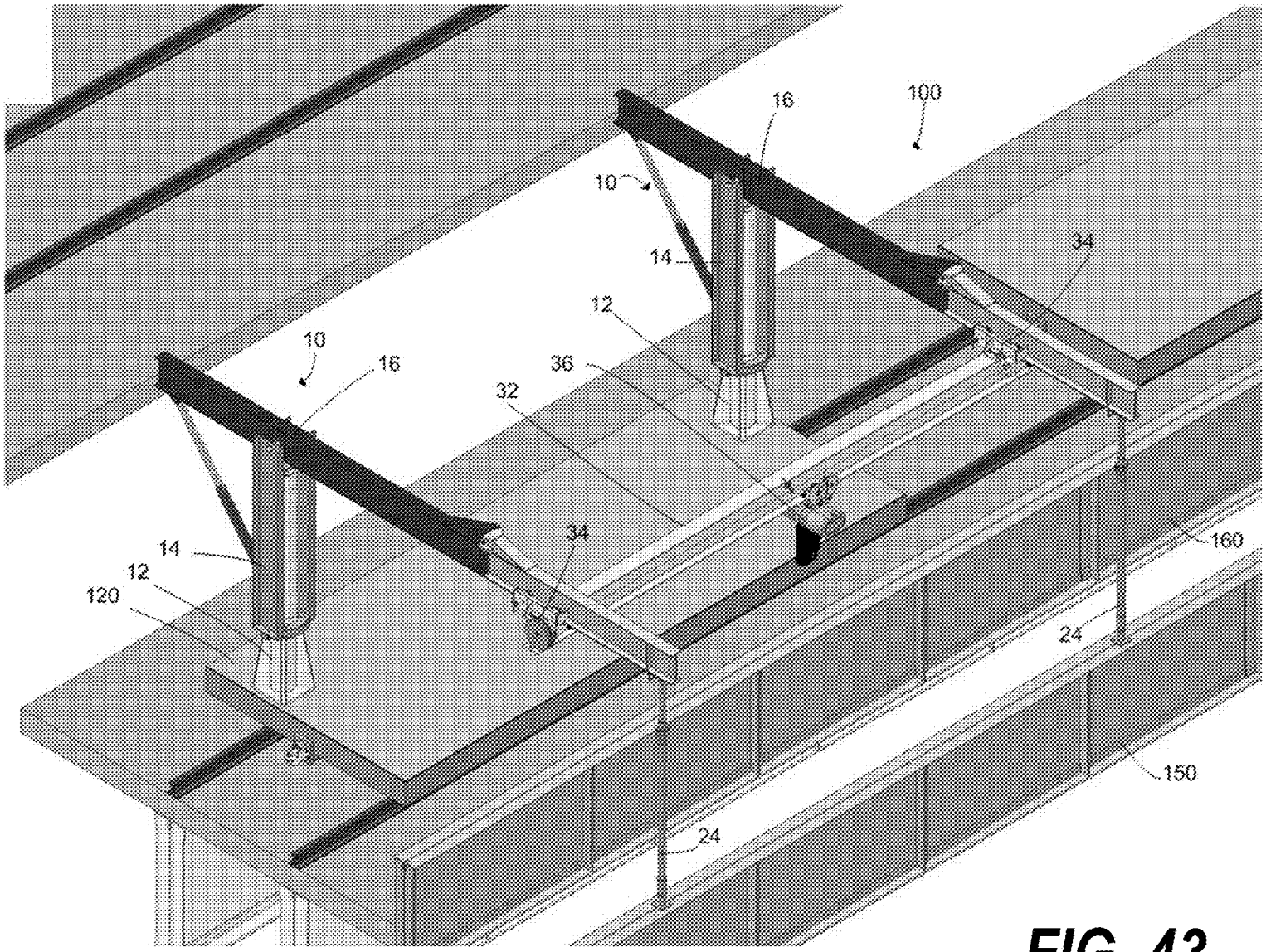
FIGS. 43-57 are perspective views of the gantry system of FIG. 30, illustrating a process for placing precast panels on the near and far girders via the hoist mechanism of FIGS. 40-42, consistent with disclosed embodiments.
Figure 44:
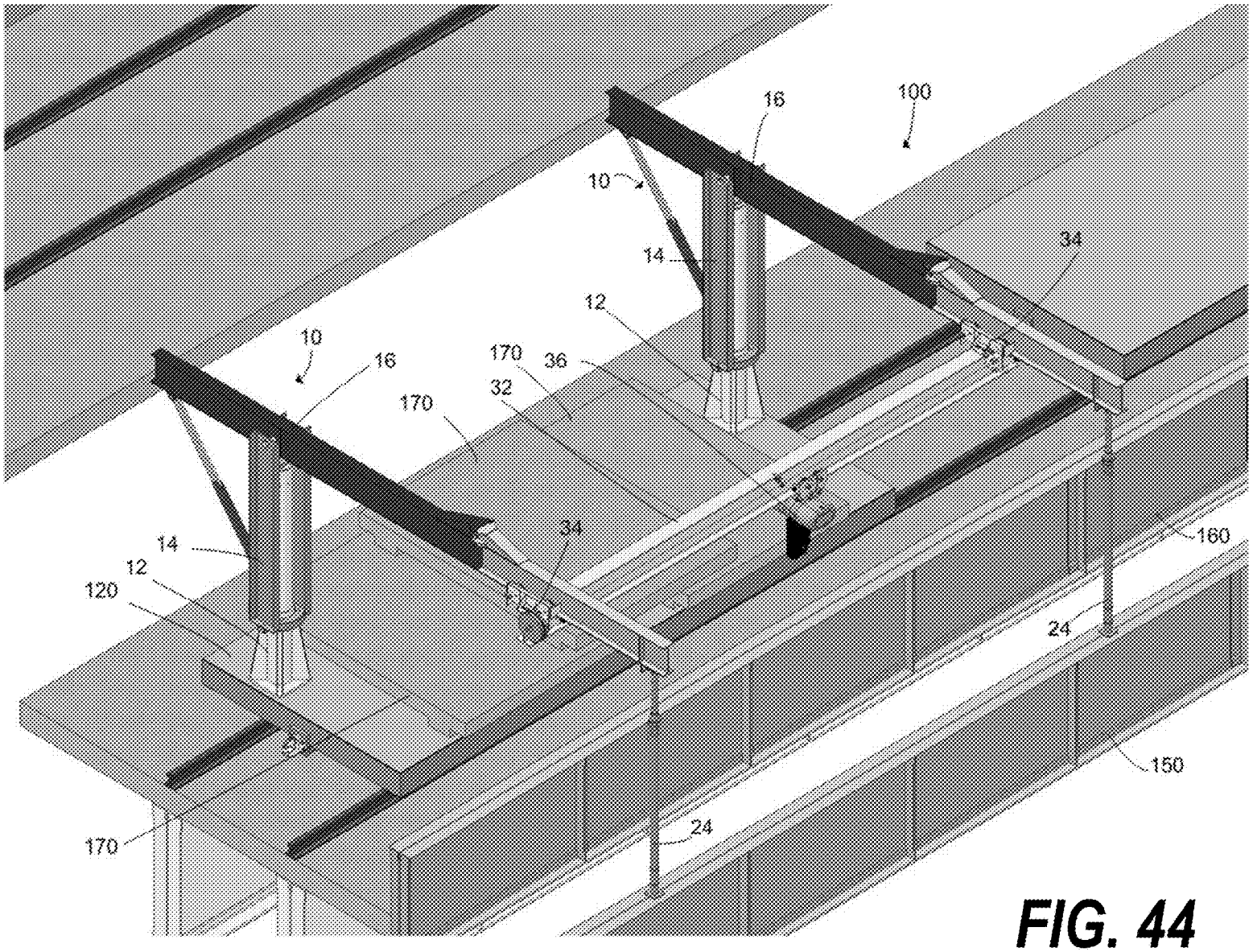
Figure 45:
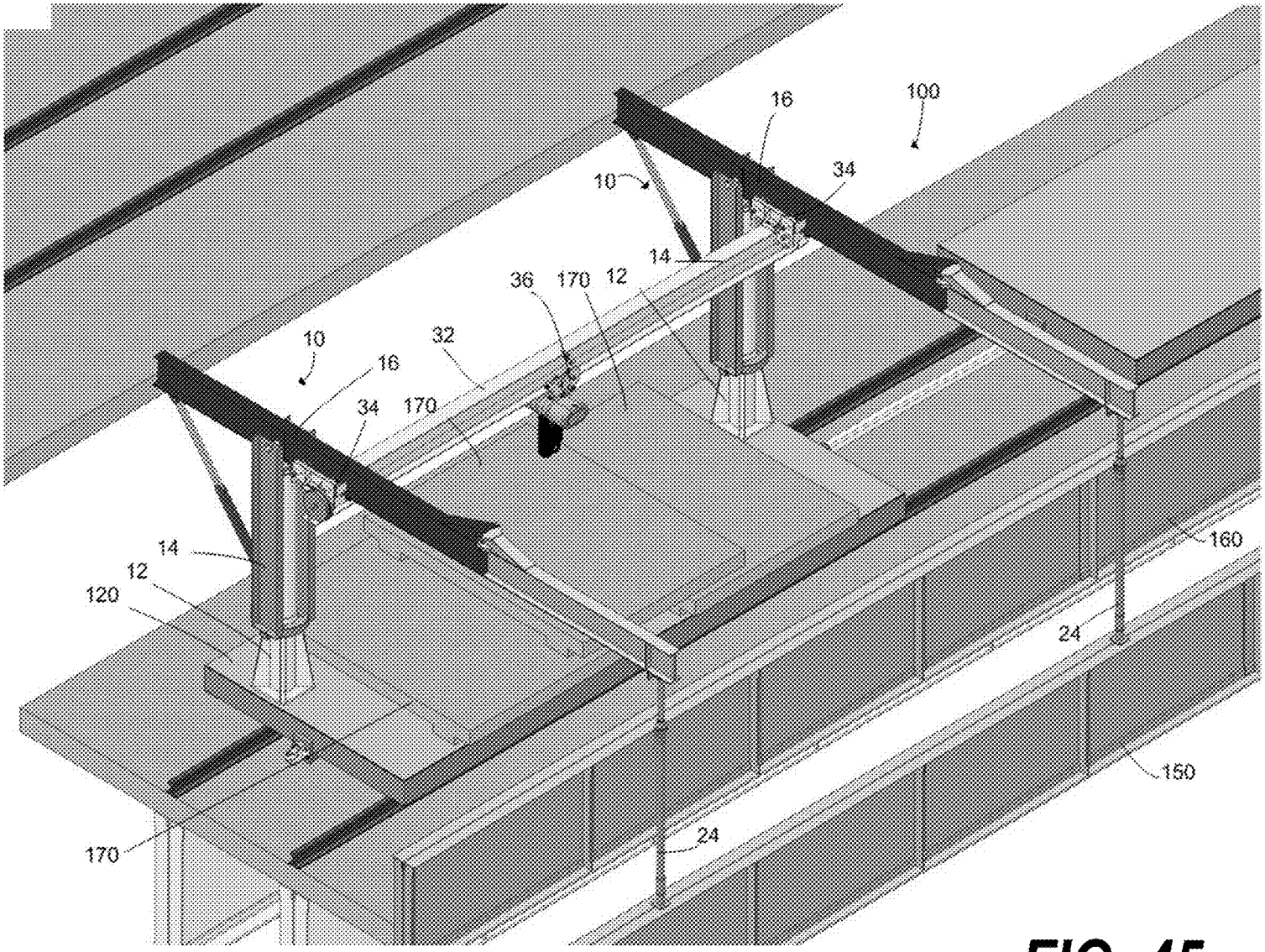
Figure 46:
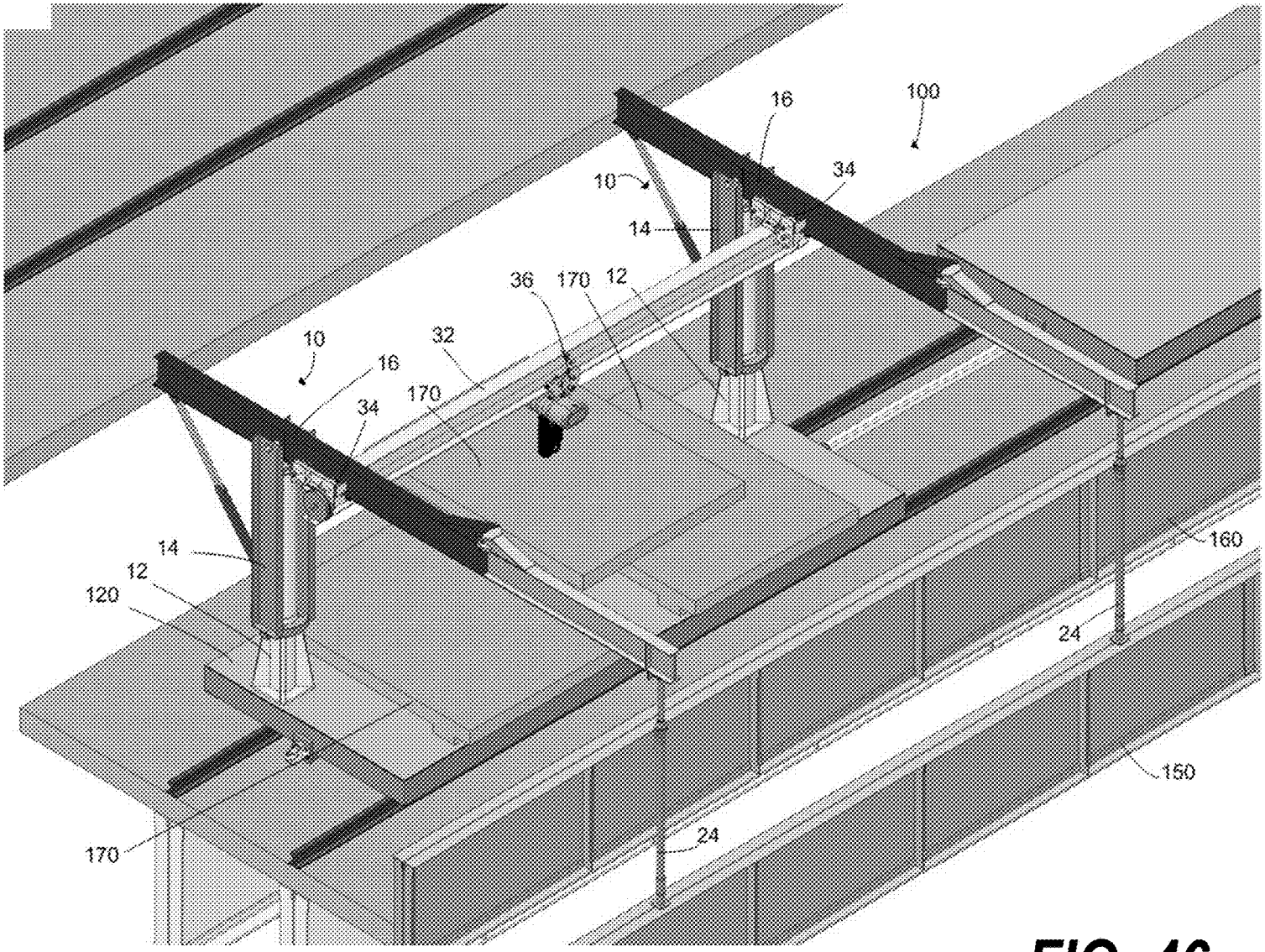
Figure 47:
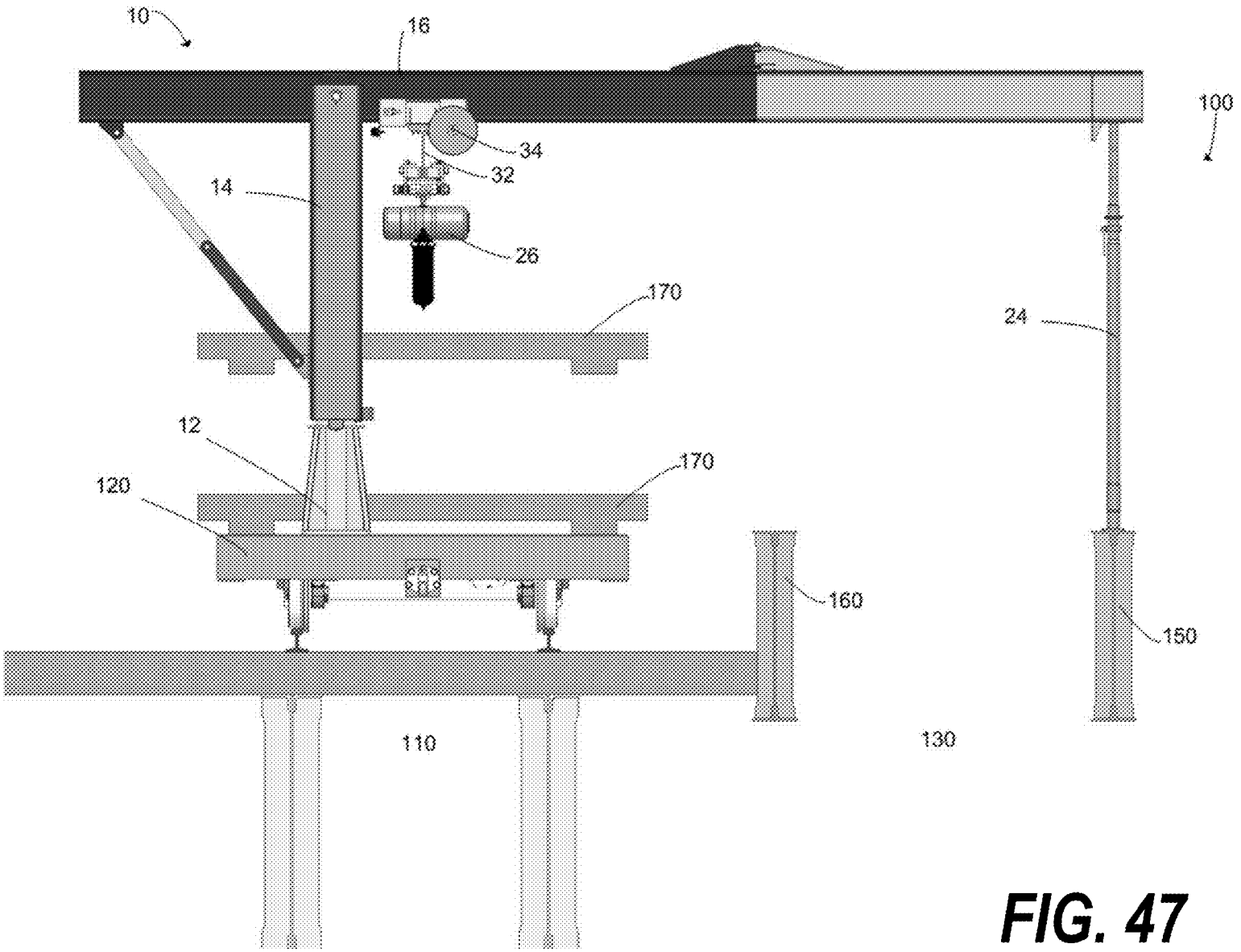
Figure 48:
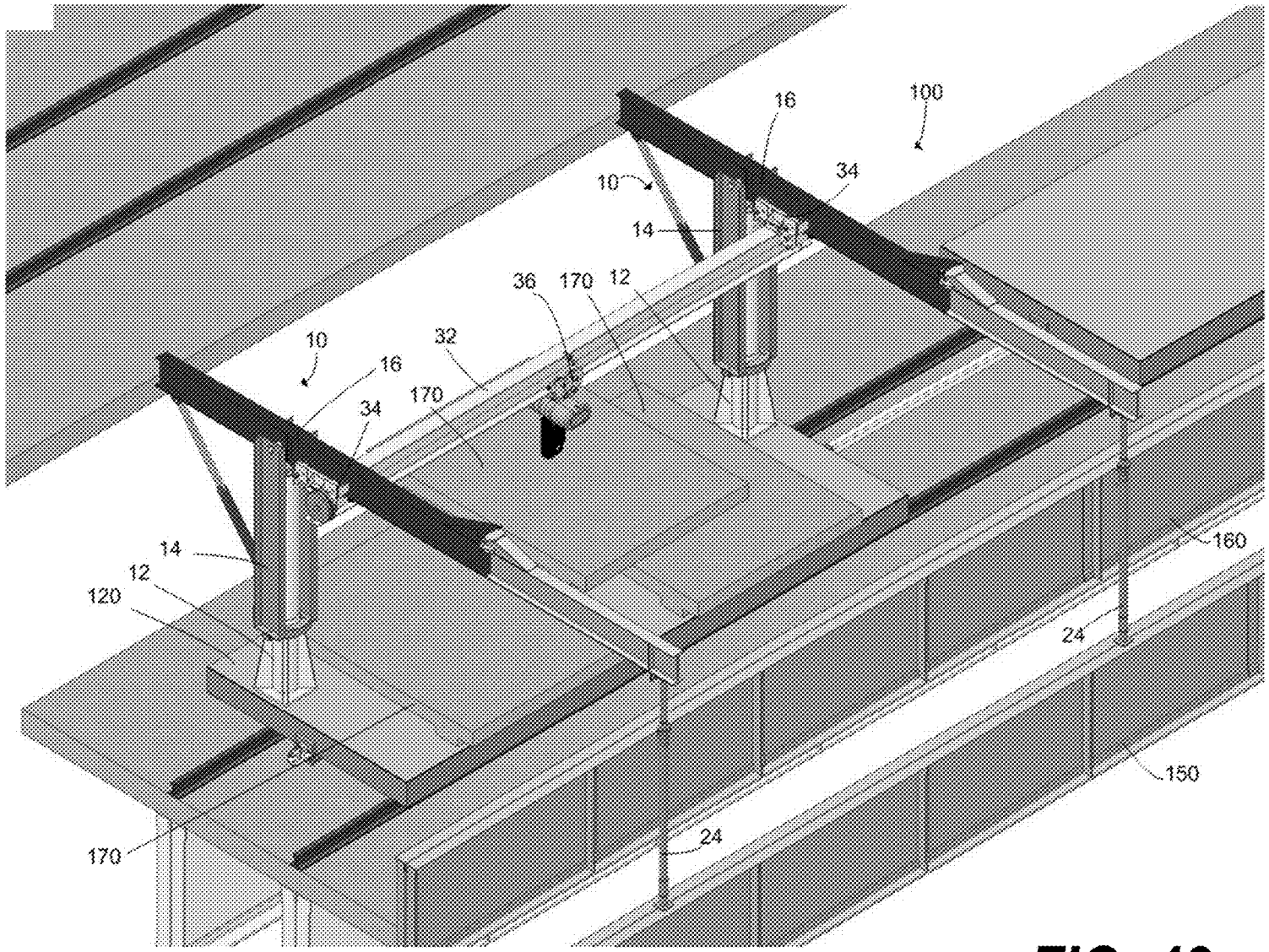
Figure 49:
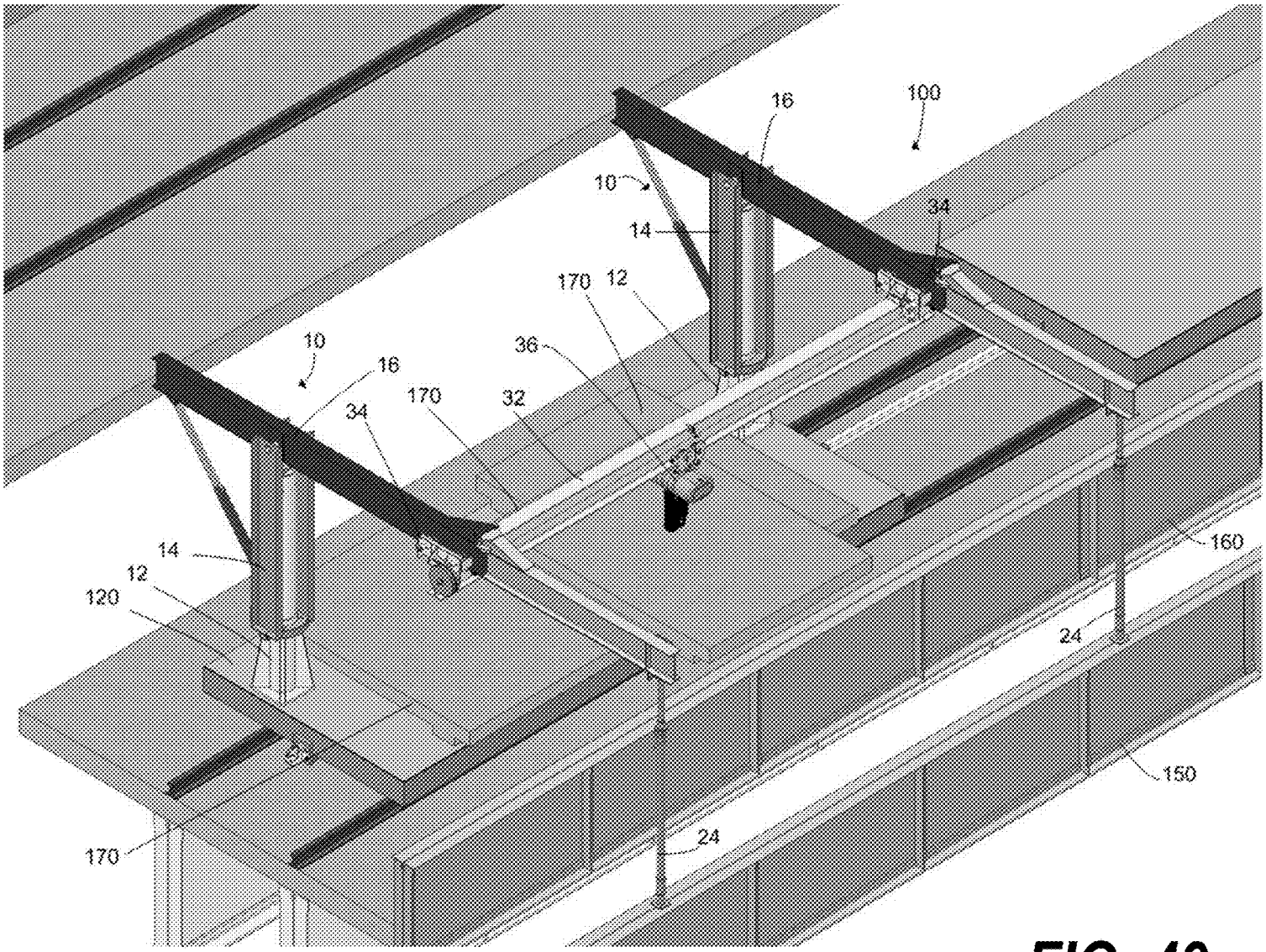
Figure 50:
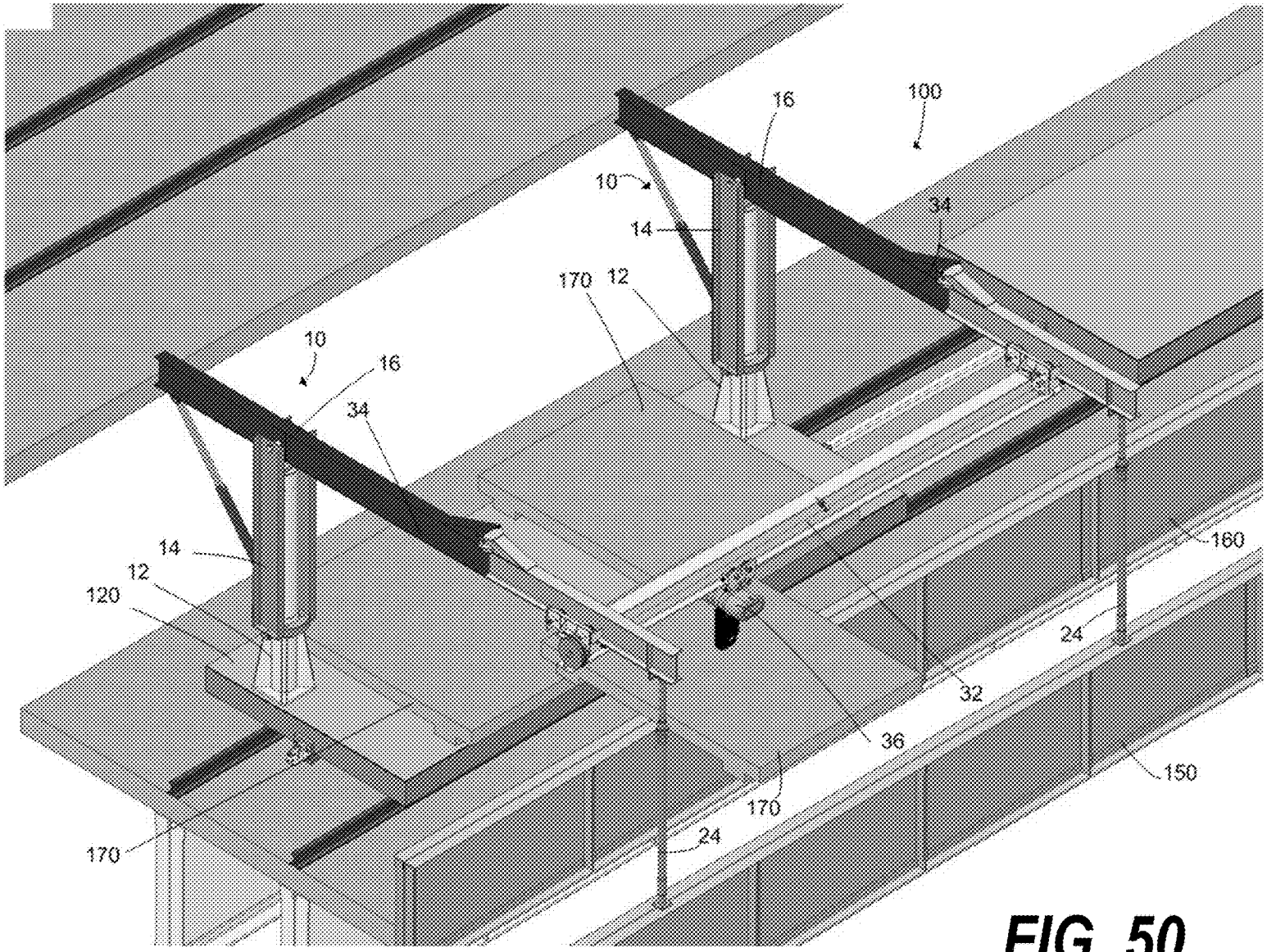
Figure 51:
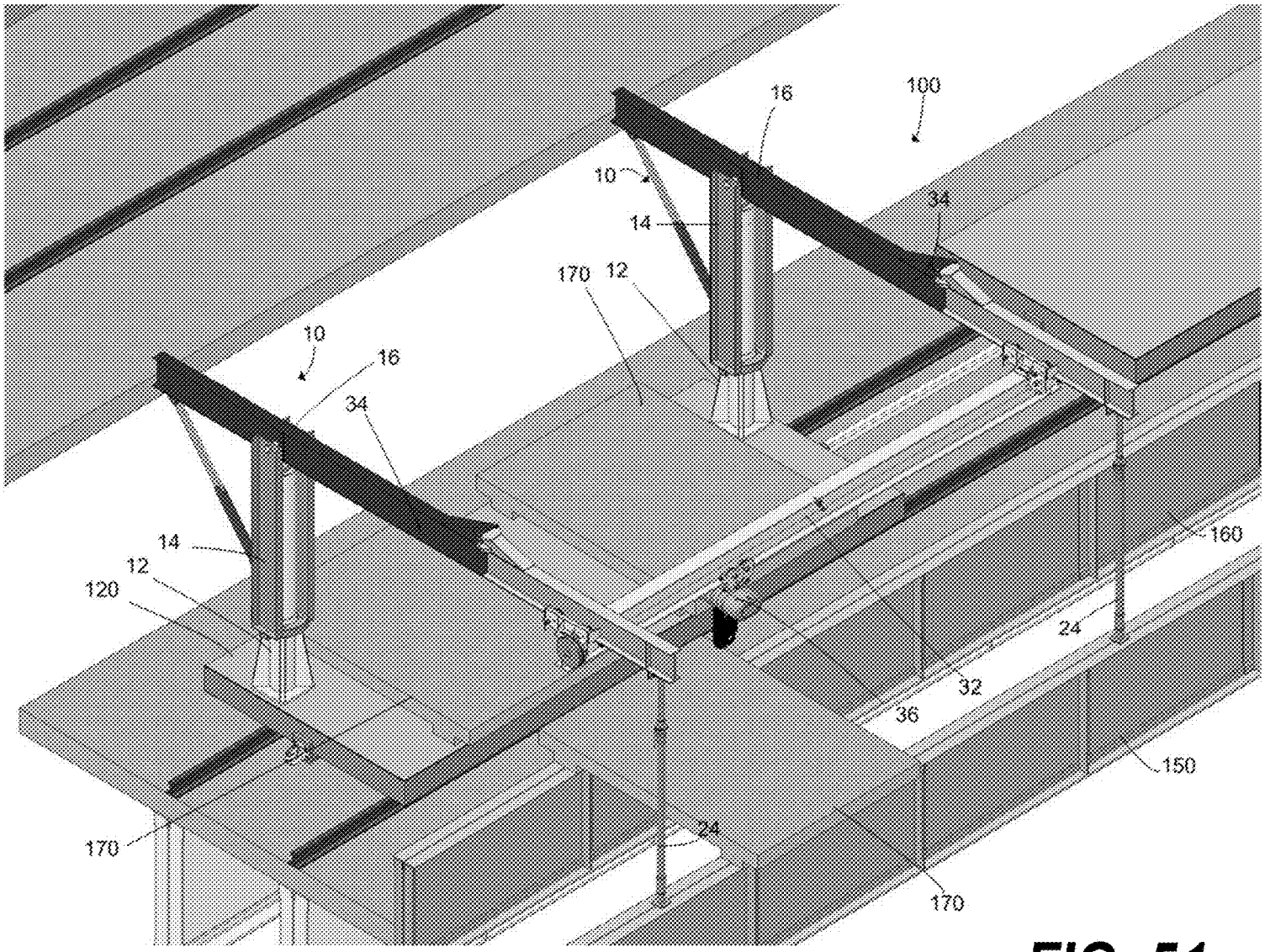
Figure 52:
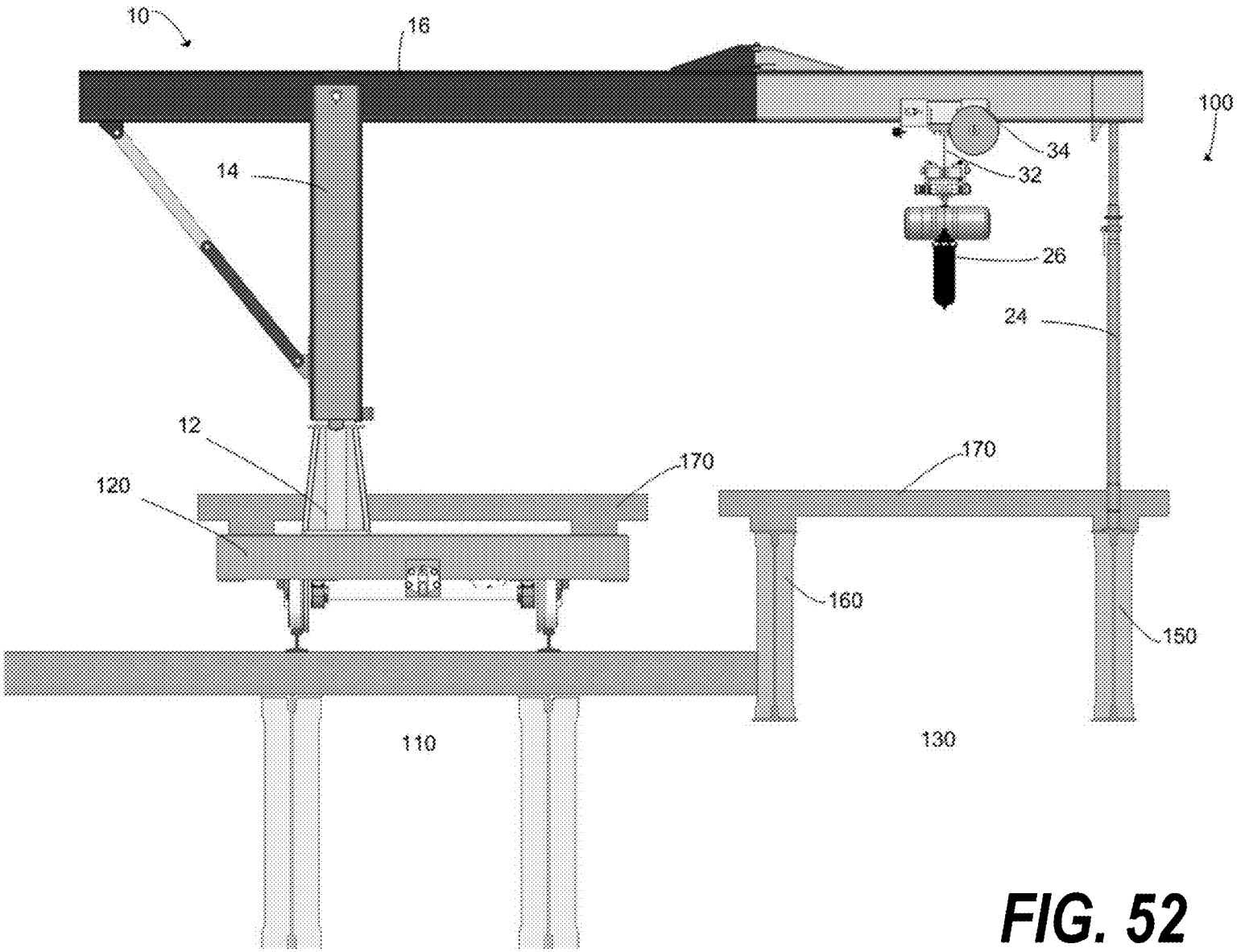
Figure 53:
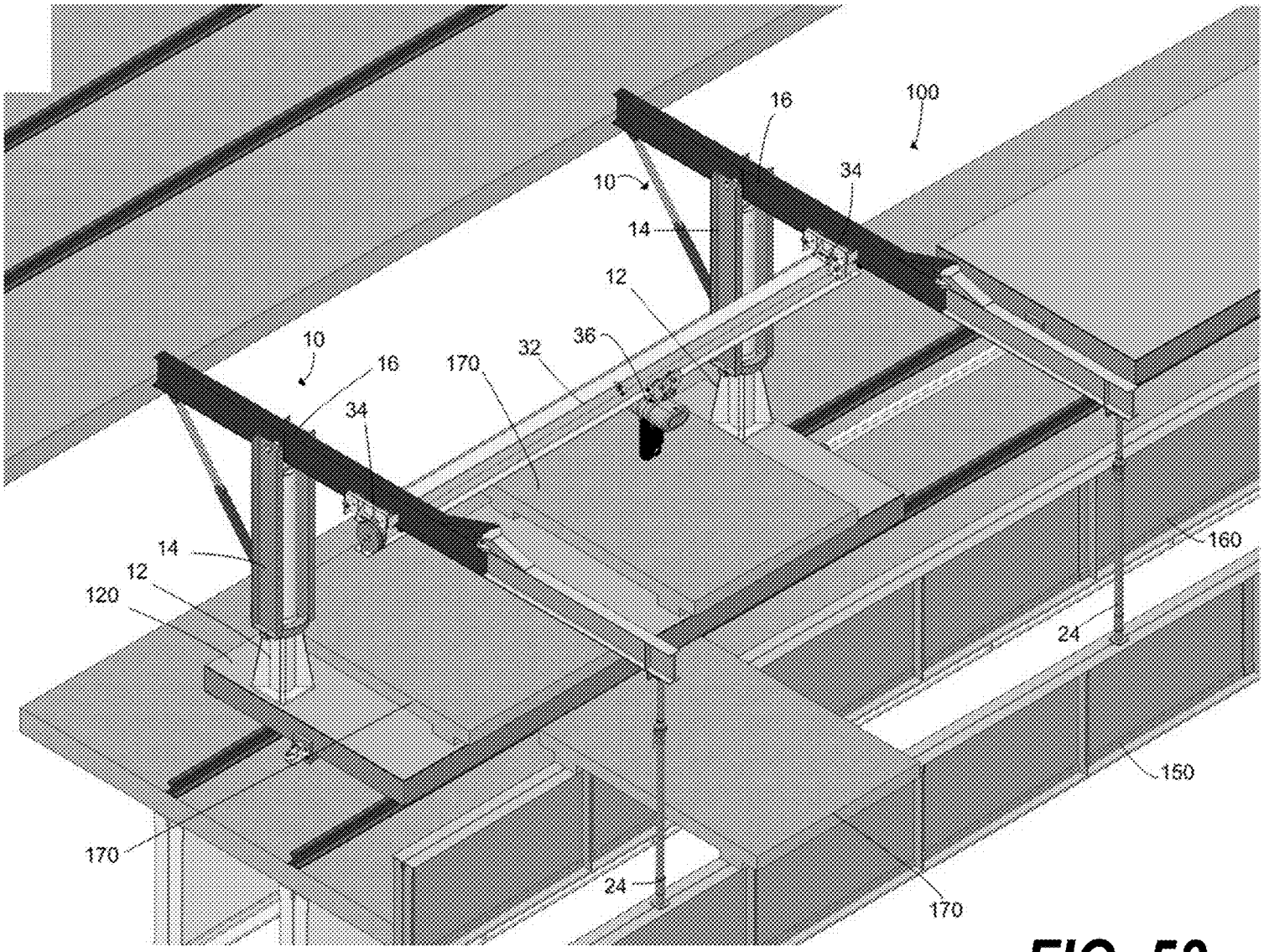
Figure 54:
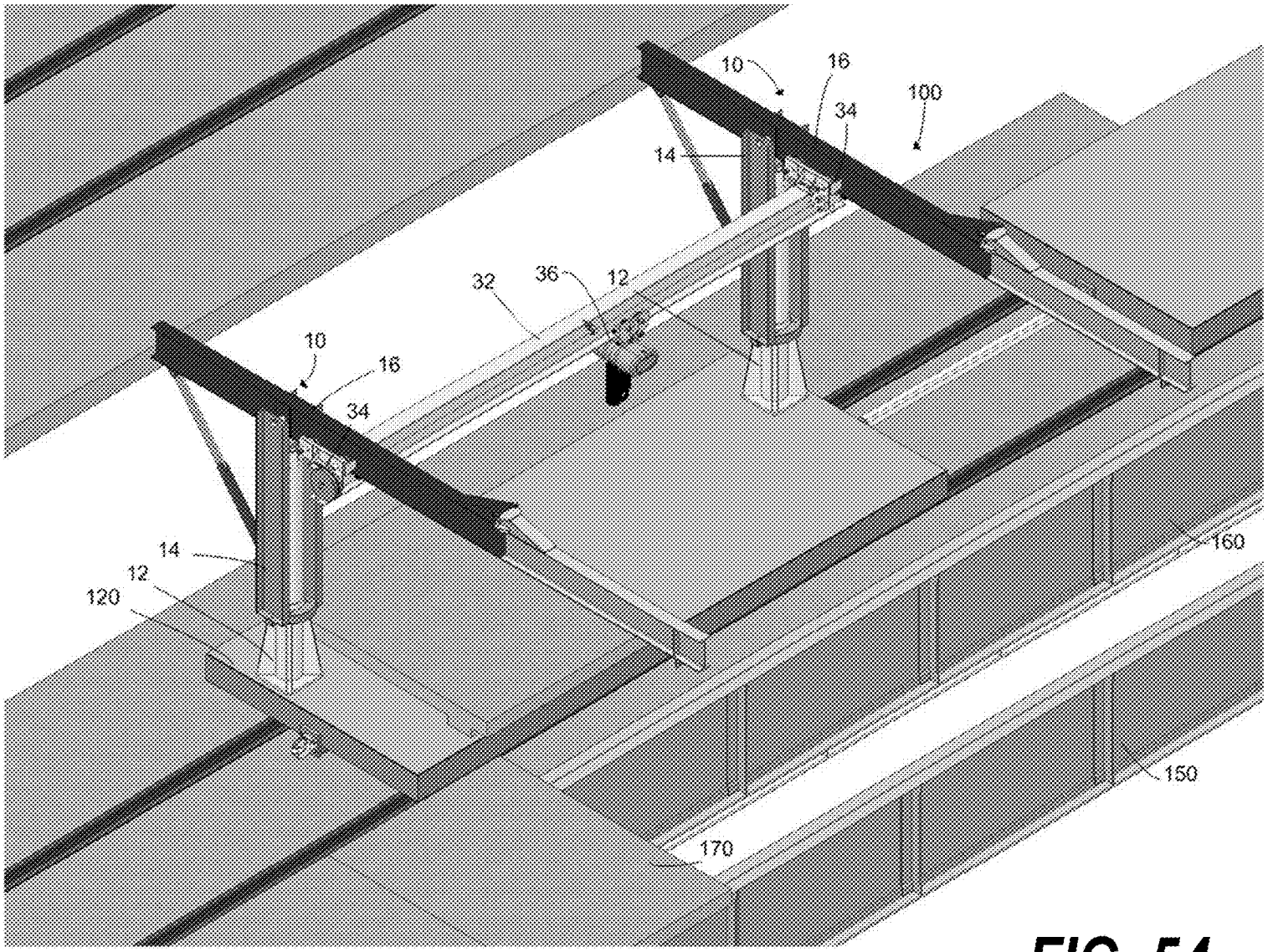
Figure 55:
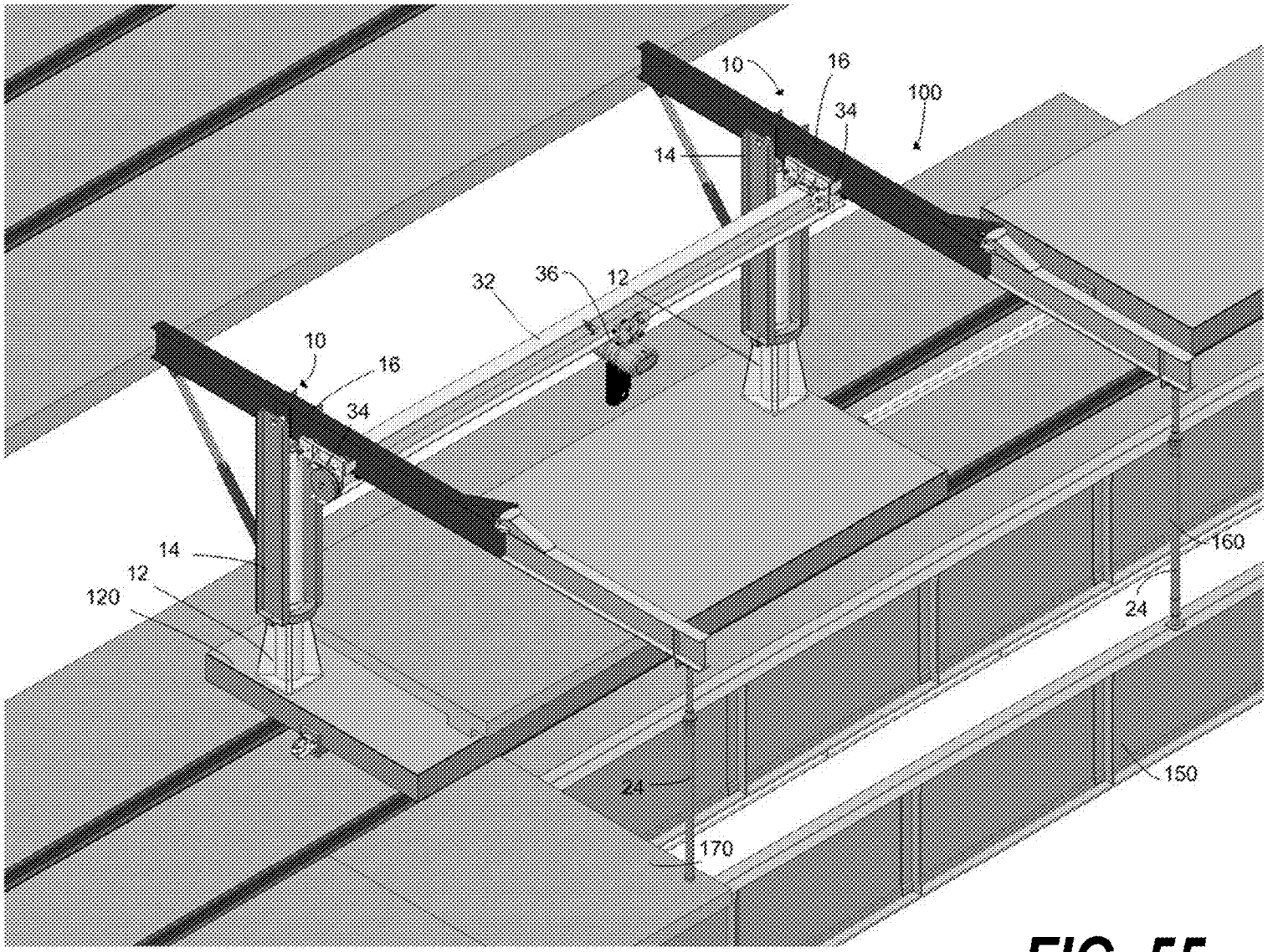
Figure 56:
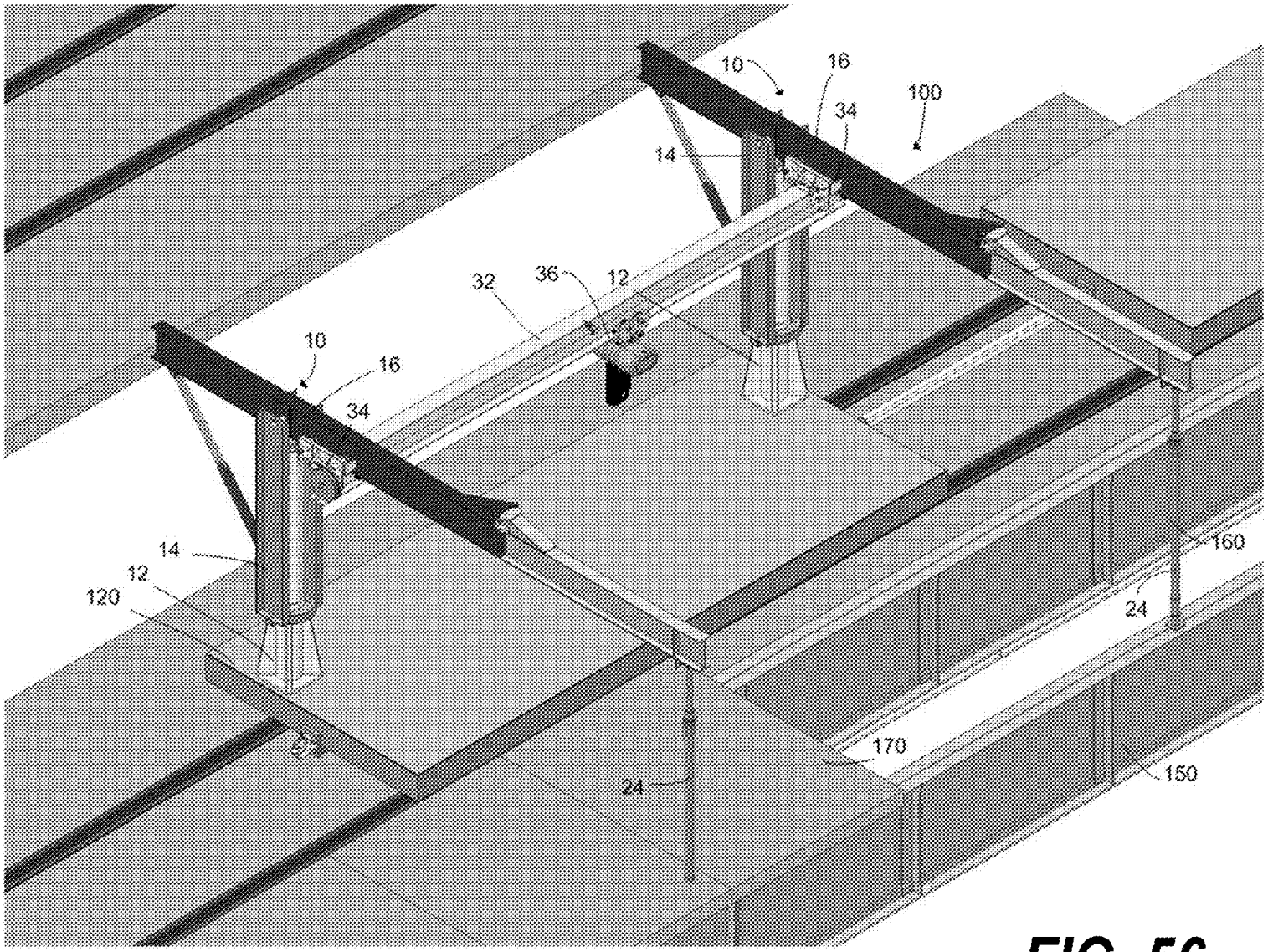
Figure 57:
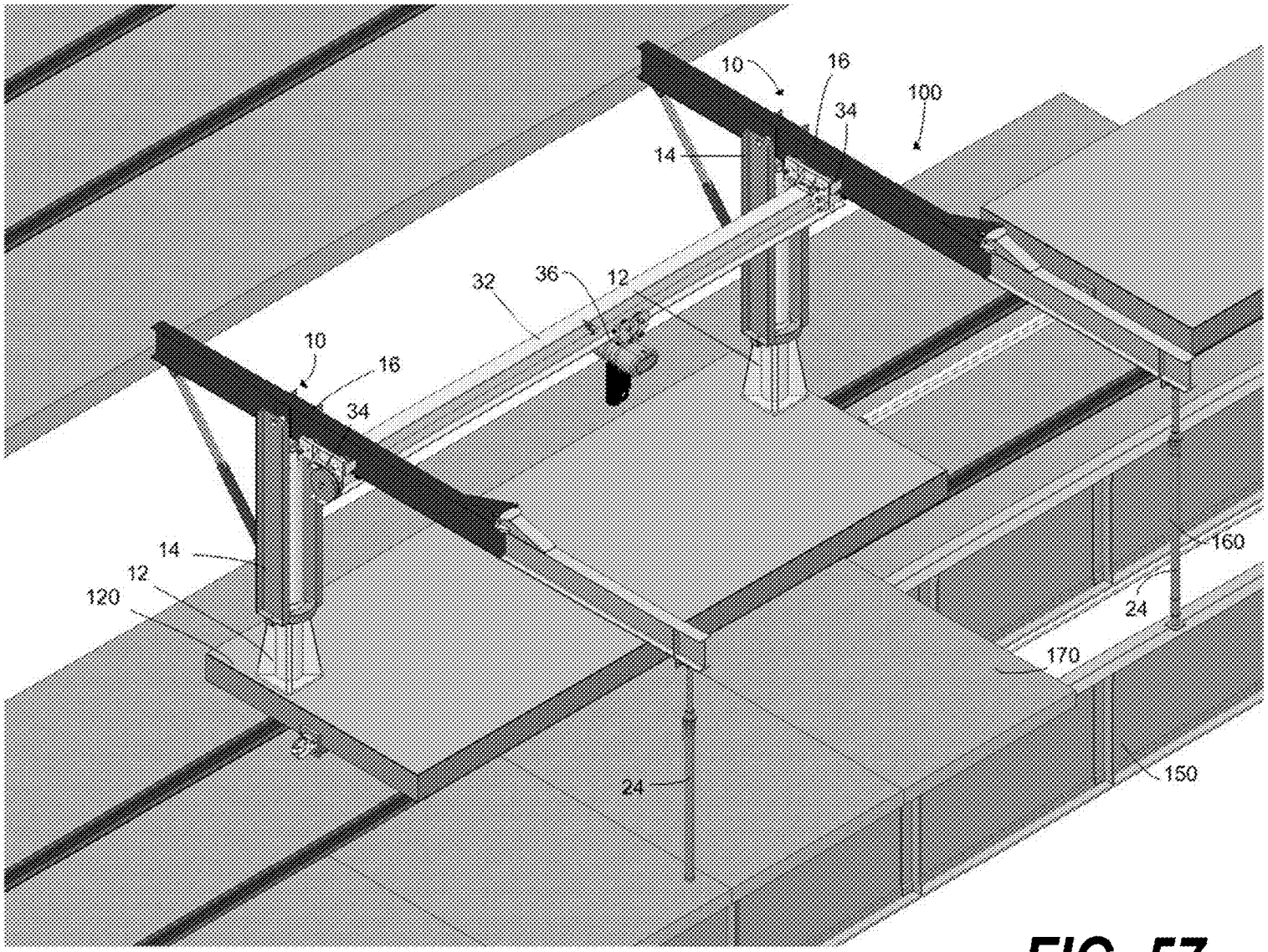

FIGS. 30 and 31 illustrate an exemplary embodiment of the gantry system 100 for use in lifting a precast panel for placement on the girders 150 and 160. In this embodiment, two crane assemblies 10 may be positioned on the same moveable platform 120, such as a 60,000 lb. capacity flatcar. The crane arms 16 of the crane assemblies 10 may be connected by a trolley beam 32 that is bolted to movable runners 34 on each crane arm 16. The trolley beam 32 may be configured to move along the length of the crane arms 16 while remaining perpendicular thereto, via runners 34. The distal ends of the crane arms 16 may be connected to support posts 24 for supporting a weight of a load suspended by the trolley beam 32. The support posts 24 are positioned at longitudinally-spaced locations on the far girder 150. A hoist 36 may be connected to the trolley beam 32 for lifting precast panels 170 (or other components in need of lifting/moving).

FIGS. 32-38 further illustrate various positions for setting up the gantry assembly to be used to install precast panels 170 that form the platform area 130 floor, after the replacement girder 160 is installed, for instance. The crane assemblies 10 are moved into position on the same moveable platform 120. The crane arms 16 may be extended and/or rotated to a position such that they are parallel to one another and perpendicular to the girders 150, 160. The trolley beam 32 is connected between the crane arms 16 via the runners 34. The hoist 36 is connected to the trolley beam 32.

FIGS. 39-42 further illustrate exemplary features of the trolley beam 32, the runners 34, and the hoist 36. For instance, the trolley beam 32 may be an I-beam bolted to the runners 34. The hoist 36 may be a heavy-duty lifting mechanism, such as a 3-Ton lifting hoist with a geared drive mechanism for moving along the trolley beam 32 and/or driving the trolley beam 32 along the length of the crane arms 16.

FIGS. 43-48 illustrate steps of an exemplary process for lifting a precast panel 170. One or more precast panels 170 (e.g., a 4,500 lb. concrete slab) may be positioned between the crane assemblies 10 on the moveable platform 120. The trolley beam 32 may be driven to position the hoist 36 above the center of the panel 170. The hoist 36 may be lowered and connected to the panel 170 and driven to lift the panel off of the platform 120. FIGS. 49-52 illustrate additional steps for moving the precast panel 170 into position and lowering it onto the girders 150, 160. FIGS. 53-57 illustrate additional steps for repeating the process for sequentially placing precast panels 170 into position on top of the girders 150, 160. The moveable platform 120 can traverse along the rails of the railway area 110 and the hoist 36 can traverse in the same direction along the trolley beam 32 to precisely position the precast panels 170 next to each other to form a platform for the station.

The disclosed embodiments provide a gantry system for efficiently utilizing a compact area to lift and place heavy-duty components of a train or subway station, such as girders and precast panels of a platform area, especially of a hard-to-reach platform such as at an elevated station. The gantry system utilizes the rails of a railway area to move crane assemblies into place and places support on existing girder beams to provide support for the weight of a suspended load. The disclosed crane arms are rotatable between a stowed and action position to further reduce the footprint of the gantry and enable the aforementioned support on existing girders. The gantry assembly provides heavy-duty lifting capabilities for moving a replacement girder from a moveable platform into position at the station, and for utilizing the same components to place precast panels on top of the girders for forming the platform.

The present description and claims may make use of the terms "a," "at least one of," and "one or more of," with regard to particular features and elements of the illustrative embodiments. It should be appreciated that these terms and phrases are intended to state that there is at least one of the particular feature or element present in the particular illustrative embodiment, but that more than one can also be present. That is, these terms/phrases are not intended to limit the description or claims to a single feature/element being present or require that a plurality of such features/elements be present. To the contrary, these terms/phrases only require at least a single feature/element with the possibility of a plurality of such features/elements being within the scope of the description and claims.

In addition, it should be appreciated that the following description uses a plurality of various examples for various elements of the illustrative embodiments to further illustrate example implementations of the illustrative embodiments and to aid in the understanding of the mechanisms of the illustrative embodiments. These examples are intended to be non-limiting and are not exhaustive of the various possibilities for implementing the mechanisms of the illustrative embodiments. It will be apparent to those of ordinary skill in the art in view of the present description that there are many other alternative implementations for these various elements that may be utilized in addition to, or in replacement of, the example provided herein without departing from the spirit and scope of the present invention.

The system and processes of the figures are not exclusive. Other systems, processes and menus may be derived in accordance with the principles of embodiments described herein to accomplish the same objectives. It is to be understood that the embodiments and variations shown and described herein are for illustration purposes only. Modifications to the current design may be implemented by those skilled in the art, without departing from the scope of the embodiments. As described herein, the various systems, subsystems, agents, managers, and processes can be implemented using hardware components, software components, and/or combinations thereof. No claim element herein is to be construed under the provisions of 35 U.S.C. 112, sixth paragraph, unless the element is expressly recited using the phrase "means for."

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

The invention claimed is:

1. A gantry system, comprising:

a crane assembly comprising:

a stationary base mounted to a moveable platform;

a rotating base configured to rotate with respect to said stationary base;

a crane arm attached perpendicularly to said rotating base;

a support post attached to a distal end of the crane arm, wherein the support post is configured to sit upon a longitudinal girder and contribute to supporting the weight of a load suspended by the crane arm; and a hoist being connected to said crane arm such that said hoist can move along the length of said crane arm.

2. The gantry system of claim 1, wherein said crane assembly has a stowed position and an action position, the crane arm being rotatable at least 90 degrees via the rotating base between the stowed position and the action position.

3. The gantry of claim 1, wherein said crane arm comprises a base arm and an arm extension foldably connected by a hinge mechanism.

4. The gantry of claim 1, wherein the crane arm is one integral structure from a proximal end to a distal end.

5. The gantry of claim 1, wherein the support post is removable from the distal end of the crane arm.

6. The gantry system of claim 1, further comprising a second crane assembly comprising a second crane arm and a second support post configured to sit upon the longitudinal girder and contribute to supporting the weight of a load suspended by the second crane arm.

7. The gantry system of claim 6, wherein the crane assembly and the second crane assembly are configured to lift a replacement girder via the hoist and a second hoist connected to the second crane arm.

8. The gantry system of claim 6, wherein the crane assembly and the second crane assembly are mounted to different moveable platforms tethered to each other.

9. The gantry system of claim 6, wherein the crane arm and the second crane arm are connected to each other by a trolley beam.

10. The gantry system of claim 9, wherein the trolley beam is connected to each of the crane arm and the second crane arm by a moveable runner that is drivable along a length of the crane arm to move the trolley beam.

11. The gantry system of claim 10, wherein the hoist is connected to the trolley beam.

12. The gantry system of claim 11, wherein the hoist is moveable along a length of the trolley beam.

* * * * *